US012115460B2

(12) United States Patent
Dym

(10) Patent No.: US 12,115,460 B2
(45) Date of Patent: Oct. 15, 2024

(54) METHODS, MOTIFS, AND KITS FOR EMERGENT PATTERN GAMES AND WORKSHOPS FOR INDIVIDUALS, COLLABORATORS, AND TEAMS

(71) Applicant: Miriam Dym, Berkeley, CA (US)

(72) Inventor: Miriam Dym, Berkeley, CA (US)

(73) Assignee: Miriam Dym, Berkeley, CA (US)

( * ) Notice: Subject to any disclaimer, the term of this patent is extended or adjusted under 35 U.S.C. 154(b) by 51 days.

(21) Appl. No.: 17/561,967

(22) Filed: Dec. 26, 2021

(65) Prior Publication Data

US 2022/0203218 A1 Jun. 30, 2022

Related U.S. Application Data

(63) Continuation-in-part of application No. 17/485,313, filed on Sep. 24, 2021.
(Continued)

(51) Int. Cl.
*A63F 9/06* (2006.01)

(52) U.S. Cl.
CPC ..... *A63F 9/0612* (2013.01)

(58) Field of Classification Search
CPC ..... A63F 3/00097; A63F 2003/00747; A63F 2003/00753; A63F 2003/00757; A63F 2003/0076; A63F 2003/00763; A63F 2003/00766; A63F 2003/00769; A63F 2003/00772; A63F 2003/00776; A63F 2003/00779; A63F 2003/00782; A63F 2003/00785; A63F 2003/00788; A63F 2003/00823; A63F 2003/00835;
(Continued)

(56) References Cited

U.S. PATENT DOCUMENTS 5,520,388 A * 5/1996 Osborn ..... B44C 3/123 428/44
2006/0145420 A1* 7/2006 Micarelli ..... A63F 3/00 273/284

* cited by examiner

*Primary Examiner* — Lawrence S Galka

(57) ABSTRACT

This invention provides motifs, kits and methods for playing emergent pattern games. The motifs lack various types of symmetry and may be bilaterally symmetric, such as when including two or more parallel rectangles. The motifs do not extend fully to a theoretical bounding box containing the motif, nor do they represent or form, singularly or in pairs, regular polygons or basic shapes. Motifs may extend to varying amounts of the sides of the box, and some edge of the box must be open. Motifs also extend to at least one corner of the box. Motifs can be configured as electronic files to be printed, printed or drawn on paper, as stamps, as tiles with a matching shape base or a larger base. Motifs are provided as sets of matching and unique motifs and as kits with instructions for playing emergent pattern games with them. Kits are provided with instructions and optionally cards for directing play. The methods for playing include providing motifs, playing the motifs to form patterns in clusters, and playing or moving/removing motifs to change patterns and block the ability to repeat patterns in a direction. Stamp motifs provide more options, such as overlapping them. Methods optionally include assessing playing tendencies and reactions and predicting psychological, personality or collaboration characteristics of players. Methods are provided for one or several people playing with one or many unique motifs and for additional instructions directing play, such as from a deck of cards or from another player or facilitator.

9 Claims, 44 Drawing Sheets

Related U.S. Application Data

(60) Provisional application No. 63/132,118, filed on Dec. 30, 2020, provisional application No. 63/131,748, filed on Dec. 29, 2020.

(58) Field of Classification Search
CPC ..... A63F 2003/00839; A63F 2003/00842; A63F 2003/8094; A63F 2003/8088; A63F 2009/0695; A63F 9/06; A63F 9/20; A63F 2250/50; A63F 2011/0083; B44C 3/085; B44C 3/12; B44C 3/123; B44F 11/04; Y10T 428/1486
See application file for complete search history.

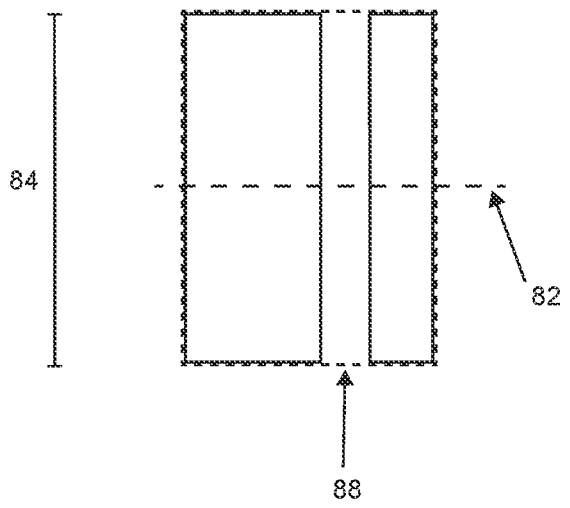
FIG. 9A
FIG. 9B
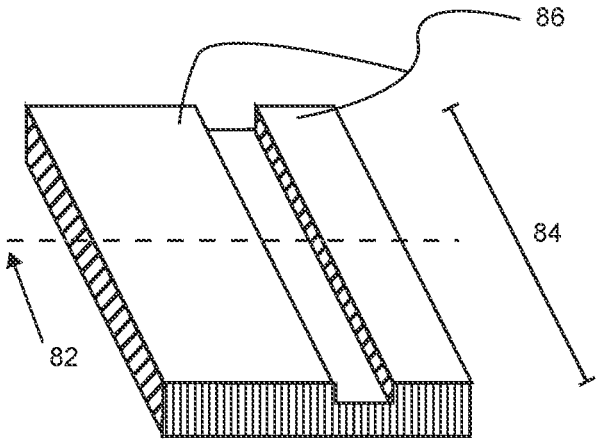

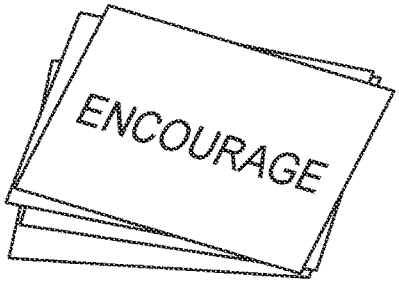
FIG. 13A
FIG. 13B
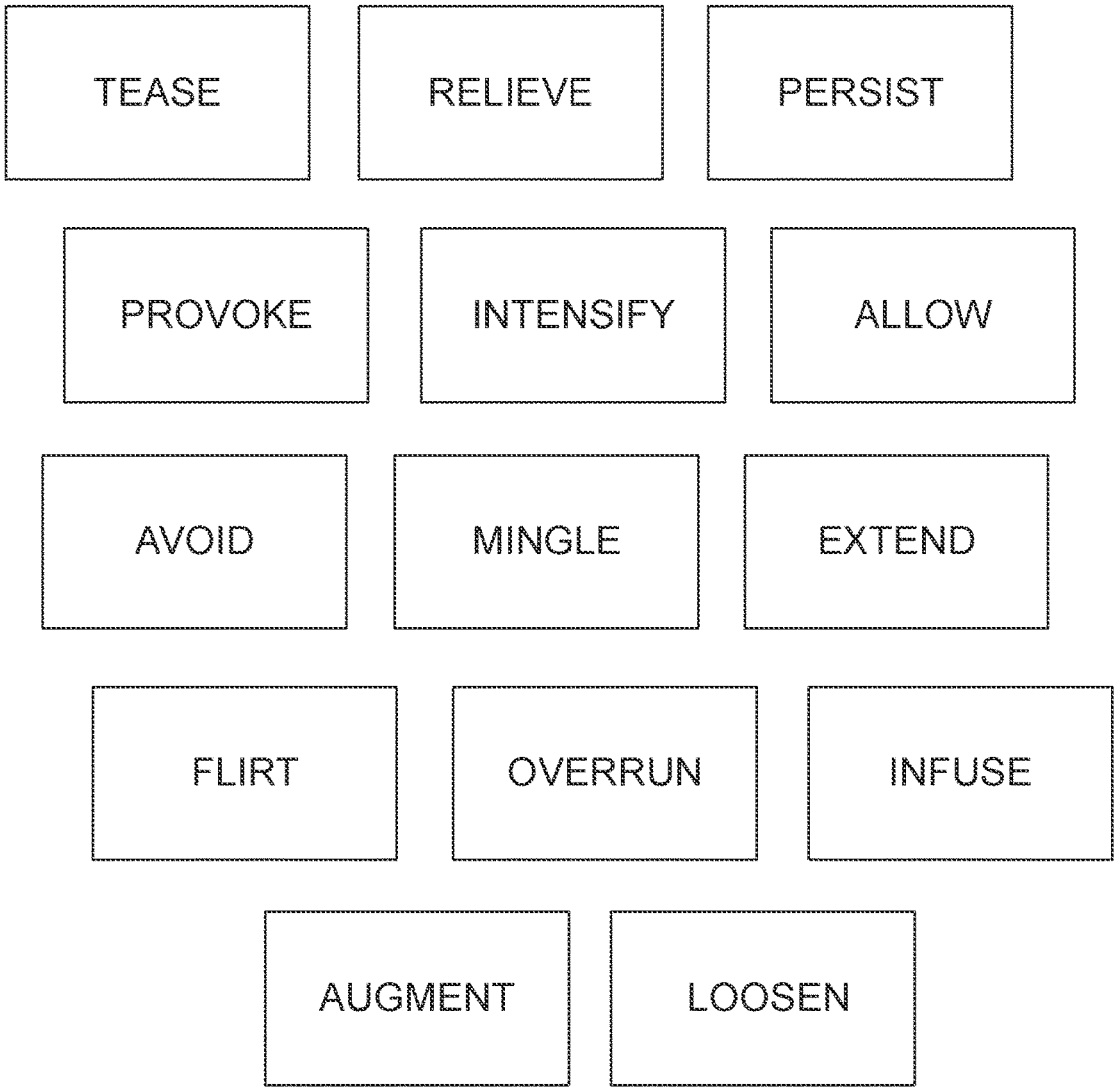

METHODS, MOTIFS, AND KITS FOR EMERGENT PATTERN GAMES AND WORKSHOPS FOR INDIVIDUALS, COLLABORATORS, AND TEAMS

CROSS-REFERENCE TO RELATED APPLICATIONS

This non-provisional patent application claims priority to U.S. Provisional Patent application Ser. No. 63/131,748 filed Dec. 29, 2020 and to U.S. Provisional Patent application No. 63/132,118 filed Dec. 30, 2020, and it is a continuation-in-part of U.S. patent application Ser. No. 17/485,313 filed Sep. 24, 2021, which claims priority to U.S. Provisional Patent application Ser. No. 63/131,748 filed Dec. 29, 2020 and to Provisional Patent application No. 63/132,118 filed Dec. 30, 2020. The contents of the above-mentioned patent applications are hereby expressly incorporated by reference in their entirety.

FIELD OF THE INVENTION

This invention relates to patterns, pattern recognition, games, collaboration, communication, team building, and creativity.

BACKGROUND

Humans excel at pattern recognition. Thinking about and through patterns occurs in many fields, including mathematics, biology, chemistry, architecture, and art, as well as in games. Many people take pleasure in experiencing or discovering patterns, whether visual, musical, in engineering or computer systems, even as their awareness of patterns isn't necessarily conscious. The mechanisms, whether neurological or perhaps somatic, that lead people to find or create patterns aren't fully understood. In behavioral sciences, there is interest in how patterns form as well as how they might change. Smaller or shorter patterns are easier to see or understand than larger ones. Large, complex patterns may have smaller patterns nested within them which may distract from, redirect from, or obscure the larger patterns.

People work with, respond to, discover, and generate patterns. People create software and AIs that work with, respond to, discover, and generate patterns. With industrialization, mechanization, and computerization, there is a tendency to work with regular or consistent patterns. Technology may contribute to visual patterns becoming more regular or predictable. The components that make up the patterns may likewise be regular and consistent, there is an absence of variation and an exclusion of the irregularity that exists outside of the human-made or in pre-industrial artifacts. With this comes a potential lossiness, for example when a node in a pattern stands in for more detailed information than is represented. Due to industrial production, many visual patterns and much of our built environment include strict, rigid repetition of elements. This is true even if the motifs within the pattern are novel or irregular. Since humans evolved in complex ecosystems, surrounded by endless variation in plants, animals, and terrain, industrial patterning overrides an innate, if forgotten, preference for "ordered complexity" and "non-monotony". (Why Monotonous Repetition is Unsatisfying, Nikos Salingaros, https://arxiv.org/pdf/1109.1461v1.pdf)

From the mid-19th through the 20th century, technology brought more constraints in patterning, as screen and roller printing produce strict repeats, however fanciful or complex the design within the repeat. In the 20th and 21st centuries, there has been use of generative patterning, by puzzle makers, mathematicians, computer scientists, artists, or architects. Generative patterns emerge by following rules or in some way self-generate. Algorithms or responsive coding can generate patterns that change over time or across space. These typically show movement and change, however, the change is within a range defined by the algorithm. Once an algorithm has been set in motion, it typically runs without interruption, and any changes that occur fall within the range of the particular algorithm, or through nested algorithms. It is not typical for algorithms to interact with each other, and it is unlikely that whatever sets an algorithm in motion has agency to change the algorithm as it's running. These limitations are addressed by this invention, as there is a need for humans to have ways to explore having patterns emerge and change as this sparks ingenuity, creativity and evolution.

Humans evolved with a need for variation, which can include stability coupled with the inevitability of change. People are excellent at pattern recognition, although they are better at finding some types of patterns over others. As published in Science Daily, "A recent study from the University of Pennsylvania shows that people respond more quickly to modular over network patterns, that is, patterns that emerge from modules instead of across networks. However, they weren't able to describe either type of pattern they experienced. Responses were quicker when participants were shown sequences that were generated using a modular network compared to sequences coming from a lattice network." Human brains pick up differences in structures that computers don't yet notice (or care about). "Subjects could better understand the modular network's underlying structure," said physics Ph.D. student Christopher Lynn. (https://www.sciencedaily.com/releases/2020/05/200508145324.htm) There is a need for increased skillfulness and training with modular patterns.

Awareness of a pattern sometimes can complement or interfere with understanding of reality, such as when a person believes they perceive a pattern when there is actually insufficient information to indicate one. The capacity for pattern recognition, then, is a fertile ground for tools that test its limits.

Humans have the capacity for specialized motor skills. Many people enjoy using their hands, arms, and other aspects of their bodies for embodied play. This includes the ability to manipulate objects, to be creative with tools, processes, and games. Learning new embodied skills can be enjoyable as well. There is a need to have creative outlets that offer embodied creativity, where the capacity to manipulate objects allows for the inclusion of irregularity and apparent imperfections. Mid-20th century statistician and productivity expert, G. Edwards Deming, invented a training game or tool, the Red Bead Experiment (https://deming.org/explore/red-bead-experiment/) that revealed previously hidden mechanisms of bad management that were, among other harms, were undermining individual strengths and autonomy. There is a need for training tools and games that enhance autonomy, freedom, self-knowledge, creativity, and play, for their own sake, and for the well being of an individual or group, plus potentially for learning about "right work."

Visual patterns are known in the art. Visual artists and craftspeople have included patterns and repeated motifs in art since as long as people have made things. Artists may combine repetition with decision making, choosing variations as they proceed in making. Or they may restrict decisions, as seen in the work of Sol LeWitt, who created instructions for others to make generative patterns, selling these instructions to museums and collectors.

Behavior games are known in the art. Interactive, group games for children to foster "good behavior" use collective scoring to induce each child to do their "best" for the group. This type of game focuses on a narrow range of what is considered good and also risks fostering self-blame in an individual child for how their behavior contributes to the group's low score. Good Behavior Game: https://goodbehaviorgame.air.org/about gbg.html Stamps are known in the art. Wikipedia (https://en.wikipedia.org/wiki/Rubber stamp) describes rubber stamping, also called stamping, as a craft in which some type of ink made of ink or pigment is applied to an image or pattern that has been carved, molded, laser engraved or vulcanized, onto a sheet of rubber. The rubber is often mounted onto a more stable object such as a wood, brick or an acrylic block. Another means has vulcanized rubber image with an adhesive foam backing attached to a cling vinyl sheet which allows it to be used with an acrylic handle for support. Cling rubber stamps can also be positioned with a greater amount of accuracy due to the stamper's ability to see through the handle being used. Temporary stamps with simple designs can be carved from a potato or soft foam. The ink-coated stamp is pressed onto any type of medium such that the colored image is transferred to the medium. The medium is generally some type of fabric or paper. Other media used are wood, metal, glass, plastic, and rock. High-volume batik uses liquid wax instead of ink on a metal stamp. Commercially available rubber stamps fall into three categories: stamps for use in the office, stamps used for decorating objects, or those used as children's toys. Stamps can be used to press reliefs in soft materials such as clay.

Books describing visual patterns, as decoration and mathematically, are known in the art. One such book about patterns and pattern formation is the Handbook of Regular Patterns, An Introduction to Symmetry in Two Dimensions, by Peter S. Stevens. In images 35.9 and 35.10 examples are shown where groups of 3 pieces have threefold rotational symmetry. Pieces of such shapes require that they be fitted exactly to repeat patterns without variation.

More shapes are known that constrain placements, such as those made by M C Escher which reference tessellations (https://en.wikipedia.org/wiki/M. C. Escher). Hexagonal tessellation with animals is shown in Study of Regular Division of the Plane with Reptiles (1939). In some cultures, patterns may include variations, either from the artist's choices or from following mathematical models as in some Islamic tile. The interest in Islamic patterning has given rise to games and tools that allow people to explore how these patterns form and change. (SekroArt https://www.instagram.com/sekroart/) Additionally, Penrose Tiling's tessellated shapes give rise to ever-changing patterns using a finite group of interlocking shapes. Here there is variation that nevertheless operates in a space of choicelessness.

Another example is shown in U.S. Pat. No. 7,284,757B2. These puzzle pieces are said to have proper placements that completely fill an area and form a predetermined image. Their shapes seem to constrain placements. There is little opportunity for freedom, choice, and continuous learning beyond a simple pattern.

There are also tiles known in the art for architectural and decorative designs and also said to be useful for playing games, such as U.S. Pat. No. 6,305,688B1. Tiles are said to be suited for interlocking assembly into continuous paths by matching tiles. Again, there is little opportunity for freedom, choice, and continuous learning.

There are pattern menus and compendiums known in the art such for making or referencing such things such as basketweaves, stripe patterns, plaids, and more. These compendiums include The Language of Ornament, by Owen Jones, and Textile Designs by Susan Meller and Joost Elffers.

Irregular polygons are known in the art as can be seen on: https://www.technologyuk.net/mathematics/geometry/irregular-polygons.shtml There are various ways known in the art for documenting decisions and decision-making processes. An example is a flowchart listing decision options. Another is a behavior tree (such as from the computer game industry) for showing decision options and consequences similar to a flowchart. Decisions can be tracked and used to impact software processes. There is a need in the art for tools, processes, and methods that leave a trace of each decision within a larger set of actions, such as playing a game. This invention addresses this need.

Modeling languages are known in the art. https://en.wikipedia.org/wiki/Modeling language A modeling language is any artificial language that can be used to express information or knowledge or systems in a structure that is defined by a consistent set of rules. The rules are used for interpretation of the meaning of components in the structure. A typical modeling language uses simple diagram components and doesn't focus on or include the traceability of individual choices. https://en.wikipedia.org/wiki/Modeling language#Behavioral There are modular, interactive games known in the art, including ones in which the player works to create patterns. In these examples of prior art, there are limitations of flexibility or creativity including constraints both mechanical and structural which limit choices, such as interlocking tiles that restrict how tiles can be used, a gridded playing area, and/or periodicity in the tiles. These include Board game for enhancing mental skills through formation of shapes and patterns US20120068407A1, Geometrically patterned tiles and game U.S. Pat. No. 6,305,688B, Board game with multi-functional pieces US20050230911A1, Structural elements and tile sets U.S. Pat. No. 7,284,757B2, and Tessellation Set U.S. Pat. No. 6,309,716B1.

Games that offer modifications during play or in response to play are automated or on a computer-based system. Players do not have full autonomy nor access to how and when changes occur. Subject to hidden algorithms and computer operations, a player here is not in charge of decisions or outcomes. Such prior art includes Automated game modification based on playing style U.S. Pat. No. 10,556,182B2; Adaptive object placement in computer-implemented games US20190105571A1; and Method and program product for fluid mosaic terrain games US20190381405A1.

SUMMARY OF THE INVENTION

In this invention, patterning is used as a tool. The motif game pieces, kits and methods of this invention provide means to create and discover patterns, work through patterns, and cause patterns to evolve. Embodied Algorithms kits, games, and methods can work with irregularity and variability at multiple levels; the greater the variation, the more flexibility and creativity is involved. The game described in this application is also a tool and a process. It is a game which allows those playing it, whether human, robot, AI, or some combination, to form patterns and to change those patterns: on a continuum from gradually to abruptly; in response to their own or others' decisions; in response to others' patterns; or in response to internal (private) or external (given, shared) rules, directions or beliefs.

Objects and advantages of the invention will be set forth in part in the following description, or may be obvious from the description, or may be learned through practice of the invention.

An embodiment of this invention includes choosing a known pattern and creating that pattern with the motifs of this invention—and then changing it. This invention includes methods for making motifs, stamps and tiles of this invention. This invention includes methods for creating and recognizing repeated instantiations that build patterns. This invention includes methods for changing patterns and communicating through patterns. This invention covers several topics including: behaviors and game cards; printing with stamps; exercises which open creativity; decision documentation (AI behavior trees); team building or group trainings; kits; games and more.

This invention has several purposes, including but not limited to: recording pattern choices for use in the moment and later; expanding creativity; observing how much creativity can be put into play; recognizing and changing decision/choice patterns; recognizing personality styles, how there is response to constraints, open choice, and directions; observing patterns of people and personality styles interacting; practicing skills to change people and their personalities with respect to doing work and styles of interacting; making art; playing for fun, competition, and collaboration.

This invention includes menus of choices, any of which can impact the overall result. Categories of choices, only some of which may be in play in a particular embodiment of this invention, include: color; which particular motif as a stamp or tile; position; direction; orientation; density; proximity; overlay (whether or how much); consistency (of stamp imprint or how regular placement or stamp imprint or tile); how careful/considered or automatic/unconsidered; and speed of playing.

A set of this invention includes a motif. The motif is to be used to create one or more patterns. In an embodiment, the motif is a tile, and the set includes two or more tiles with the same or with different motifs. In an embodiment, a motif is configured as a stamp and the kit including it also includes ink of one or multiple colors. When the motifs are stamps, the set optionally also includes paper or cloth as a surface to play on.

In a basic embodiment, the kits of this invention can optionally include a motif (one or more if stamps, a plurality if tiles, and one or more unique motifs); ink if a stamp; a playing surface which can also be called a Decision Field; a set of instructions; optionally extra rules or directions; optionally cards giving the directions; optionally cards with prompts, including behavior prompts, possibly ranging from precise or specific to vague or implicit; a workshop guide or plan for a coach or manager using the kits and games of this invention with at team, and one or more catalogs of patterns as for reference or reproduction or inspiration. The methods of this invention can be used by or with agent(s) or players, a person, a plurality of people, an artificial intelligence (AI) device, a robot, software, or a combination of different types of agent-players. The methods of this invention can include possibly facilitated play, such as by a manager or coach.

The aforementioned Decision Field or playing surface may include an approximately flat surface, a two dimensional plane, an approximately flat or two dimensional plane. The playing surface may be cloth or paper or other likely somewhat absorbent substance if stamp motifs are used and can include any acceptable surface if tiles. There could be a third dimension, too, including sloped or slightly wavy or pleated fabric, etc. which can include adding dimensions after or during play with this invention. In an embodiment of this invention, including in virtual reality, the playing surface can be fully three dimensional.

This invention teaches methods for improvising while implementing algorithms, be they technically or organically derived.

DEFINITION OF TERMS

Pattern: Merriam Webster defines Pattern (noun, https://www.merriam-webster.com/dictionary/pattern). Some of the relevant elements in this invention are: 3: an artistic or mechanical design or form (such as: the geometrical pattern of the carpet); 7: a reliable sample of traits, acts, tendencies, or other observable characteristics of a person, group, or institution (such as: a behavior pattern); 10: a discernible coherent system based on the intended interrelationship of component parts; and 11: frequent or widespread incidence.

In this invention, in an embodiment, what is a considered a pattern may also have variation, such as 5% or sometimes even 10% or more that seems "off" or could be construed as incorrect or irregular, including with motifs or clusters that are overlapped, separate from, having an angle changed, or the "wrong" motif placed etc. In this invention, a pattern has enough repeated elements—which motif, the angle or rotation, color, position relative to other motifs, etc.—that is different enough from other played motifs (or that there are no other played motifs) that these elements appear in an approximate rhythm when enough are repeated. In an embodiment, 100% are repeated, at least 95% are repeated, at least 95% are repeated, at least 90% are repeated, at least 85% are repeated, or at least 80% are repeated. It may be that only one characteristic changes or all change a bit.

In this invention, changing a pattern includes changing enough characteristics enough or changing one characteristic enough that, relative to a rule/direction/instruction selected, it has been substantially changed.

A motif is a decorative and functional unit having certain characteristics and is a component used to create patterns in the kits, games, and methods of this invention. The characteristics are explained herein.

A stamp is a tool for putting a mark on an object either by printing on it or pushing into it, or it is the mark made in this way, as is known in the art.

A tile is an object, analog or digital, that contains a motif and can be played to create a part of a pattern. A tile has included a base of some sort that allows a motif to be more easily grasped and played by fingers, hands, a robot, etc. The base may impact what plays are possible depending on its shape relative to the motif.

Shape: Merriam Webster defines Shape (noun, https://www.merriam-webster.com/dictionary/shape). Some relevant elements in this invention are: 1a: the visible makeup characteristic of a particular item or kind of item, and 1b: (1) spatial form or contour; (2) a standard or universally recognized spatial form. Basic shapes are known in the art.

Decision Field: this effectively means the playing surface in this invention. It is the area that contains decisions made by players using this invention.

Emergent: Merriam Webster defines emergent (adjective, https://www.merriam-webster.com/dictionary/emergent). Some of the relevant elements in this invention are: 1:

arising unexpectedly, 2: arising as a natural or logical consequence; and 4: newly formed or prominent.

Behavior: Merriam Webster defines behavior (noun, https://www.merriam-webster.com/dictionary/behavior). Some relevant elements are: 1: the way in which someone conducts oneself, 2a: the manner of conducting oneself, 2b: anything that an organism does involving action and response to stimulation, 2c: the response of an individual, group, or species to its environment, and 3: the way in which something functions or operates.

BRIEF DESCRIPTION OF THE DRAWINGS

In the drawings, closely related figures have the same number but different alphabetic suffixes.

FIG. 3A shows the motif on a base as a tile. FIG. 3B shows the motif within a theoretical bounding box.

FIG. 4B shows shaped tiles also in use flipped over.

FIG. 7A shows a minimal area bounding polygon, FIG. 7B shows a minimal sided bounding rectangular box, and FIG. 7C shows a minimal sided bounding polygon that is not limited to being a rectangle or box.

FIGS. 9A and 9B show a motif with parallel parallelograms of different widths. In FIG. 9A, there is a line indicating the axis of bilateral symmetry. FIG. 9B indicates which is the shorter and which the longer side on the motif.

FIG. 11P shows a variation of linear or rectangle motifs where the rectangles are approximately parallel, that is, have one axis of approximate symmetry.

FIG. 13A shows Behavior cards in a stack. FIG. 13B shows a selection of Behavior cards laid out.

FIGS. 25D to 25L show a different emergent pattern than FIGS. 24A to 24L.

FIGS. 26A, 26D, 26G, and 26J show a basketweave pattern emerging. FIG. 26B repeats the motif of FIG. 26A. FIGS. 26E, 26H, and 26K follows that repetition to allow a pattern to emerge. FIG. 26C repeats the motif of FIG. 26B. FIGS. 26F, 26I, and 26L show the development of a pattern that follows from that repetition.

FIG. 29B shows two placements of the same motif, where the tile numbered 2 is flipped onto its opposite surface. FIG. 29K shows the removal of tiles numbered 5 and 6. FIG. 29M shows tiles with numbers 9 to 12 moved left to occupy the space where tiles 5 and 6 were.

DRAWINGS—REFERENCE NUMERALS

Figure 2A:
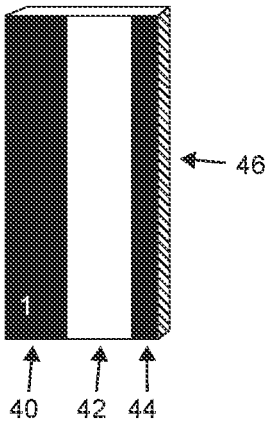
FIGS. 2A to 2C show about parallel rectangle tile modules, three variations with different numbers of parallel rectangles, different overall widths and lengths.

40 and 44 different widths of parallel parallelograms in one motif (FIG. 2A)

42 space between parallelograms (FIG. 2A)

46 height of parallel parallelogram motif (FIG. 2A)

Figure 2B:
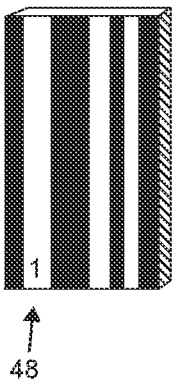

48 numeration on tile (FIG. 2B)

52 The tile with two rectangles numbered "1" is oriented 180° relative to the tile with five rectangles numbered "1" and these tiles are not perfectly aligned relative to each other (FIG. 1A), and that is acceptable in play. The numbers, e.g. "1", may be used to show the order in which that motif was played in this example.

Figure 1A:
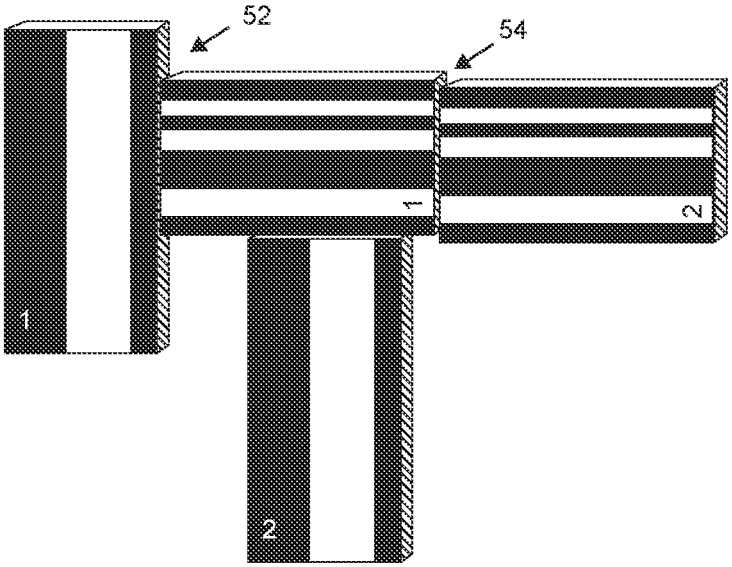
FIGS. 1A and 1B show tile modules placed to reveal emergent patterns, inclusive of visible errors in exact placement.

54 tile 1 and tile 2 misaligned, acceptable placement (FIG. 1A)

56 tile 6 rotated 180° from tile 3, acceptable placement (FIG. 1A)

Figure 3A:
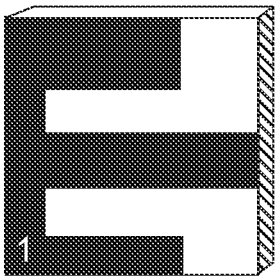
FIGS. 3A to 3B show two instantiations of a particular irregular shape motif.
Figure 3B:
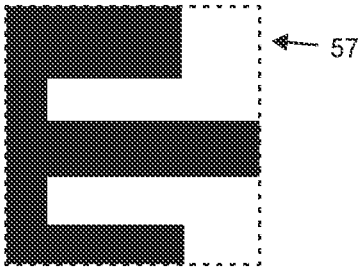

57 theoretical bounding box (FIG. 3B)

Figure 4A:
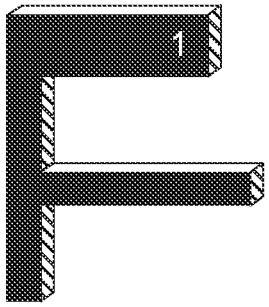
FIGS. 4A and 4B show instantiations of a particular irregular shape motif, where the irregular shape is also the shape of the tile base.
Figure 4B:
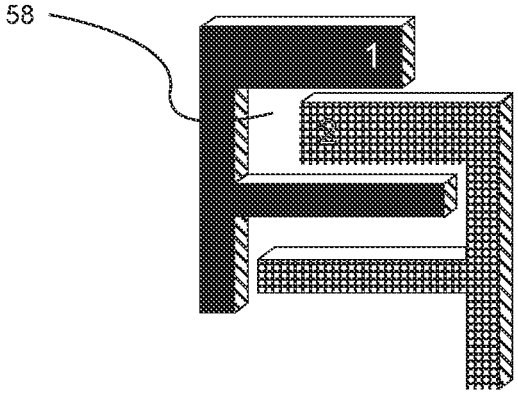

58 interstitial space formed when two or more irregular tiles connect without filling all available space, due to placement or to the particular shape of the tile (FIG. 4B)

Figure 5A:
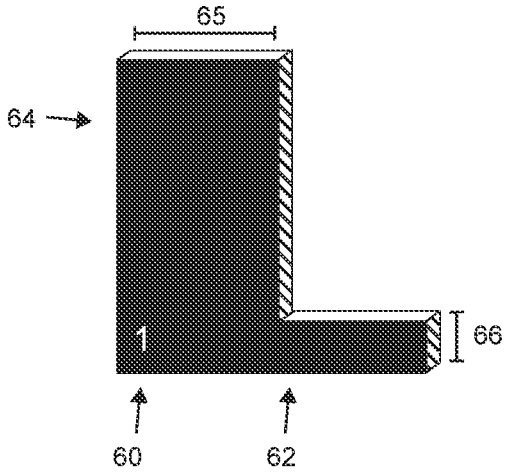
FIG. 5A shows the tile base in the shape of an irregular shape motif.
Figure 5B:
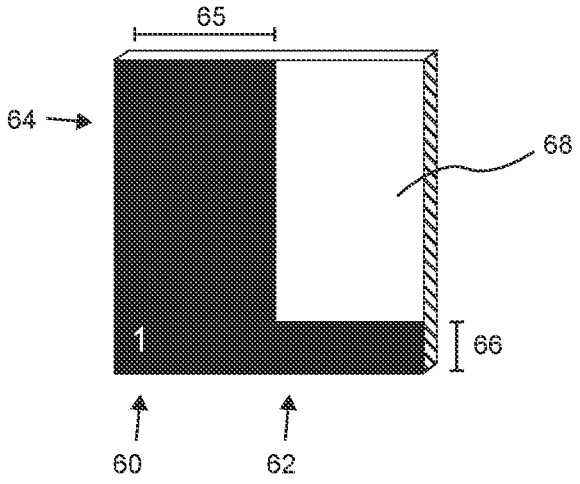
FIG. 5B shows the same motif in the bounding box of a regular quadrilateral polygon.
Figure 6A:
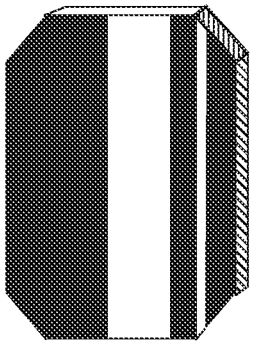
FIGS. 6A to 6G show some possible irregular shapes as motifs on both regular and irregular polygonal tiles.
Figure 6B:
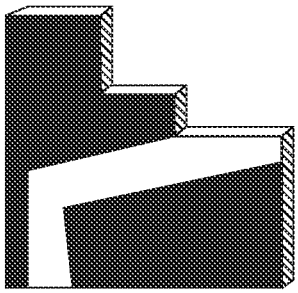
Figure 6C:
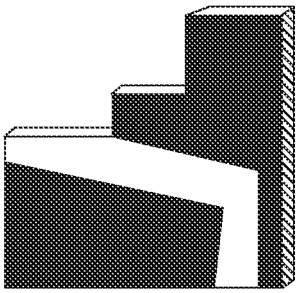
Figure 6D:
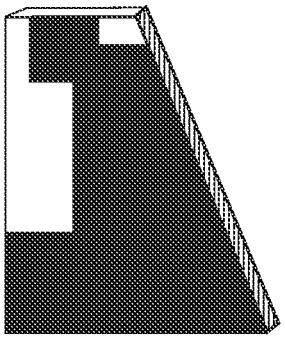
Figure 6E:
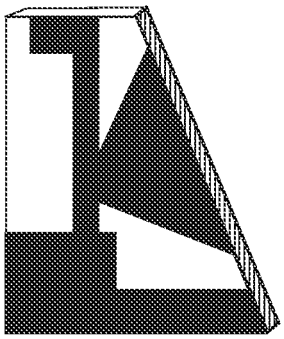
Figure 6F:
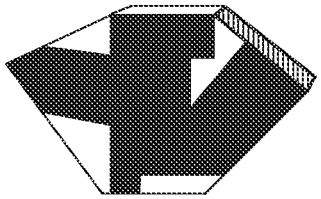
Figure 6G:
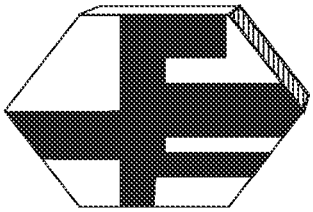

60 unique numeration on each tile of a particular motif (FIGS. 5A-5B)

64 height is distinct from 62 width, the same irregular polygon motif either as a shaped tile or in a bounding box (FIGS. 5A-5B)

65 width of upright distinct from 66 width of horizontal protrusion for the same irregular polygon whether as shaped tile and in bounding box (FIGS. 5A-5B)

68 bounding polygon base of a motif tile (FIG. 5B)

Figure 8:
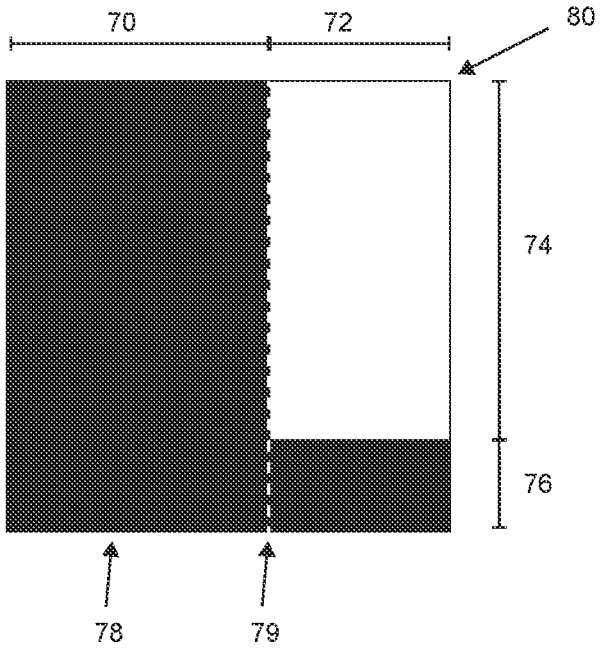
FIG. 8 shows an irregular shape motif with a theoretical bounding box and how the motif is divided into simple polygons, which are rectangles.

70 (FIG. 8) at the top of the motif is 60% of the width of this motif showing the theoretical bounding box 80, and it does not extend to the corner where 80 points. 72 is the motif not extending to the bounding box 80 along the top edge, and this is 40% of the width. 76 is where the motif extends to the right edge at 15% of the height. 74 is the motif not extending fully to the right side for 85% of the height. 78 is the bottom of the motif showing the motif fully extending to the theoretical bounding box 80. This motif also extends to the left side. 79 shows how the shape is reducible to two rectangular polygons. It could be reduced horizontally as well to make two different shaped rectangular polygons. There is no actual top, bottom, right, etc. of this motif—these elements are described this way in this figure for ease of understanding.

82 indicates an axis of bilateral symmetry. 84 is the longer (and in this case the longest) length. 86 is the playing surface. 88 is the theoretical or literal bounding box. The elements of the motif are parallel rectangles. (FIGS. 9A to 9B)

98 flush edge of stamp constructed with layers of different materials (FIGS. 10B and 10F) that is within the motif's theoretical bounding box

Figure 10A:
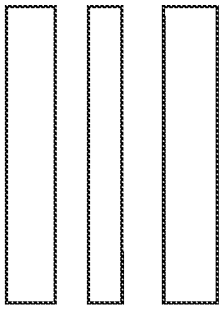
FIGS. 10A to 10D show a parallel rectangle motif and three different versions of printing stamps with that motif.
Figure 10B:
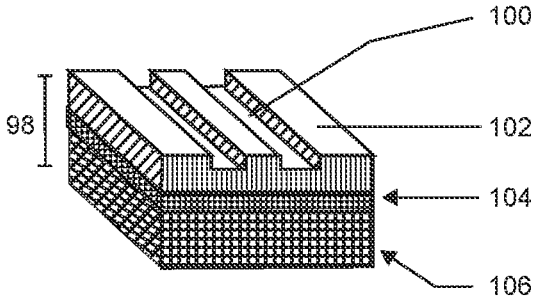
Figure 10C:
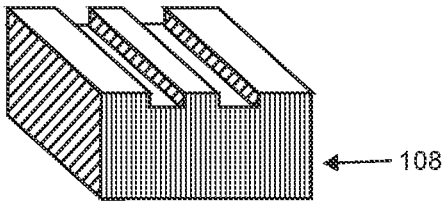
Figure 10D:
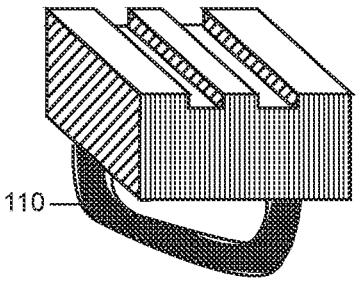
Figure 10E:
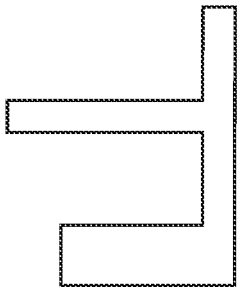
FIGS. 10E to 10H show an irregular polygon motif and three different versions of printing stamp construction with that motif.
Figure 10F:
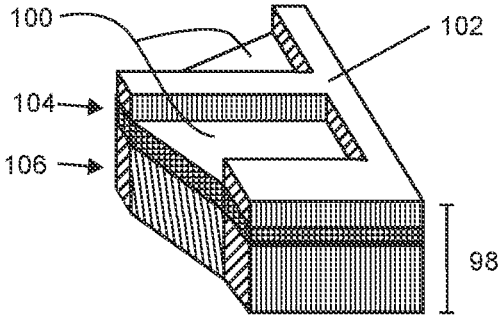

100 groove between motif elements (FIGS. 10B and 10F)

102 printing surface of stamp motif (FIGS. 10B and 10F)

104 additional material to alter the squishiness of stamp, optional stamp elements as known in the art (FIGS. 10B and 10F)

106 base material stiff and thick enough for gripping, as is known in the art of stamp design (FIGS. 10B and 10F)

Figure 10G:
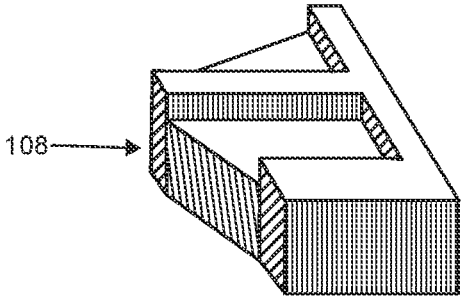

108 stamp printing surface and base are made of the same material (FIGS. 10C and 10G)

Figure 10H:
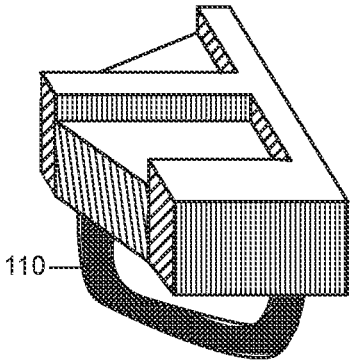

110 handle used in some embodiments as is known in the art for stamps and tiles (FIGS. 10D and 10H)

Figure 15A:
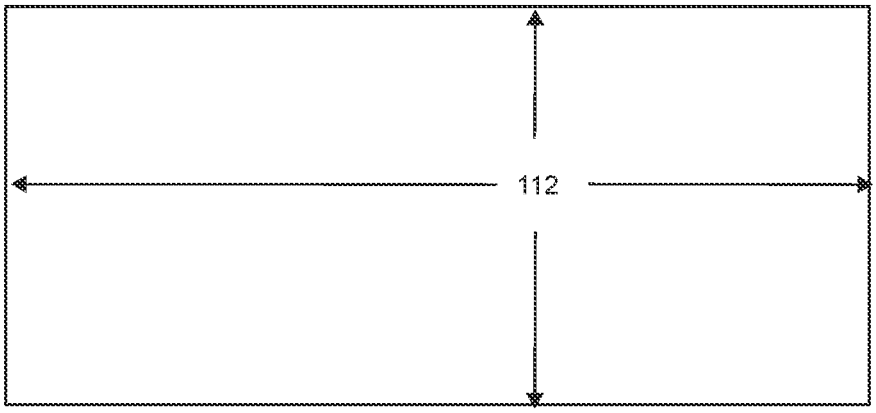
FIG. 15A shows a blank playing surface.

112 length and width of playing surface (FIG. 15A)

Figure 15B:
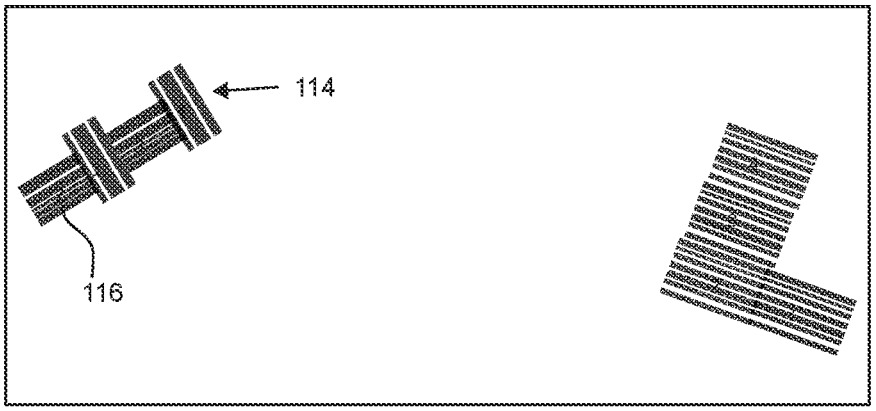
FIG. 15B shows the playing surface with four stamped moves in each of two distinct pattern clusters.

114 pattern cluster formed of four stamped moves using two different motif stamps and 116 optional numbers written on each move to track order, both in FIG. 15B

Figure 15C:
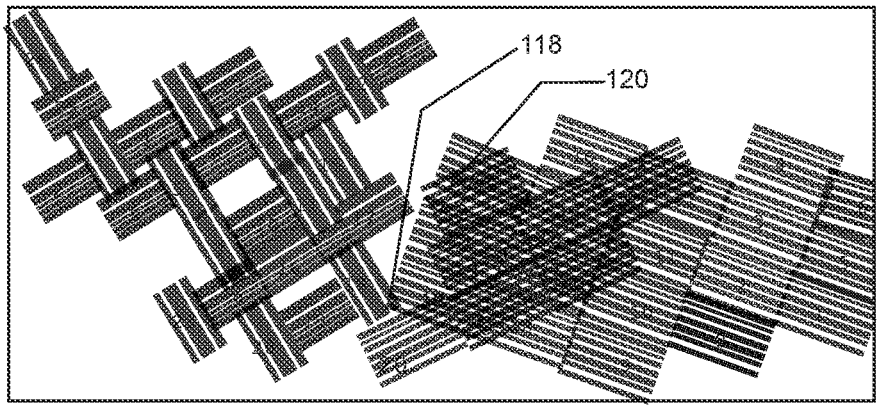
FIG. 15C shows 24 moves in each pattern cluster including a point of contact where the clusters have reached each other.
Figure 15D:
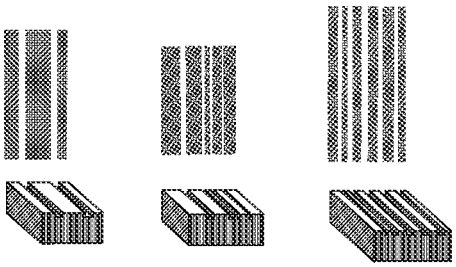
FIG. 15D shows the stamps and their imprints that are used for play in FIGS. 15B and 15C.

118 pattern clusters reach each other and 120 stamp motif placements 21-26 overlay placements 10-19, both in FIG. 15C

Figure 16:
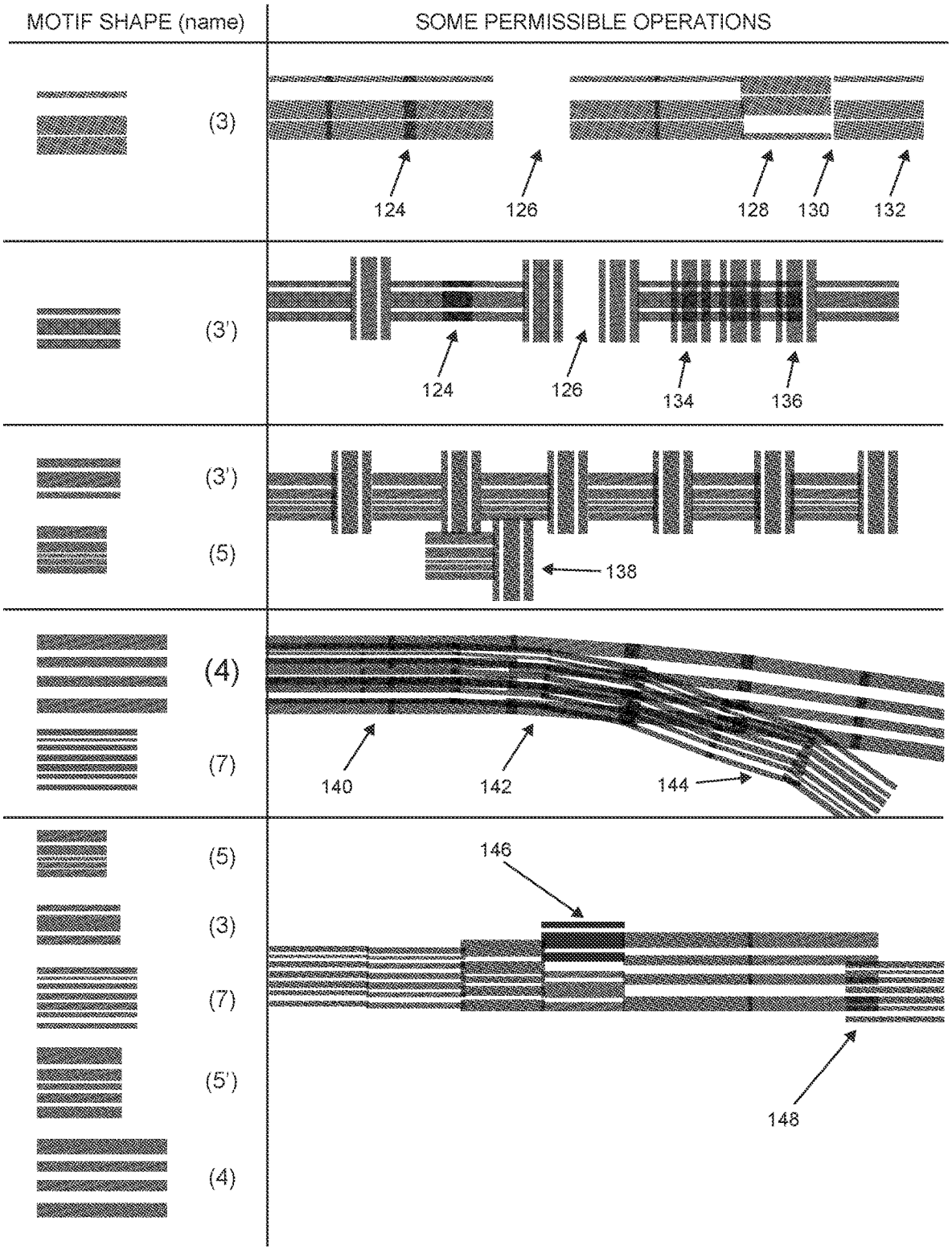
FIG. 16 is a chart that shows examples of some stamped parallel rectangle motifs and some of the acceptable ways they might be placed.

124 overlapped placements, 126 open space separates clusters at left and right, 128 motif rotated 180° from motif to its left and right, 130 small gap between motifs, 134 complete crosswise overlay and 136 incomplete crosswise overlay, 138 pattern continues in any direction, here below the original row, 140 overlaid parallel motifs, 142 overlaid motifs separating into distinct lines, 144 motif used to create waviness, 146 stacked motifs within a linear pattern, 148 misalignment, all are shown in FIG. 16

Figure 18A:
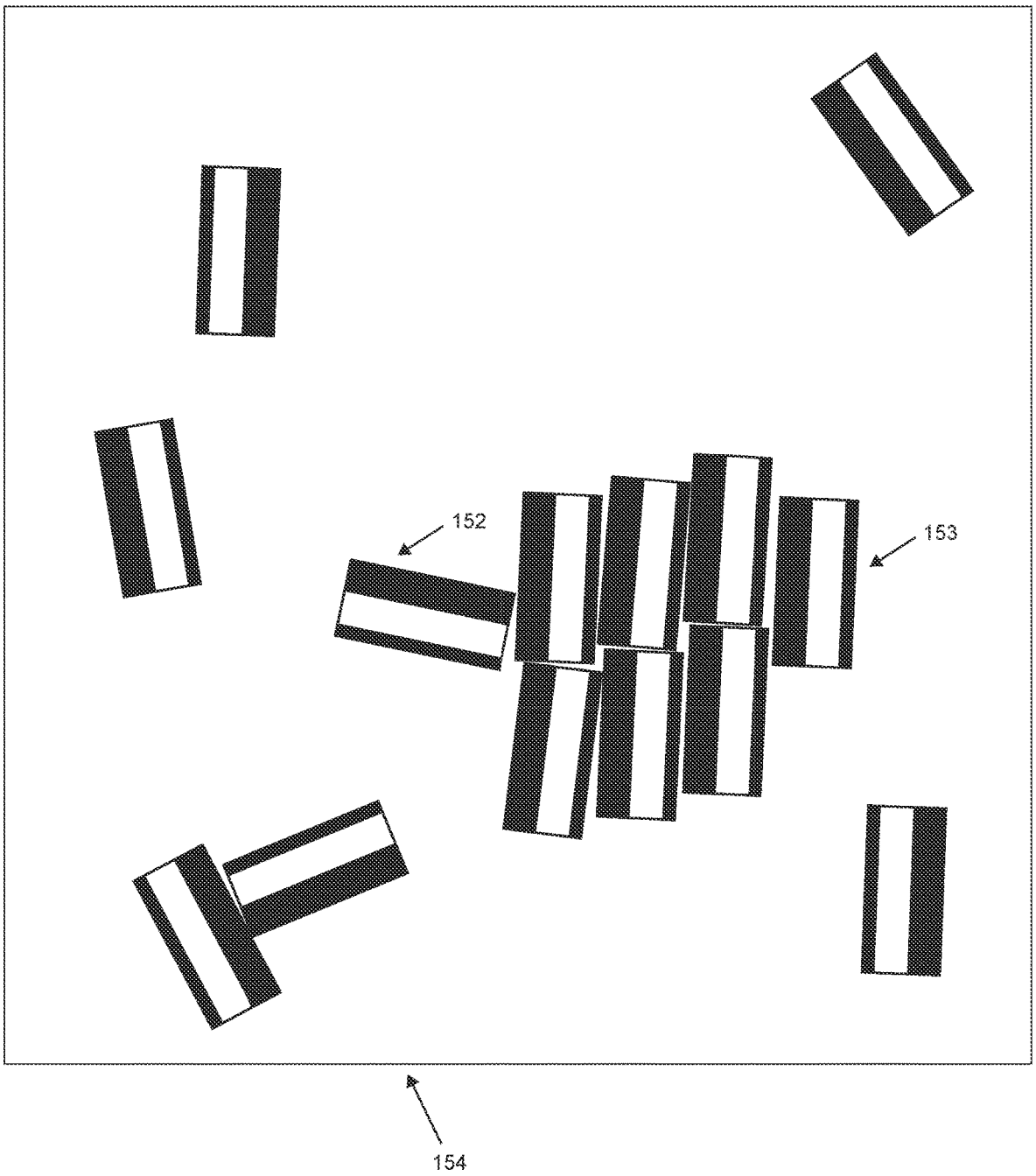
FIG. 18A shows a table top playing surface with a pattern cluster of 7 tiles, with an 8th tile placed at left that may change the pattern, and a 9th tile placed that disrupts or changes the pattern.

152 tile interrupting or provoking shift in pattern cluster, 153 tile that may introduce a shift in pattern, both in FIG. 18A

154 table playing surface, shown in FIGS. 18A, 18B, 22A, and 22B

Figure 18B:
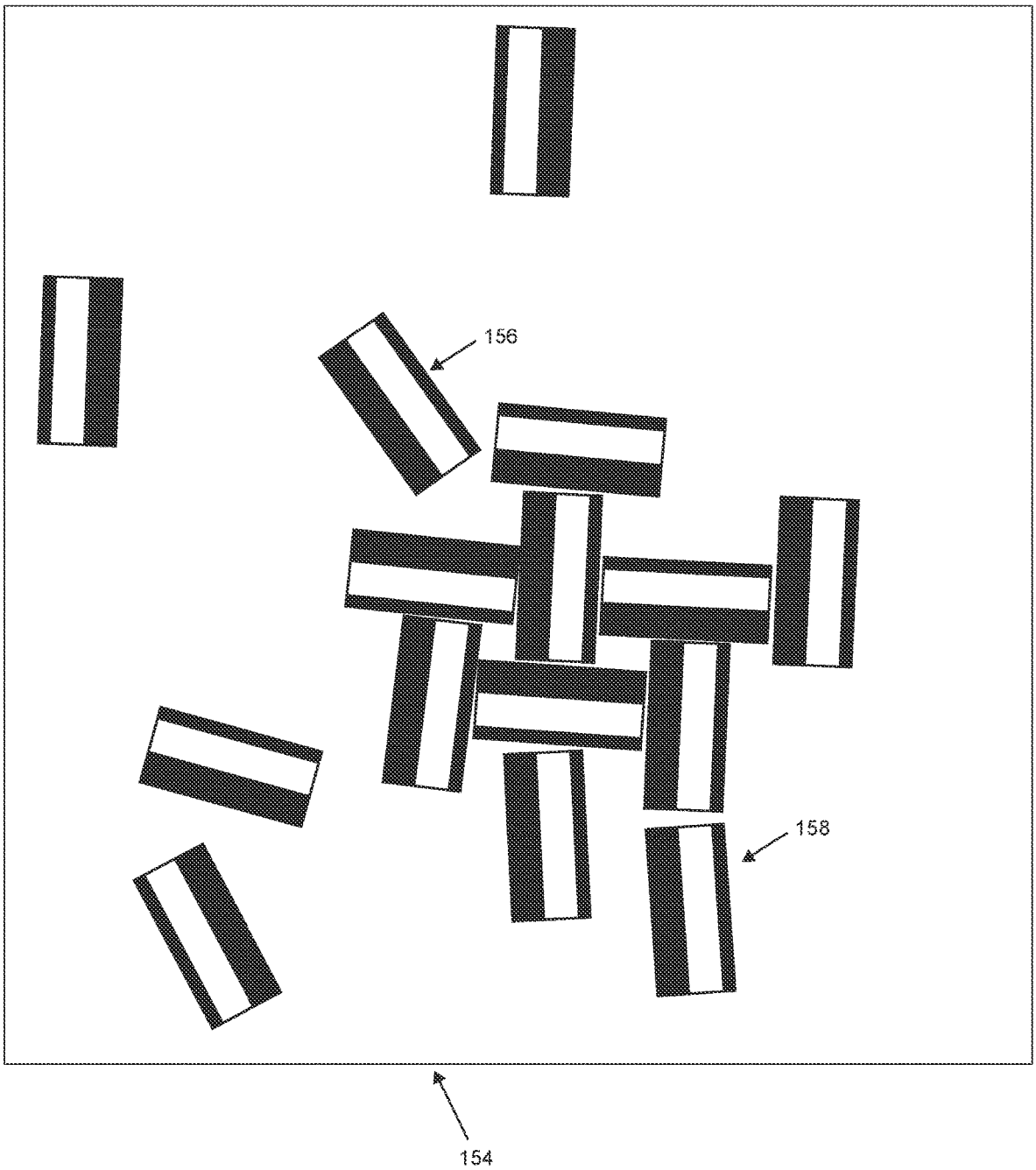
FIG. 18B shows a table top playing surface with a pattern cluster of 9 tiles, with a 10th tile placed to change the pattern, and an 11th tile potentially interfering with the pattern continuing.

156 tile interrupting or provoking shift in pattern cluster and 158 tile that may introduce a shift in pattern, both in FIG. 18B

Figure 19A:
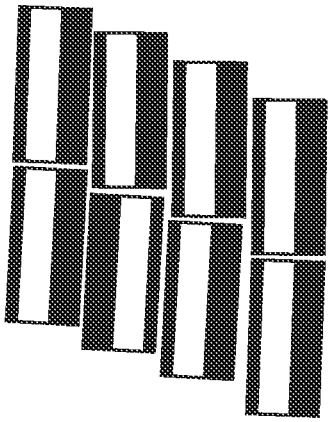
FIG. 19A shows a staggered pattern.
Figure 19B:
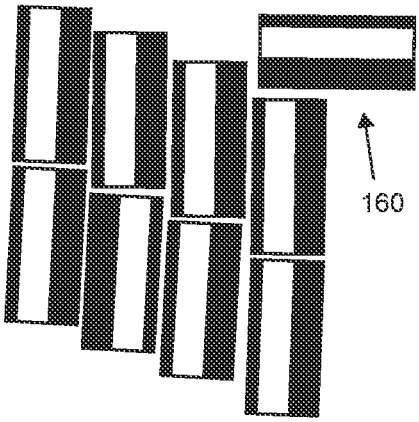
FIG. 19B shows a tile placement that changes or disrupts the pattern.
Figure 20A:
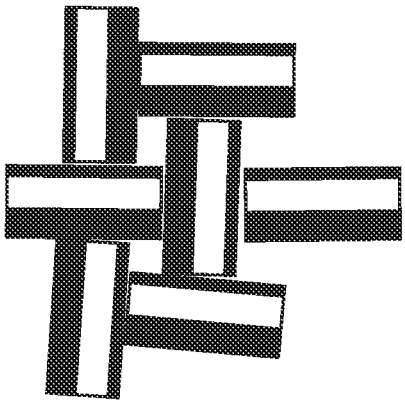
FIG. 20A shows an alternating rotation pattern.
Figure 20B:
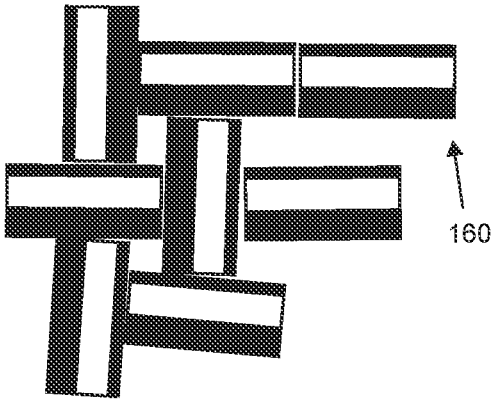
FIG. 20B shows a tile placement that changes the pattern.
Figure 21A:
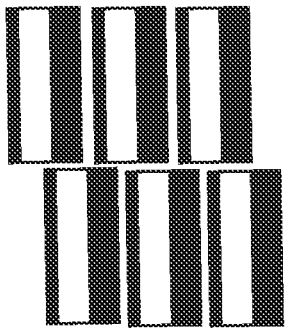
FIG. 21A shows a staggered pattern.
Figure 21B:
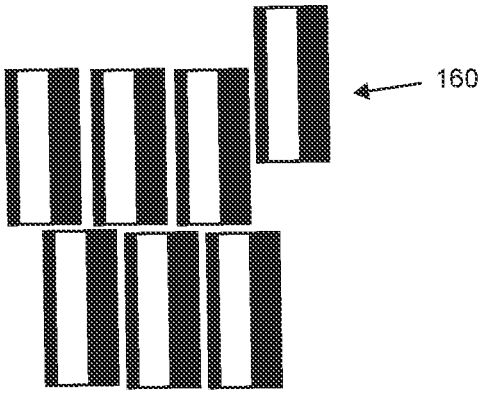
FIG. 21B shows a tile placement that changes or disrupts the pattern.

160 tile that interrupts a pattern or introduce a shift in pattern (FIGS. 19B, 20B, and 21B)

Figure 22A:
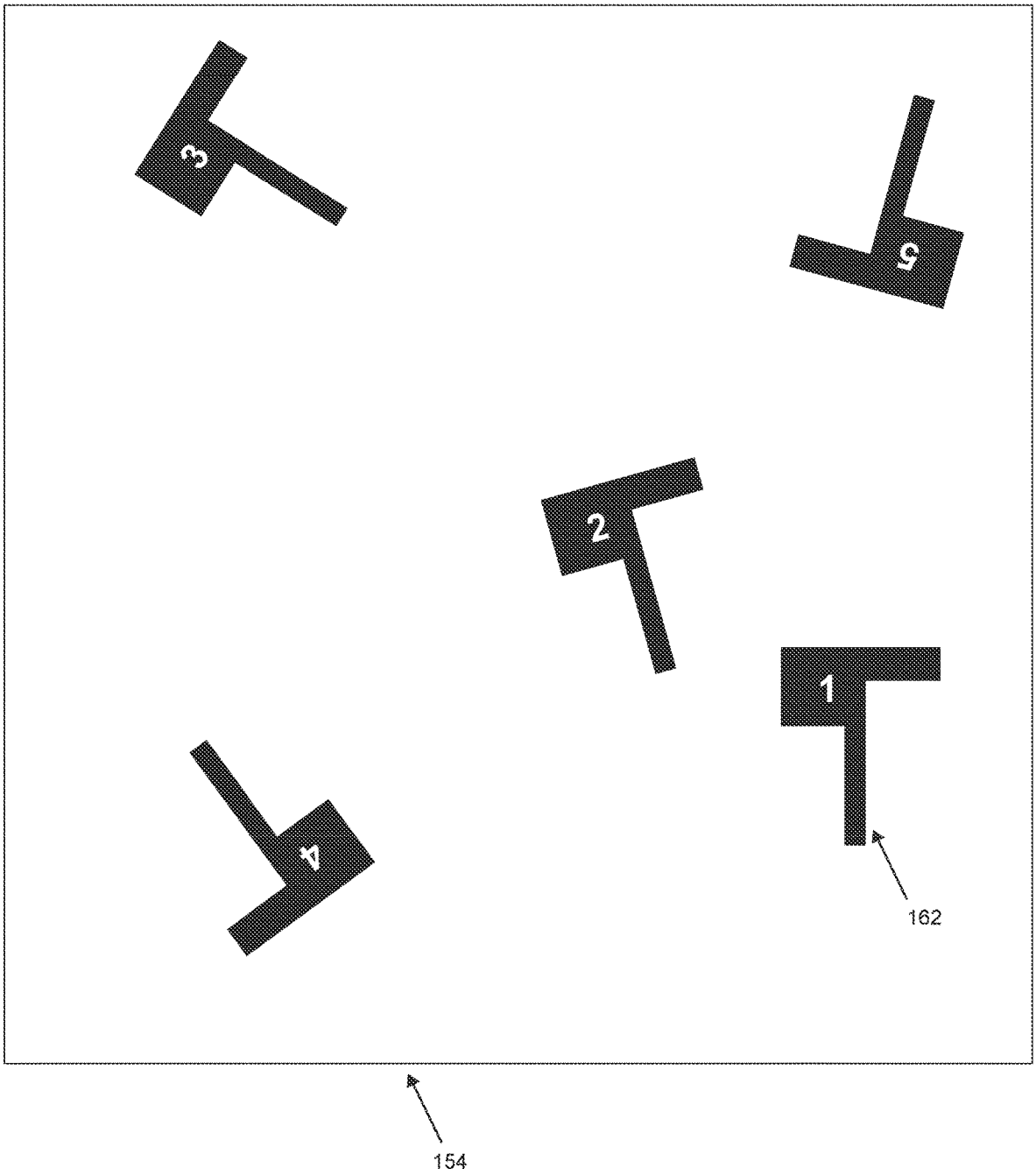
FIG. 22A shows shaped motifs as numbered tiles 1-5 (the order played) on a playing surface.

162 shaped motif tile labeled "1" is the first tile placed (FIG. 22A)

Figure 22B:
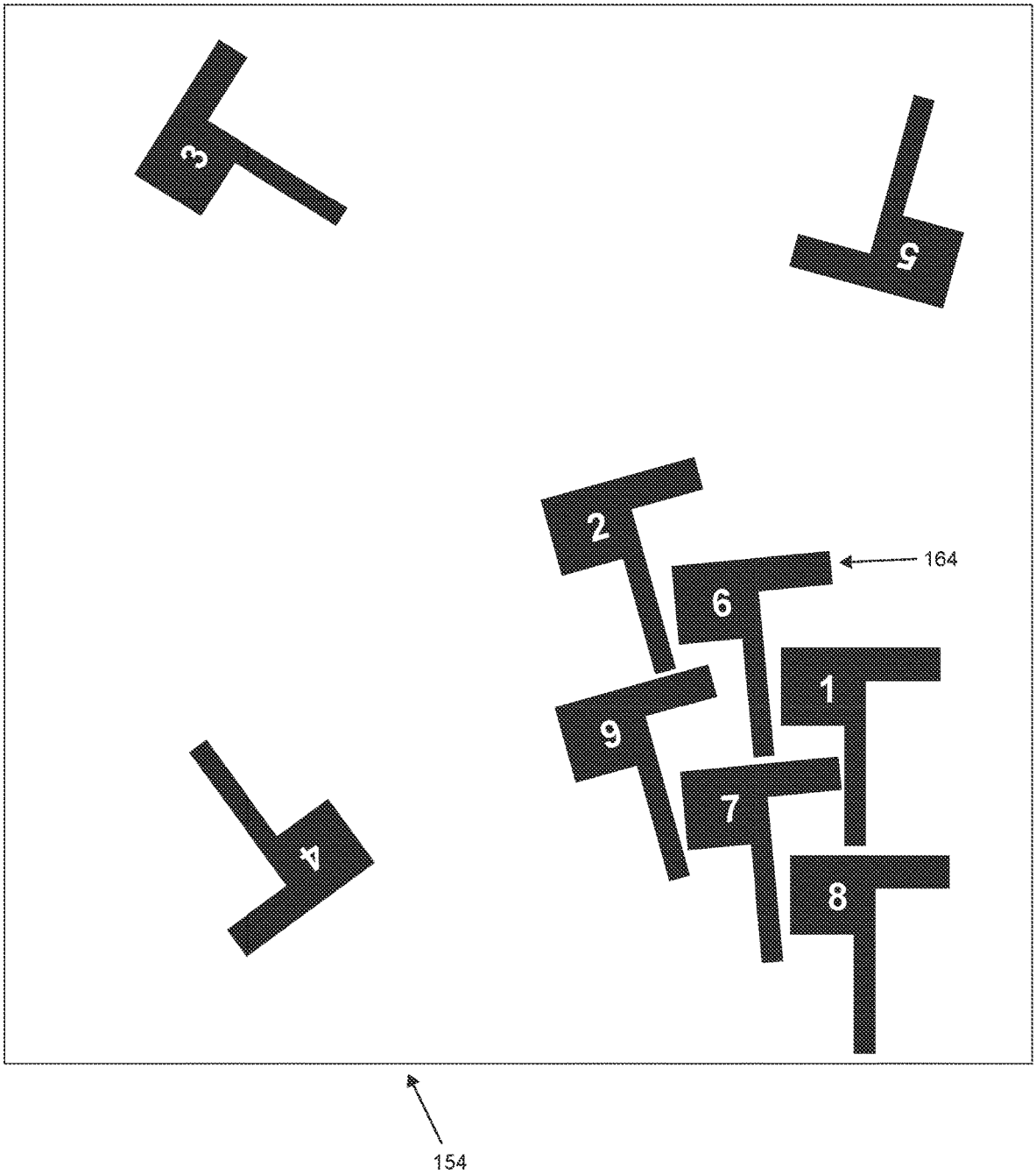
FIG. 22B shows the addition of tiles 6, 7, 8, and 9 which brings about a pattern that includes tiles 1 and 2.

164 shaped motif tile labeled "6" is placed between "1" and "2." When tiles "7", "8" and "9" are placed, the pattern begun by "6" becomes more easily discernible or visible. (FIG. 22B)

Figure 29A:
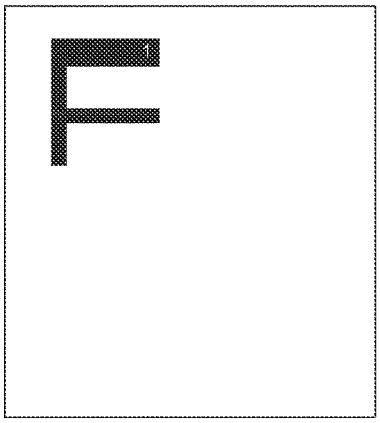
FIGS. 29A to 29M show a pattern emerging from placements of an irregular polygon motif tile, where the tile is the same shape as the polygon.
Figure 29B:
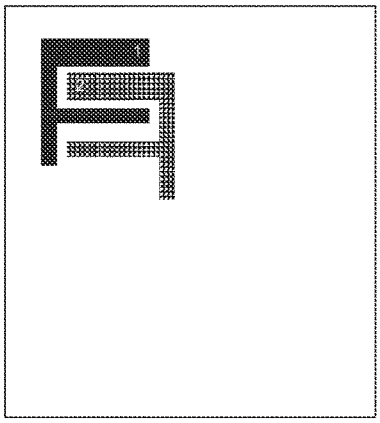
Figure 29C:
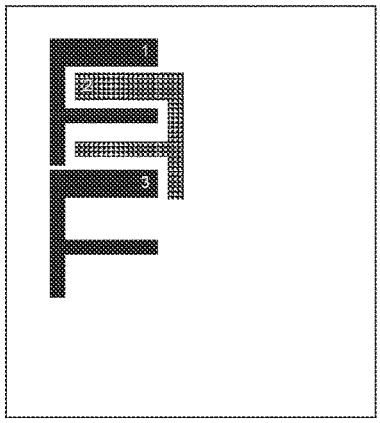
Figure 29D:
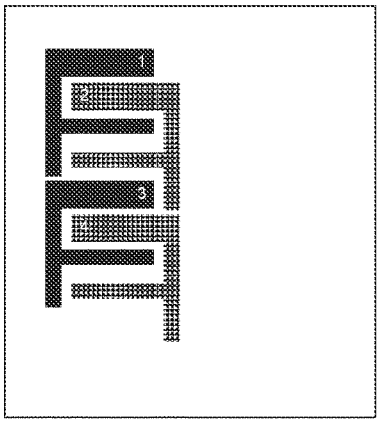
Figure 29E:
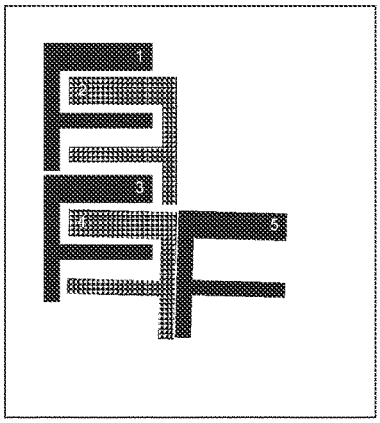
Figure 29F:
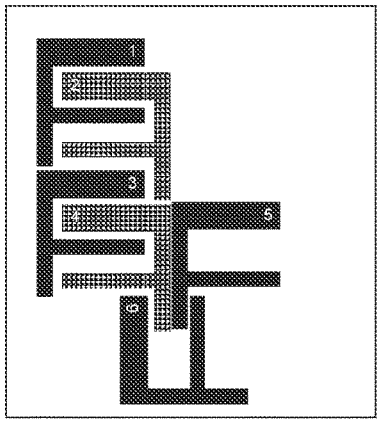
Figure 29G:
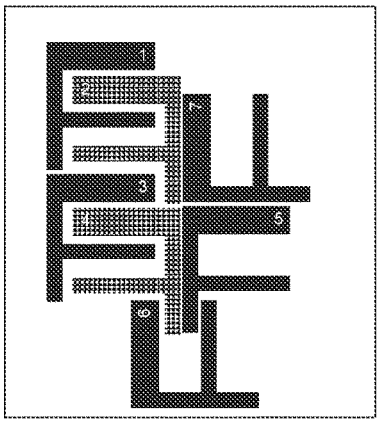
Figure 29H:
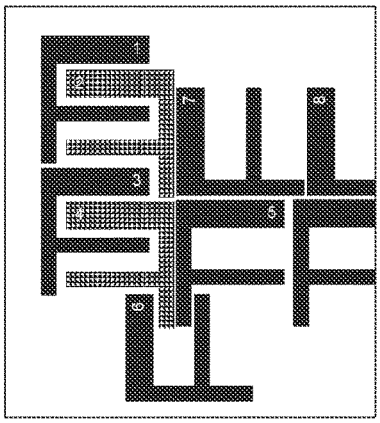
Figure 29I:
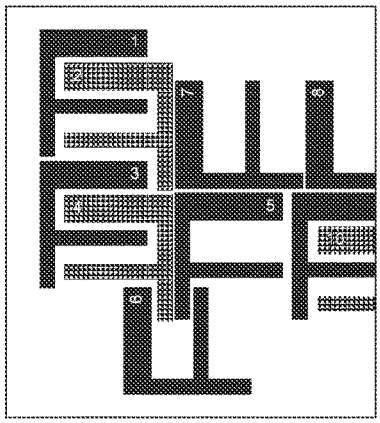
Figure 29J:
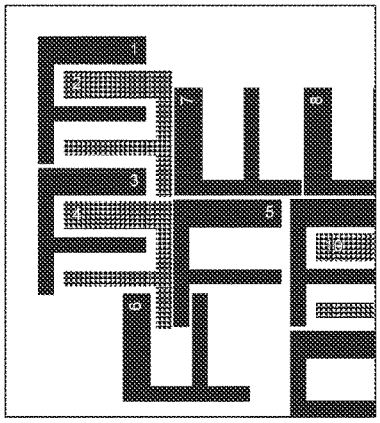
Figure 29K:
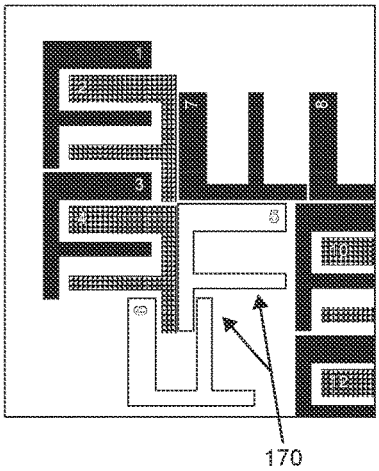
Figure 29L:
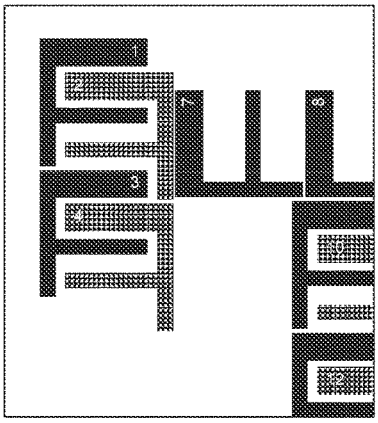

170 tiles with number 5 and 6 removed (FIG. 29K)

Figure 7A:
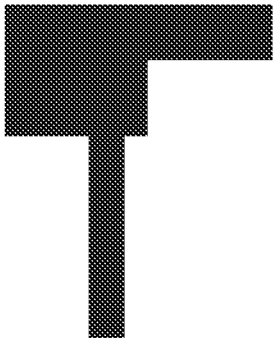
FIGS. 7A to 7C show an irregular shape as a motif with different theoretical bounding curves or polygons or actual bases.
Figure 7B:
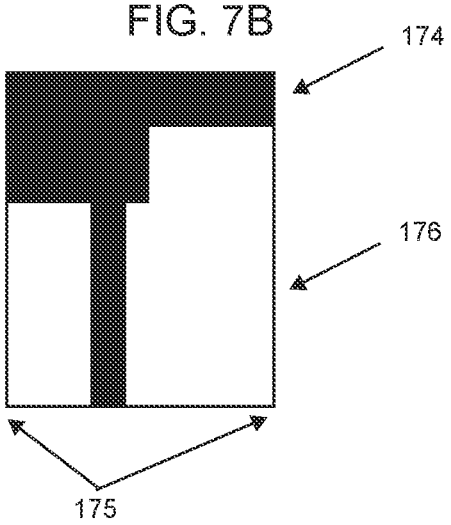

174 shows motif extending to a second corner of the theoretical bounding box and 175 shows the same motif not extending to two other corners (FIG. 7B)

176 rectangular theoretical bounding box that could also be an actual bounding base (FIG. 7B)

Figure 7C:
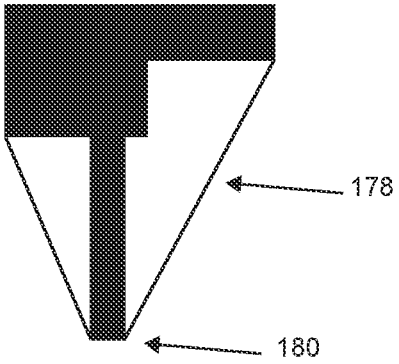

178 shows a theoretical line of a minimal sided bounding polygon that is not a box, extending at an angle from one element of the motif to another. The motif does not extend to this side. 180 shows where the motif extends to the minimal sided bounding polygon. (FIG. 7C)

DETAILED DESCRIPTION OF THE INVENTION

This invention includes a method for playing an emergent pattern game that comprises a plurality of a first two-dimensional motif. The motifs of this invention have a playing plane, a longest length, and a theoretical minimal-area rectangular bounding box that contains the motif around its playing play. The motifs are not fully radially symmetric and they don't approximate radial symmetry. They also are not fully or even approximately rotationally symmetric. The motifs extend to or almost extend to at least one corner of the bounding box and less than fully to at least one of the box's sides. Any motif of this invention by itself does not consist of nor can two or more identical motifs be arrangeable to consist of a solid regular polygon or solid basic shape. Solid regular polygons and solid basic shapes include squares, circles, triangles, rectangles, ovals, stars, trapezoids, and parallelograms.

Motifs of this invention do not by themselves or in pairs represent or form, nor can they be arranged to form a solid regular polygon or a solid basic shape. A seeming exception is that for some motifs configured as stamps, the overlapping stamping pattern can be made to look like regular polygons and basic shapes. The motif themselves however, cannot be.

In an embodiment, a motif can be divided up into a minimum number of convex polygon elements. In an embodiment, all these elements are connected or contact each other to make one contiguous motif shape. In some embodiments, there are more than one separate elements in a motif, such as with parallel rectangles of the same length and different widths. Two or more parallel rectangles, ideally of different thicknesses, are both abstract and understandable—they imply connection, continuity, yet also offer discontinuity or disruption. Parallel rectangles can combine into sets of differing numbers of parallel rectangles. Parallel rectangles allow for a myriad of different patterns—some of which are nameable (e.g., basketweave, FIG. 15C particularly on the left side of the drawing, and FIG. 26J, lattice), however, the names are less important than the possibility of generating understanding to create new patterns.

The motifs of this invention can have all flat sides, all curved sides, or a combination of flat and curved sides. In an embodiment, motifs are simple enough that patterns of motifs are more easily discerned by players, software, etc. Motifs of this invention are preferably simple enough that meta patterns can be recognized when many motifs have aggregated. Motifs of this invention include irregular shapes, including those that riff on familiar shapes like letters in an alphabet but altered enough to make them unfamiliar and irregular (see FIGS. 12A to 12R). Motifs of this invention are preferred to have not too many lines nor too many angles. Motifs of this invention are preferred to touch enough edges of their bounding rectangle or polygon so they form contiguous shapes when played together. Motifs of this invention are preferred to have simplicity with enough complexity to make each motif's placement visible but not too much complexity which makes patterns harder to see.

In an embodiment, the motif used in this invention is the simplest complexity possible that is complex enough to be interesting, such as 2 parallel lines or rectangles with different thicknesses. The preferred asymmetry of a motif allows each to have a unique and visible placement within a pattern, up to and including 180° rotation. Simplest two-dimensional unit has asymmetry along one axis so when it rotates 180° this rotation is visible. Examples include: a) two parallel rectangles of a discrete length where the rectangles have different thicknesses (see FIGS. 11A, 11B, and 11C); and b) a vector or arrow, whether regular or irregular including curves or messiness. Preferred embodiments of motifs acknowledge a tendency for the mind to look for some kinds of repetition or tolerate, accommodate, or allow for irregularity, as in biomimicry we see sameness/coherence in all a tree's leaves when each is particular or also, the opposite, the mind's capacity to resist or become frustrated at irregularity or misalignments.

This invention provides motifs having a theoretical or actual base that is a minimal sided bounding polygon. In an embodiment, that polygon is a rectangle. In an embodiment, wherein the motif is bound by such a polygon, the motif extends to at least two corners of the polygon. In an embodiment, this invention provides motifs having a theoretical or actual base that is a minimal area bounding polygon. This invention provides motifs where the design does extend to all the sides of its theoretical minimal rectangular bounding box and it has a frame that overlaps with the bounding box.

In an embodiment, the module fits well for playing with the fingers and hand, fits well enough to not be frustrating in play or use, and its size relative to the playing surface, also called Decision Field, allows a satisfying number of placements. Preferably the dimension of the playing surface is at least about 20 times the dimension of a motif. In an embodiment, the longest length of a motif is much shorter than the dimensions of a playing field it is used to play on. For example, a motif may be less than 5% or less than 10% of the length and width of a playing field. Playing fields may be any shape, including infinite.

The motif may be embodied as one printing stamp or printing block or as a (set of identical) tiles or as pixels on a computer device. The motif that in digital or computed or virtual reality embodiments are created using software coding. Because the patterns are created one motif at a time, they may be changed incrementally or completely due to the decisions of any player, Agent, robot, software, AI, a combination of these or a new intelligence.

In an embodiment, the motif is carved out of the connecting means. In an embodiment, the handling means is the connecting means. In an embodiment the motifs of this invention come in three dimensions, three-dimensional motifs, and play can happen in three dimensions simultaneously. This invention provides methods, motifs and kits for playing in three dimensions.

In an embodiment, the shaped tiles don't interlock approximately perfectly. In an embodiment, when the motifs are configured as tiles with minimal bases that protrude as little as possible outside of the motif, the motifs are chosen to not nest or to minimally nest together. In an embodiment, when two or more different motifs are selected for play together, they are chosen to not or to minimally nest each other. Not nesting or minimally nesting motifs may be selected when motifs are configured as stamps, paper, etc. as well. In an embodiment, the amount of nesting can be calculated, such as how much area of a motif can fit in a concave area of another motif.

This invention provides motifs having a theoretical or actual base that is a minimal sided bounding polygon. In an embodiment, that polygon is a rectangle. In an embodiment, wherein the motif is bound by such a polygon, the motif extends to at least two corners of the polygon. In an embodiment, this invention provides motifs having a theoretical or actual base that is a minimal area bounding polygon.

The motifs can be configured in electronic files for printing, drawn or printed on paper or an equivalently about flat material, as a tile with no extended base, as a tile with an extended base that at least somewhat prevents the extended based tiles from intersecting or getting as close to each other, as a tile with a minimally extended base as a handle for connecting discontiguous elements as in parallel rectangles, as a stamp for impressing a material such as clay and/or for absorbing and delivering ink, etc. Any such configuration known in the art is permissible.

In this method, playing two or more motifs creates a first pattern which may form a first cluster. In a cluster, two motifs are close enough to be recognizably clustered together. Clusters depend on a context. If they are in an open playing field, almost any two motifs might be said to be clustered. And if several motifs are scattered about, then any two motifs must be much closer together to be recognized as a cluster. (FIGS. 22A and 22B) In an embodiment, one way a cluster is defined, or a way to know if a placement of a motif is in an existing cluster, is when the outer edges of two neighboring motifs are at least as close to each other as at least one of: ~60% of the longest length of the motif or as close as about 20% of the entire length of said first cluster. So being close enough that an added motif is within 40% of its longest length, which is also ~15% of the length of the multi-motif cluster, would definitely be now within this cluster. And 70% of the longest length and/or 30% of the length would be not in that cluster. Being either less than 60% of the longest length or less than 20% could be within the cluster, it depends whichever describes the longer length. In other embodiments of this invention, to be in a cluster, two motifs need to be not more than 70%, 60%, 50%, 40%, 30% or 20% of their longest length (whichever motif is longer) apart or not more than 5%, 10%, 15%, 20%, 25%, 30% or 35% of the entire distance of the cluster, with or without the added motif, and in any combination of whichever is the smaller or greater distance of the two measurements, or simply either one of these.

In this method, playing one or more of the first motif can accomplish any of the following possibilities: a) It approximately repeats an existing pattern and thereby enlarges that cluster, b) It creates a second pattern in that cluster or by forming a new cluster, c) It follows some of an existing pattern yet also substantially changes at least one characteristic of it (e.g., angle, distance), d) It blocks the ability of a future playing move to repeat or approximately repeat one of an initial or subsequent patterns in any given direction on the playing surface (Decision Field). (118 in FIG. 15C shows this if this round of play includes a rule that disallows overrunning a pattern or motif.)

In an embodiment of this method, a required step is one or more of playing: a) a motif that substantially changes a characteristic of at least one of the first, second or subsequent patterns, b) a motif that blocks the ability of a future playing move to repeat or extend a first, second or subsequent pattern in a direction, c) by replacing a motif, or d) by removing a motif. This method of this invention may include rules or direction for assessing a playing rhythm, preference, or tendency and predicting a psychological, personality, or collaboration characteristic.

Figure 25A:
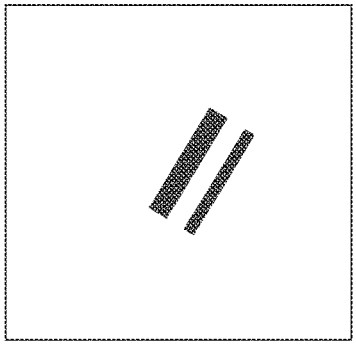
FIGS. 25A to 25L show the same 2-rectangle motif and same first three placements as FIGS. 24A-U.
Figure 25B:
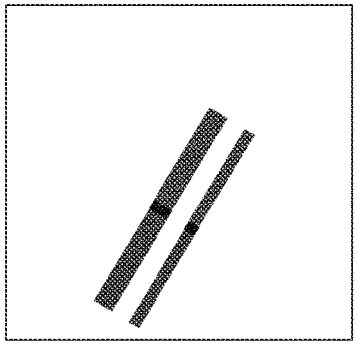
Figure 25C:
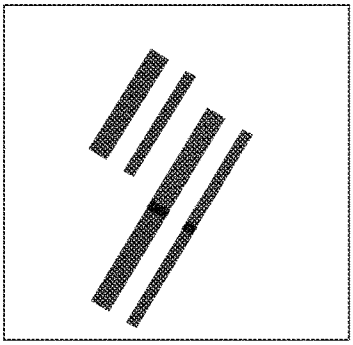
Figure 25D:
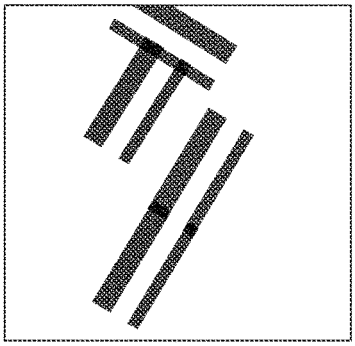
Figure 25E:
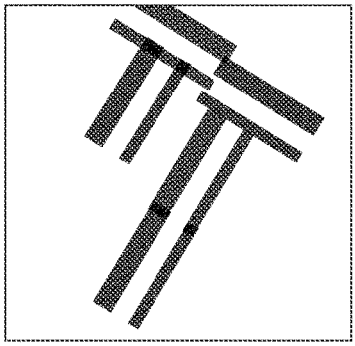
Figure 25F:
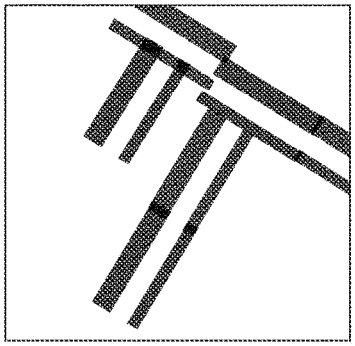
Figure 25G:
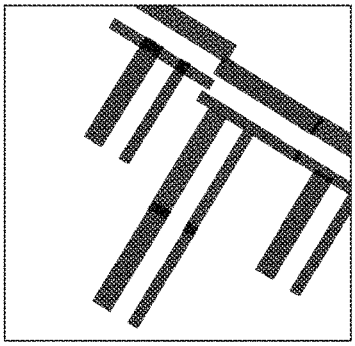
Figure 25H:
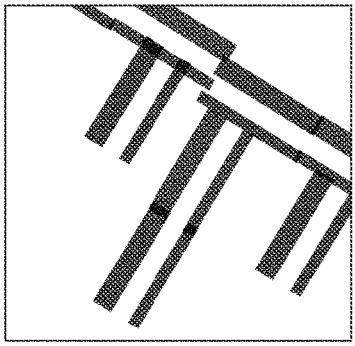
Figure 25I:
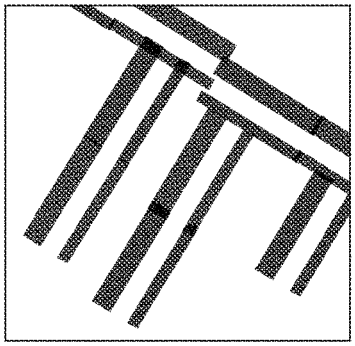
Figure 25J:
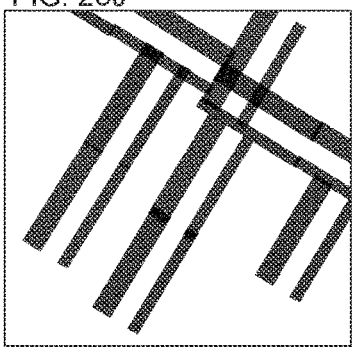
Figure 25K:
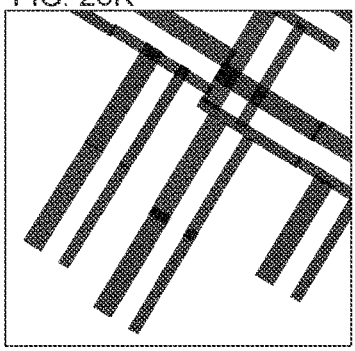
Figure 25L:
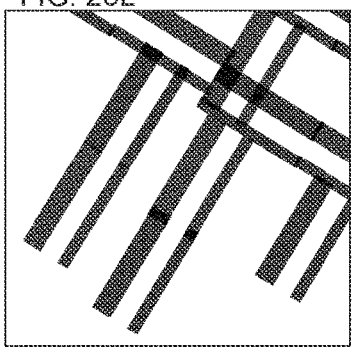

This method may include substantially changing a characteristic of an initial pattern by one or more of the following: a) substantially changing the distance one or more motifs are placed from previously played motifs in a cluster (FIG. 27E or FIG. 30F); substantially changing the angle of rotation of one or more motifs relative to previously played motifs in a cluster; changing the angle of rotation of said one or more motifs by around or exactly 90 degrees or 180 degrees (FIG. 25D). When the motifs are stamps, play can include overlapping a range from a small to a substantial part of any pattern on a playing surface (120, 134, 140, 142, FIG. 25J, FIG. 26C). This method may include using motifs of different colors and it allows changing colors of motifs relative to the colors of the motifs already played in a cluster. This method includes moving, replacing, or removing a previously played motif (170, FIGS. 29J to 29M).

Figure 2C:
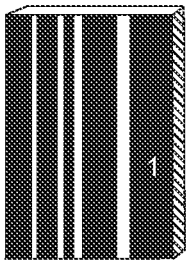

This method includes variations on how a motif can be implemented or placed, including: a) placed end to end one after the other which forms a long stripe or potentially infinite line from the shorter segments of the unit; b) long stripe patterns can repeats next to themselves, at any interval apart or overlapping, one or more times, to form multiple parallel lines (FIGS. 24A to 24U); c) said motifs can turn 180° on alternating placements to form a basketweave-type pattern (FIGS. 23A to 23L), or on every $2^{nd}$ or more placements to form a lattice-type pattern (FIGS. 26B, 26E, 26H, 26K); d) said motif can form long stripes that run parallel and cross-wise, at any angle, to form plaid-like patterns (FIGS. 26K and 26L); e) any of said patterns, having no requirement to continue, may morph into any other mentioned patterns, or into some new pattern or set of placements including chaotic messy placements. FIGS. 2A to 2C show about parallel rectangles tile modules, three variations including different numbers of parallel rectangles, different overall widths and lengths. In the ideal version, as shown, each rectangle on the tile is a distinct width, with distinct distances between them. Because of the different widths, when a tile is placed end-to-end with another that is the same, whether a tile is rotated 180° from earlier placements is knowable. These parallel rectangle tiles—and stamps, in another instantiation—can be placed end-to-end to create linear patterning, with the idea that a potentially infinitely long line is composed of these shorter segments.

Figure 1B:
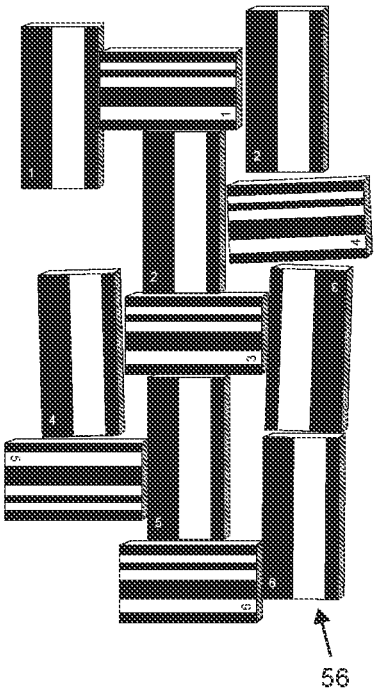

FIGS. 1A and 1B show parallel rectangle or line tile modules placed to reveal emergent patterns, inclusive of visible errors in exact placement. Each tile placement is the result of an individual choice. The player, whether human, robotic, AI or some combination, chooses to create a pattern then chooses whether or how to continue the pattern, by placing one tile at a time, though multiple tiles may be placed in a turn depending on which rules are in effect. The small variations in placement, such as misalignments or tiles rotated 180°, may indicate distraction, intention, or range of motor skills. In any case, the player may choose whether irregularities of any scale are disruptive or acceptable. FIG. 16 is a chart that shows examples of some stamped parallel rectangle motifs and a plurality of acceptable ways they might be placed. With parallel rectangle motifs, placement of each motif is often followed by another that continues, interrupts, or crosses it. Though placements may be at right angles to one another, as the motifs seem to invite, the game accepts placements at any angles and players may enjoy discovering the creative freedom in placements that are not at 90° to one another. Acceptable compositions that may be built into patterns may be made using the same or different motifs. Motifs may overlap, rotate, or curve within an established pattern section or independently of it.

Placements of motifs onto the playing surface include but are not limited to: next to or adjacent, flipped, perpendicular, parallel or nearly parallel, askew, jogging, or misaligned. Placement of motifs may take on a crystalline or solid patterning, with touching edges and sufficient density. Placements of motifs preferably form clusters or groups that are non-linear although linear repetitions are acceptable or encouraged in some embodiments.

Figure 23A:
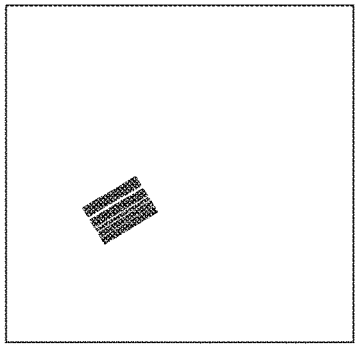
FIGS. 23A to 23J show a sequence of a pattern cluster forming, one move at a time, inclusive of rotated stamp placement in FIG. 23H.
Figure 23B:
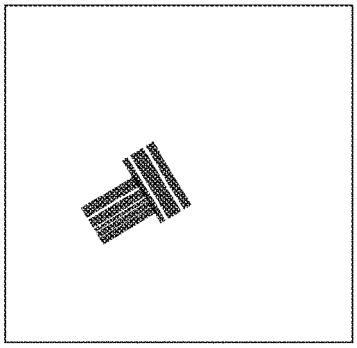
Figure 23C:
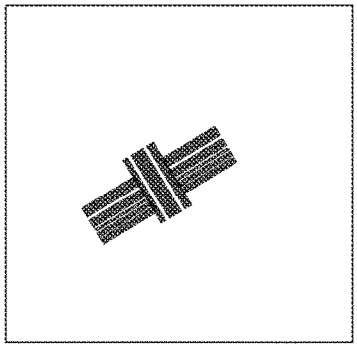
Figure 23D:
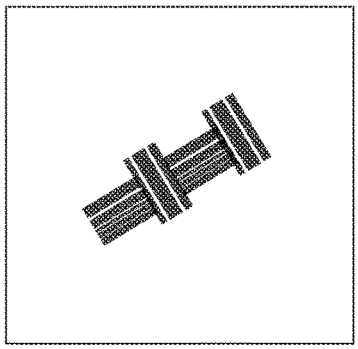
Figure 23E:
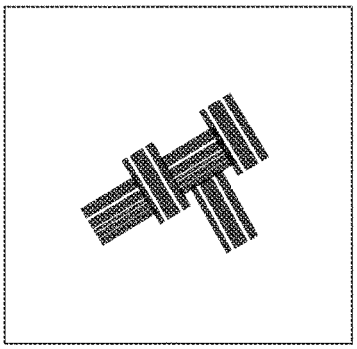
Figure 23F:
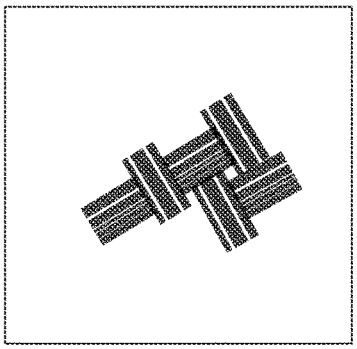
Figure 23G:
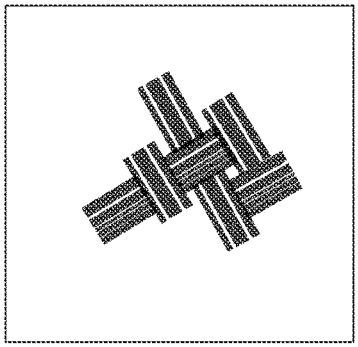
Figure 23H:
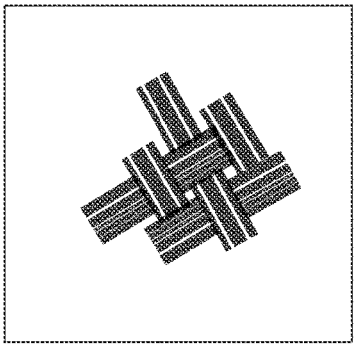
Figure 23I:
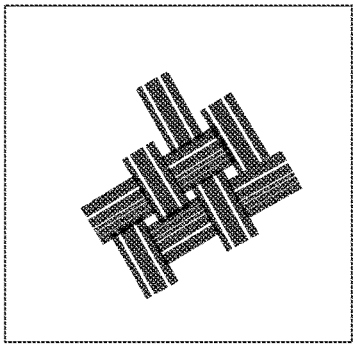
Figure 23J:
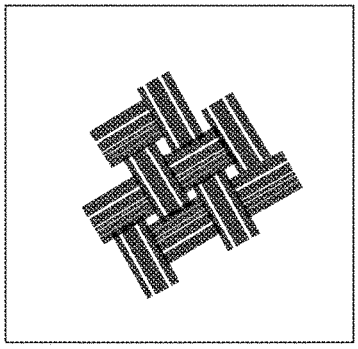
Figure 23K:
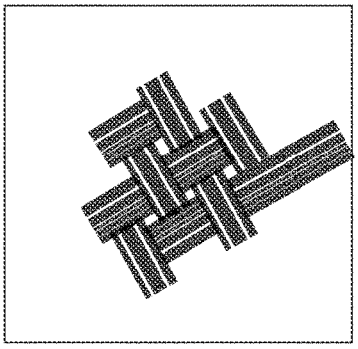
FIGS. 23K and 23L show stamp placement altering the pattern by repeating a 3-rectangle stamp and a 5-rectangle stamp in each direction without rotating or alterations.
Figure 23L:
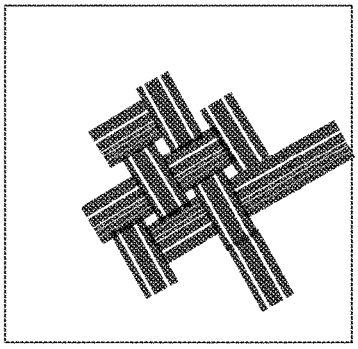
Figure 24A:
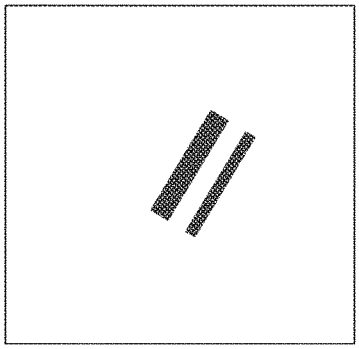
FIGS. 24A to 24U show a stripe pattern composed of multiple 2-rectangle stamp placements including irregularities such as the rotated stamp that appears in FIG. 24I.
Figure 24B:
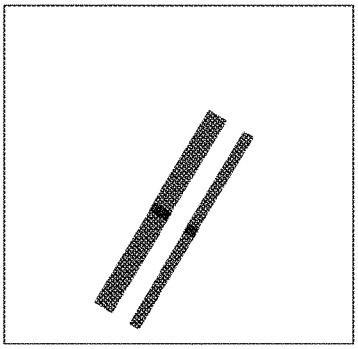
Figure 24C:
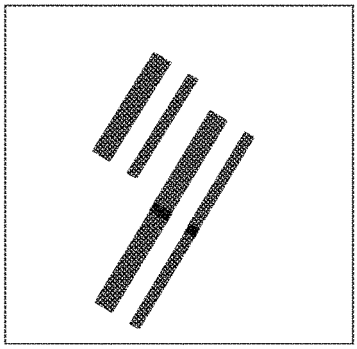
Figure 24D:
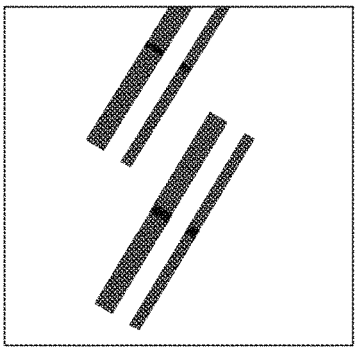
Figure 24E:
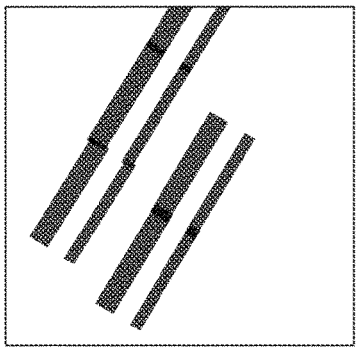
Figure 24F:
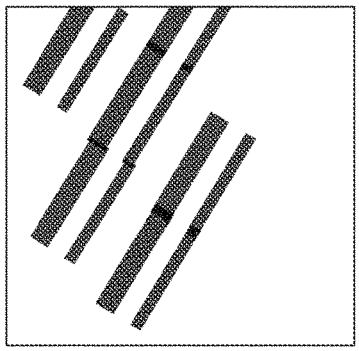
Figure 24G:
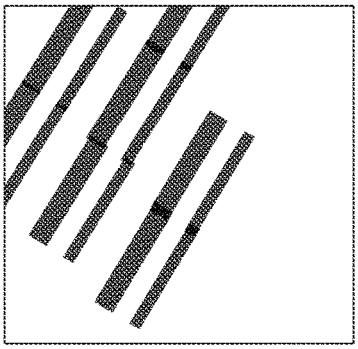
Figure 24H:
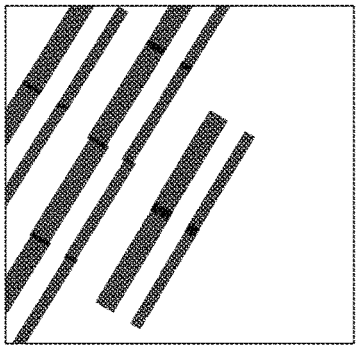
Figure 24I:
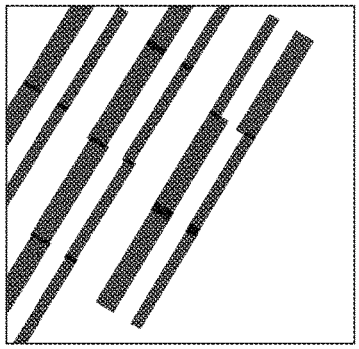
Figure 24J:
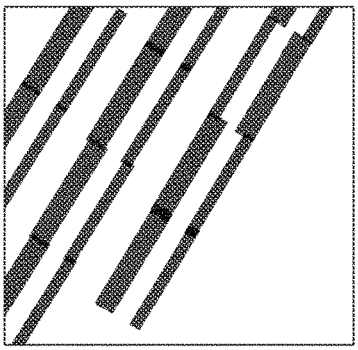
Figure 24K:
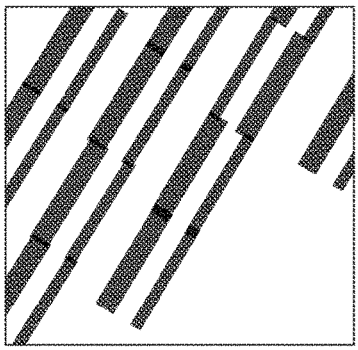
Figure 24L:
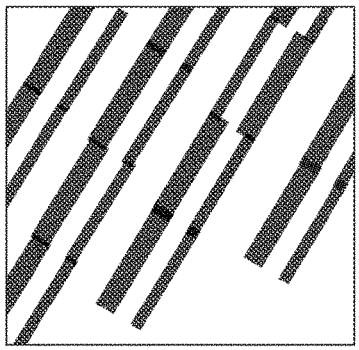
Figure 24M:
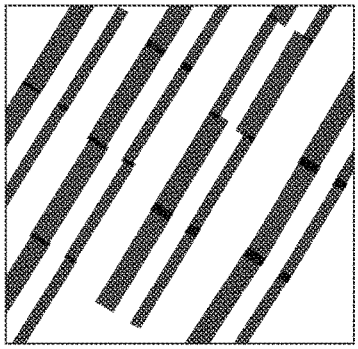
Figure 24N:
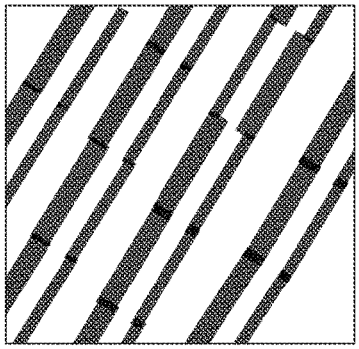
Figure 24O:
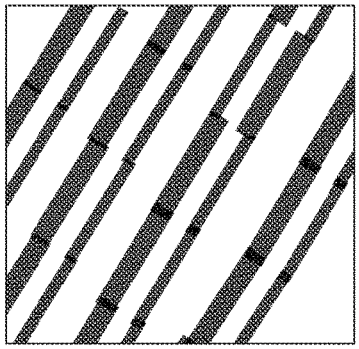
Figure 24P:
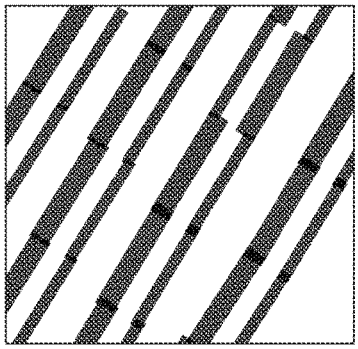
Figure 24Q:
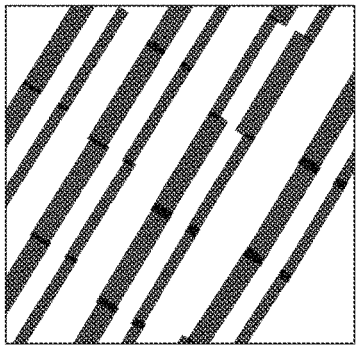
Figure 24R:
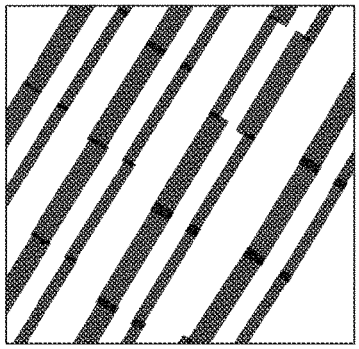
Figure 24S:
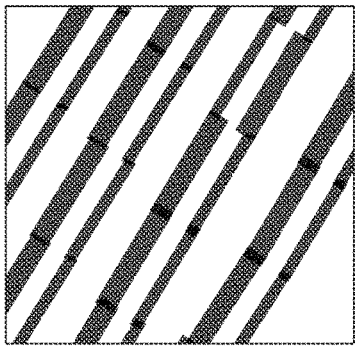
Figure 24T:
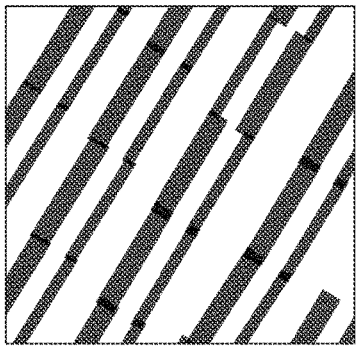
Figure 24U:
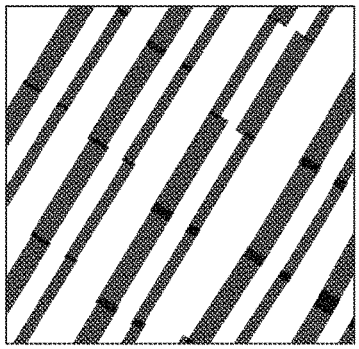

FIGS. 23A to 23J show a sequence of a pattern cluster forming, one move at a time, inclusive of rotated stamp placement in FIG. 23H. FIGS. 23K and 23L show stamp placement altering the pattern by repeating a 3-stripe stamp and a 5-stripe stamp in each direction instead of rotating and altering the 3- and 5-stripe stamps. FIGS. 24A to 24U show a stripe pattern composed of multiple 2-stripe stamp placements. The stripe pattern includes irregularities such as the rotated stamp that appears in FIG. 24I, irregularities that do not disrupt the overall pattern. In this pattern, the single decision to place the motif sequentially to create longer parallel lines, like stripes, is consistent throughout. FIGS. 25A to 25L show the same stripe motif and same first three placements as FIGS. 24A to 24U. FIGS. 25D to 25L show a different emergent pattern than FIGS. 24A to 24L.

Figure 26A:
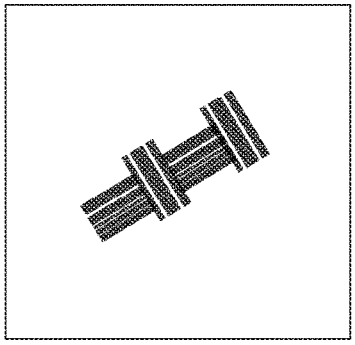
FIGS. 26A to 26L show variations on emergent patterns.
Figure 26B:
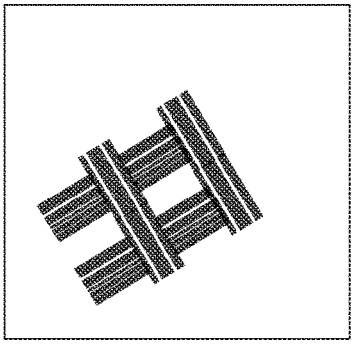
Figure 26C:
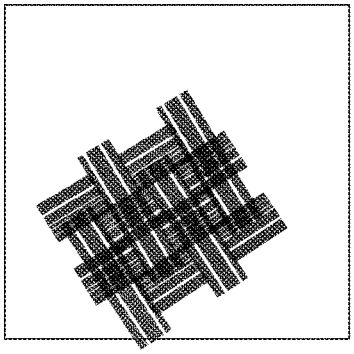
Figure 26D:
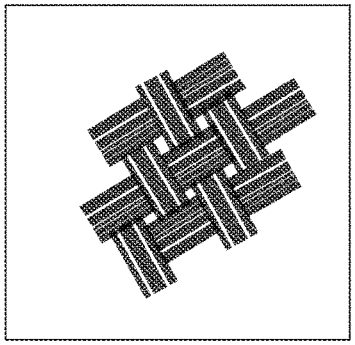
Figure 26E:
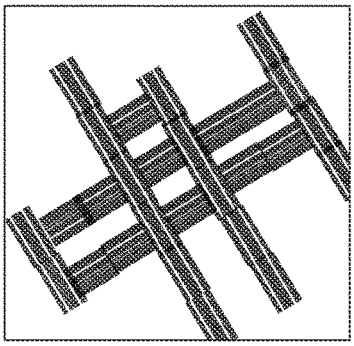
Figure 26F:
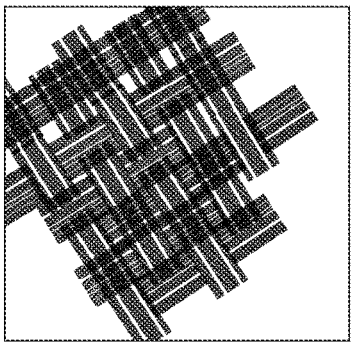
Figure 26G:
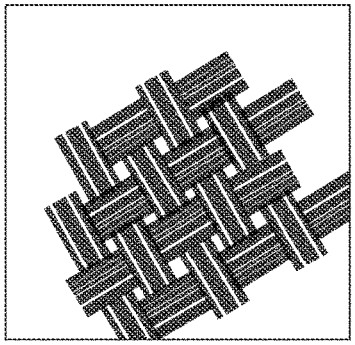
Figure 26H:
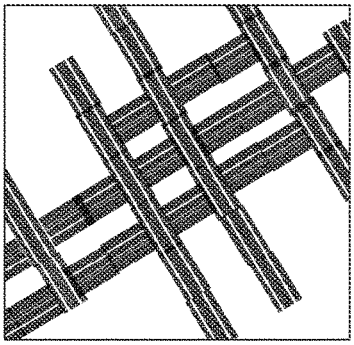
Figure 26I:
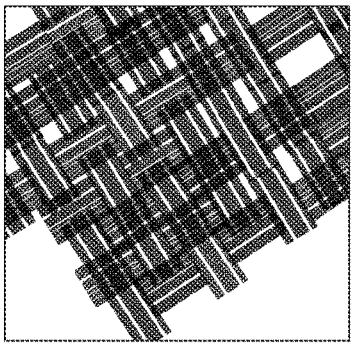
Figure 26J:
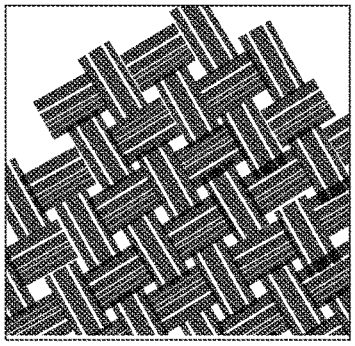
Figure 26K:
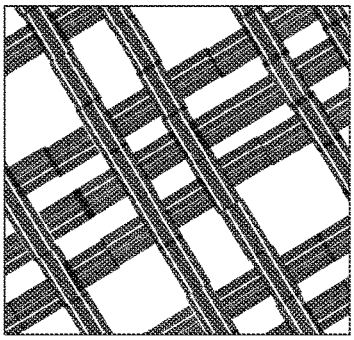
Figure 26L:
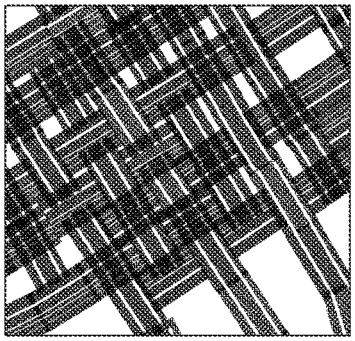
Figure 27A:
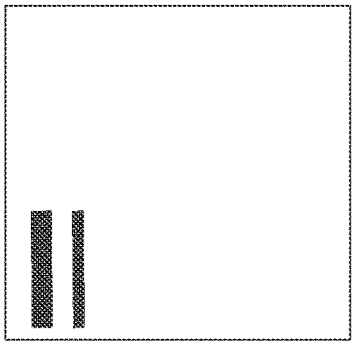
FIGS. 27A to 27L show a pattern emerging from vertical and diagonal stamp placements.
Figure 27B:
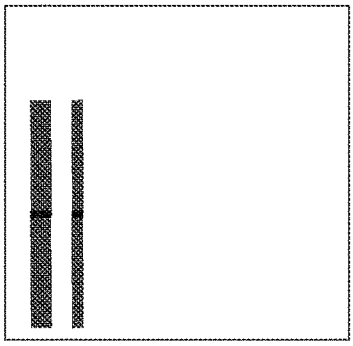
Figure 27C:
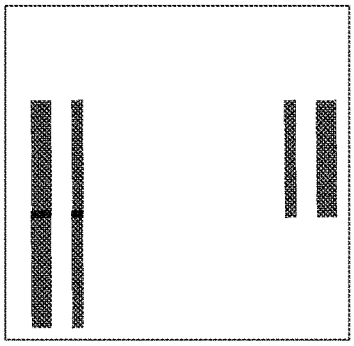
Figure 27D:
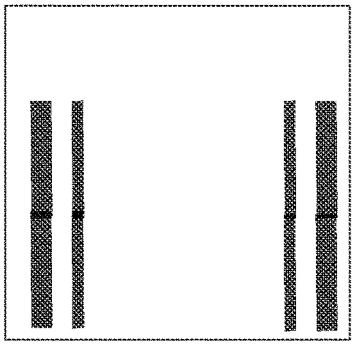
Figure 27E:
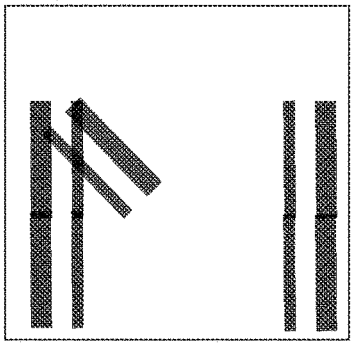
Figure 27F:
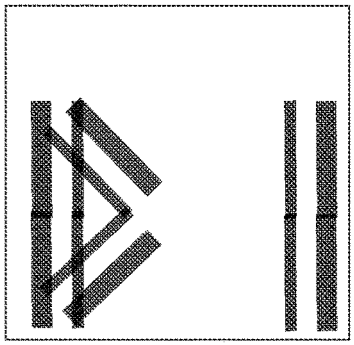
Figure 27G:
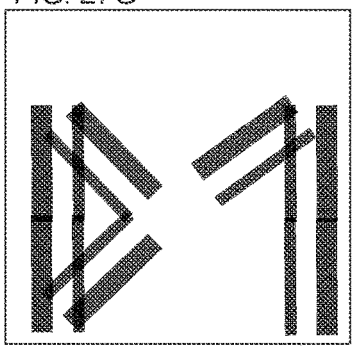
Figure 27H:
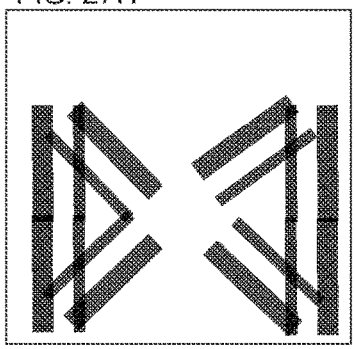
Figure 27I:
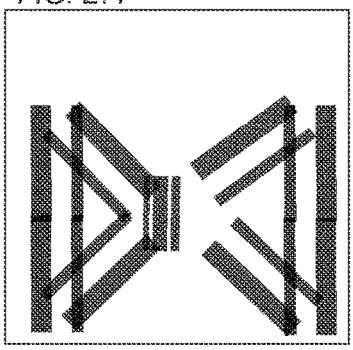
Figure 27J:
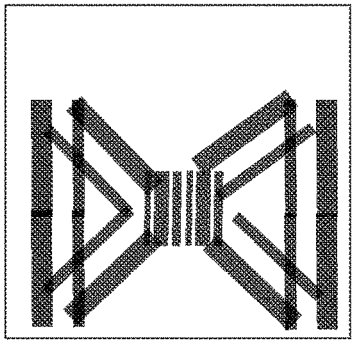
Figure 27K:
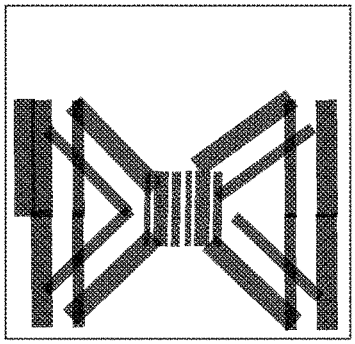
Figure 27L:
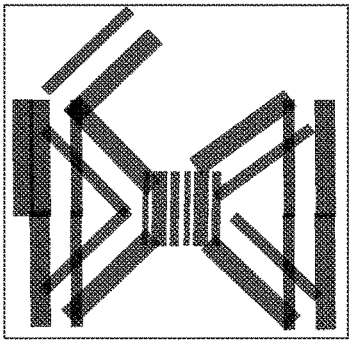
Figure 28A:
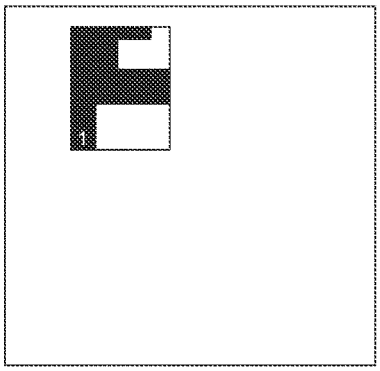
FIGS. 28A to 28J show a pattern emerging from placements of an irregular polygon motif tile, with the emergent pattern changing from a simple linear repeat to include reversals and rotations.
Figure 28B:
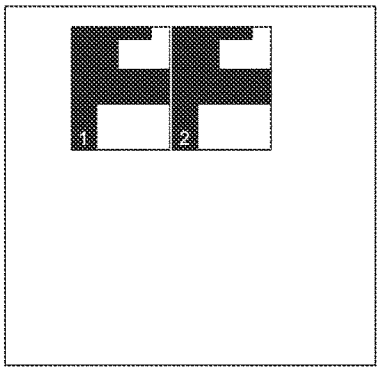
Figure 28C:
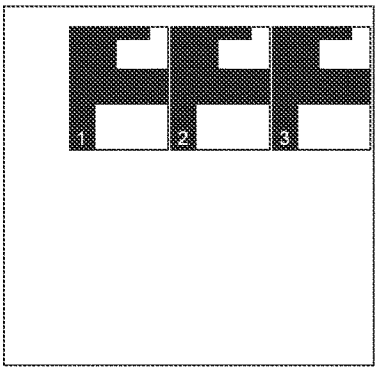
Figure 28D:
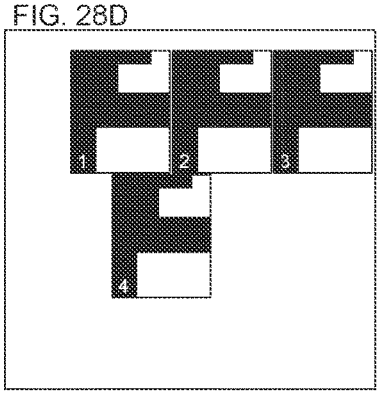
Figure 28E:
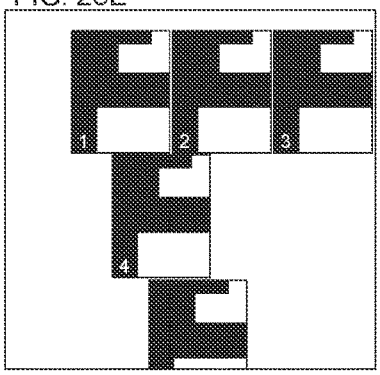
Figure 28F:
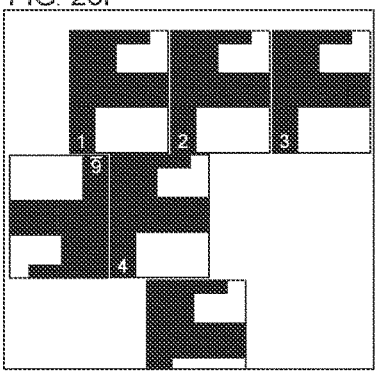
Figure 28G:
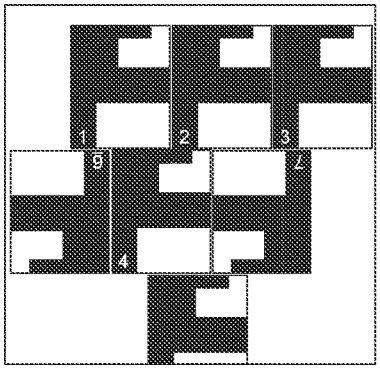
Figure 28H:
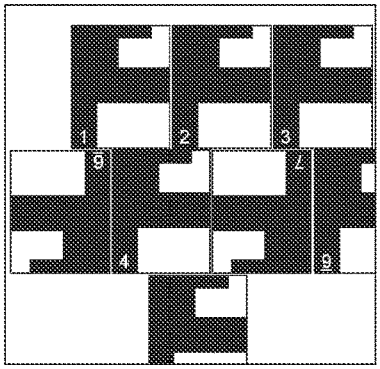
Figure 28I:
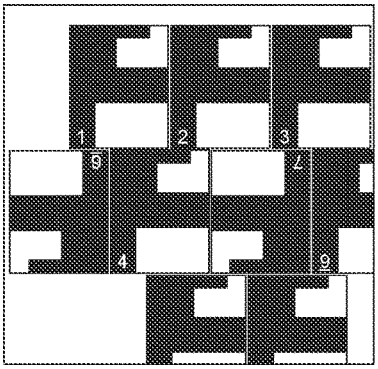
Figure 28J:
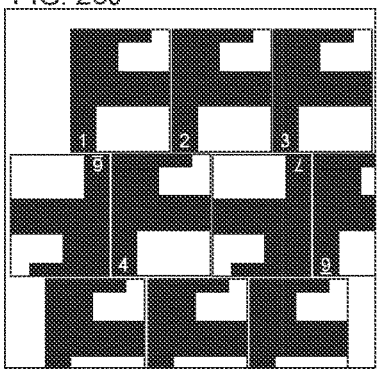

FIGS. 26A to 26L show variations on emergent patterns. FIGS. 26A, 26D, 26G, and 26J show a basketweave pattern emerging. FIG. 26B repeats the motif of FIG. 26A. FIGS. 26E, 26H, and 26K develop a pattern that follows from that repetition. FIG. 26C repeats the motif of FIG. 26B. FIGS. 26F, 26I, and 26L develop a pattern that follows from that repetition. A cluster forms in FIG. 26A. A player may extend this cluster in any number of possible variations. For example, the order of decision-making from FIG. 26A proceeding to FIG. 26D proceeding to FIG. 26G proceeding to FIG. 26J shows the original cluster becoming a basketweave. The order of decision-making from FIG. 26A proceeding to FIG. 26B proceeding to FIG. 26E proceeding to FIG. 26H proceeding to FIG. 26K shows the original cluster becoming a loose plaid. The order of decision-making from FIG. 26A proceeding to FIG. 26B proceeding to FIG. 26C proceeding to FIG. 26F proceeding to FIG. 26I proceeding to FIG. 26L shows the original cluster becoming a loose plaid.

Figure 29M:
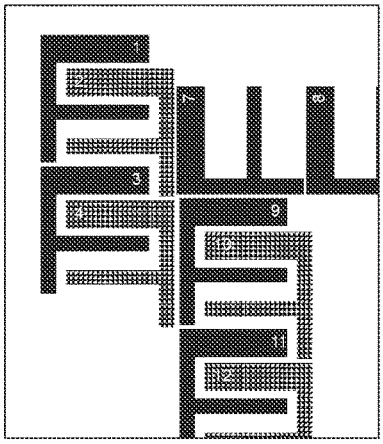

FIGS. 29A to 29M show a pattern emerging from placements of an irregular polygon motif tile, where the tile is the same shape as the polygon. In a preferred embodiment, the tiles have unique numbers as part of their design. FIG. 29K shows the removal of tiles numbered 5 and 6. FIG. 29M shows tiles with numbers 9 to 12 moved left to occupy the space where 5 and 6 were.

Figure 30A:
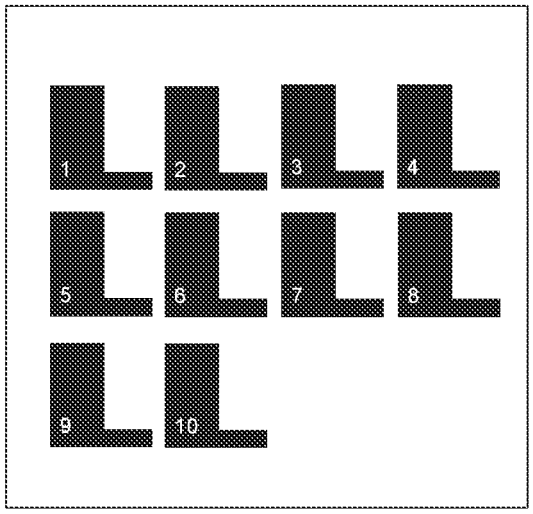
FIG. 30A shows the irregular polygon tiles for Player A, numbered 1-10.
Figure 30B:
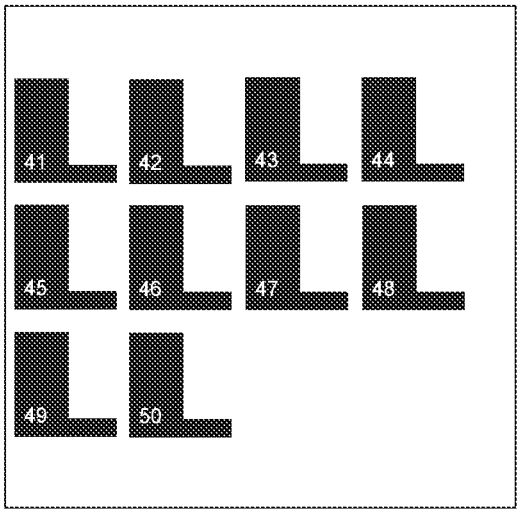
FIG. 30B shows the irregular polygon tiles for Player B, numbered 41-50.
Figure 30C:
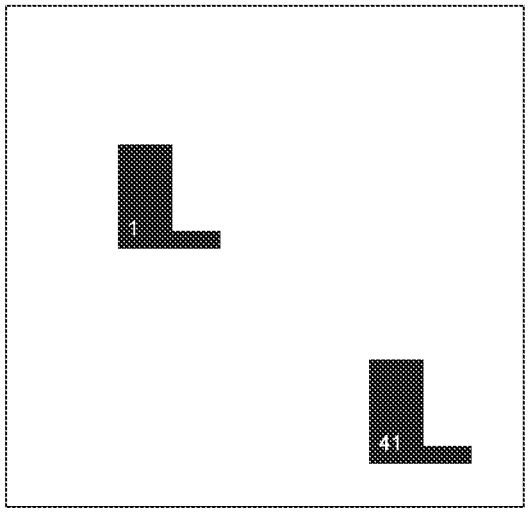
FIGS. 30C to 30G show separate patterns emerging for both players on the same playing surface.
Figure 30D:
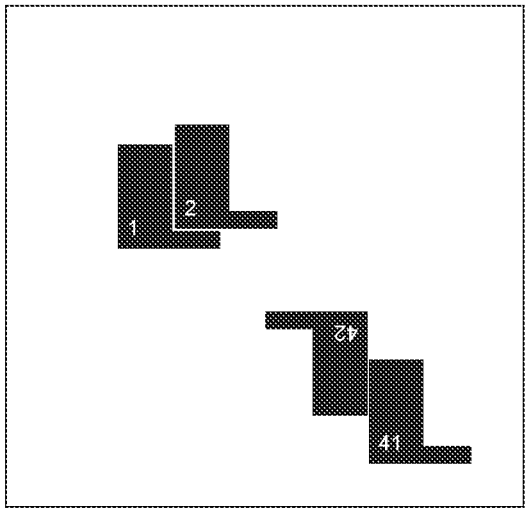
Figure 30E:
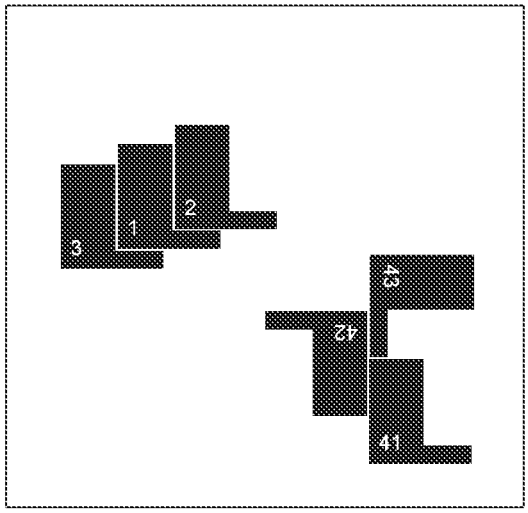
Figure 30F:
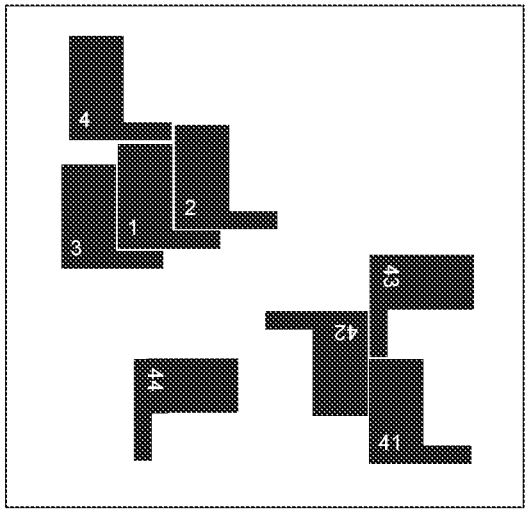
Figure 30G:
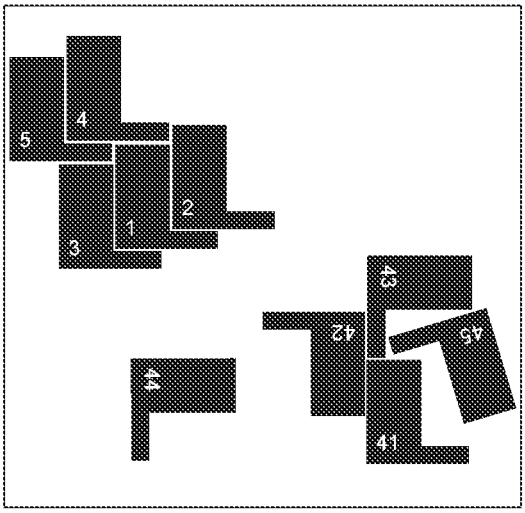
Figure 30H:
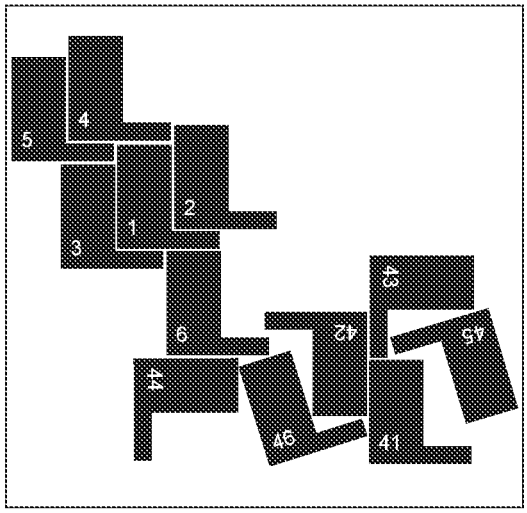
FIGS. 30H to 30K show the tile placements of how Players A and B choose to have their patterns interact on the playing surface.
Figure 30I:
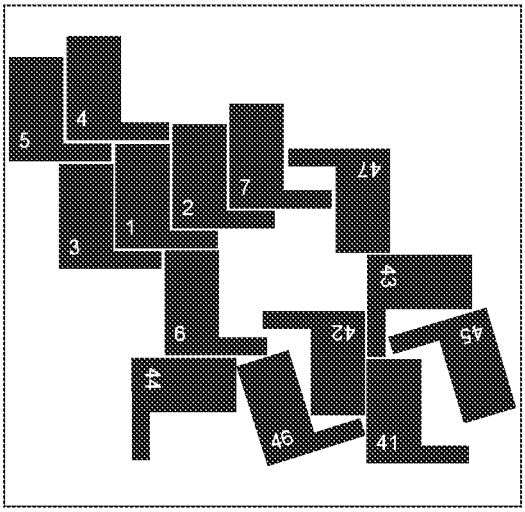
Figure 30J:
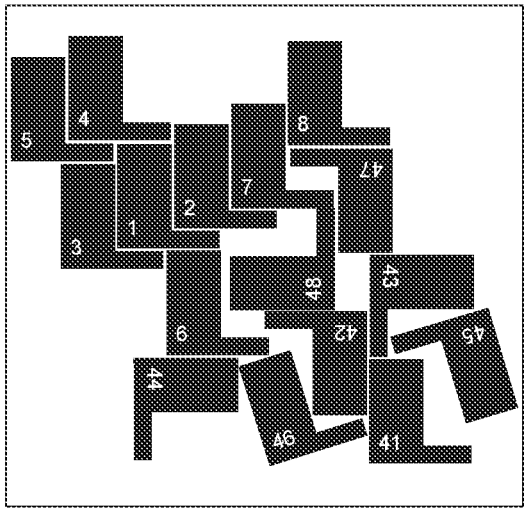
Figure 30K:
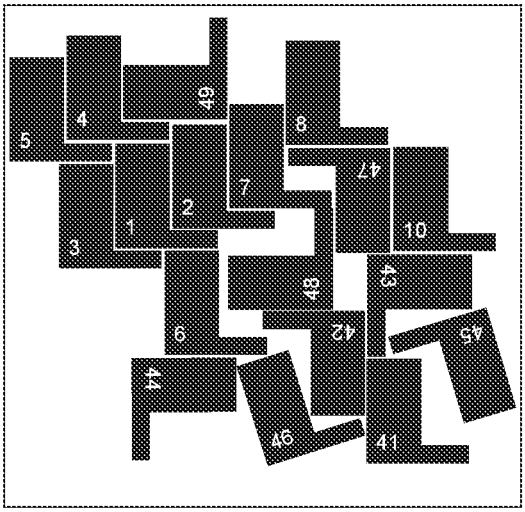

FIG. 30A shows the irregular polygon tiles for Player A, numbered 1-10. FIG. 30B shows the irregular polygon tiles for Player B, numbered 41-50. FIGS. 30C to 30G show separate patterns emerging for both players on the same playing surface. FIGS. 30H to 30K show the tile placements how Players A and B choose to have their pattern clusters interact when they reach each other on the playing surface.

Figure 31A:
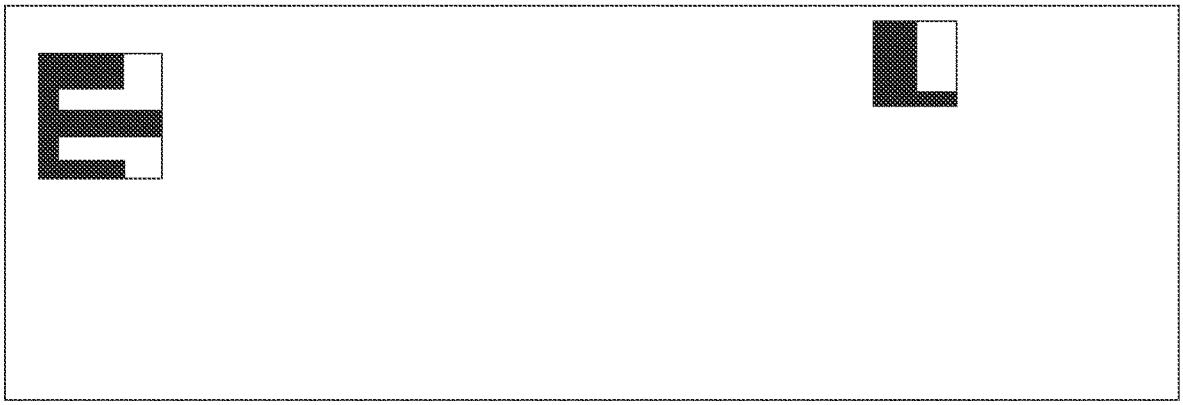
FIGS. 31A to 31H shows sequences in a two player game where each player adds multiple tiles per turn, based on a chance operation like dice rolling.
Figure 31B:
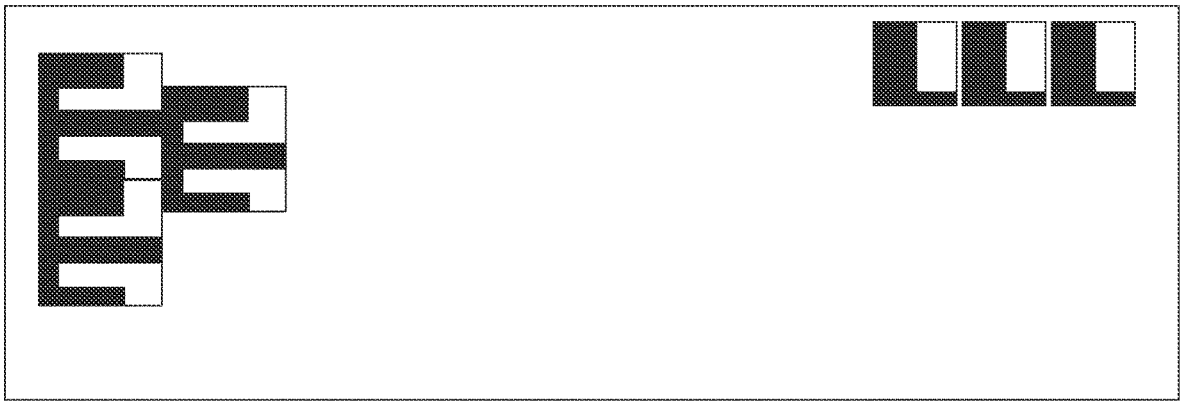
Figure 31C:
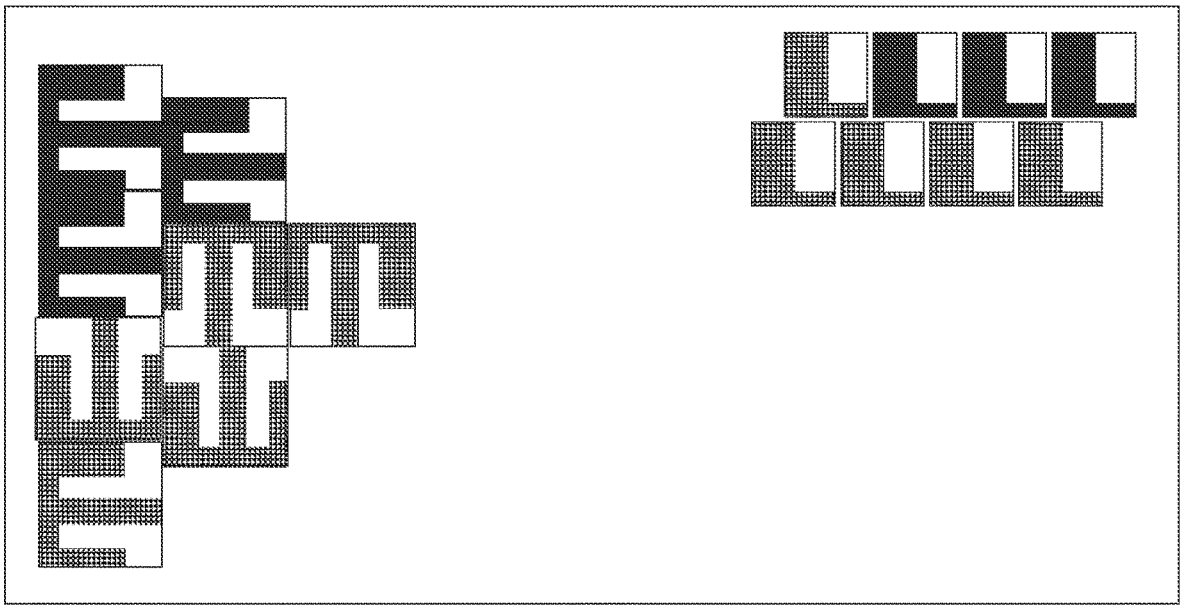
Figure 31D:
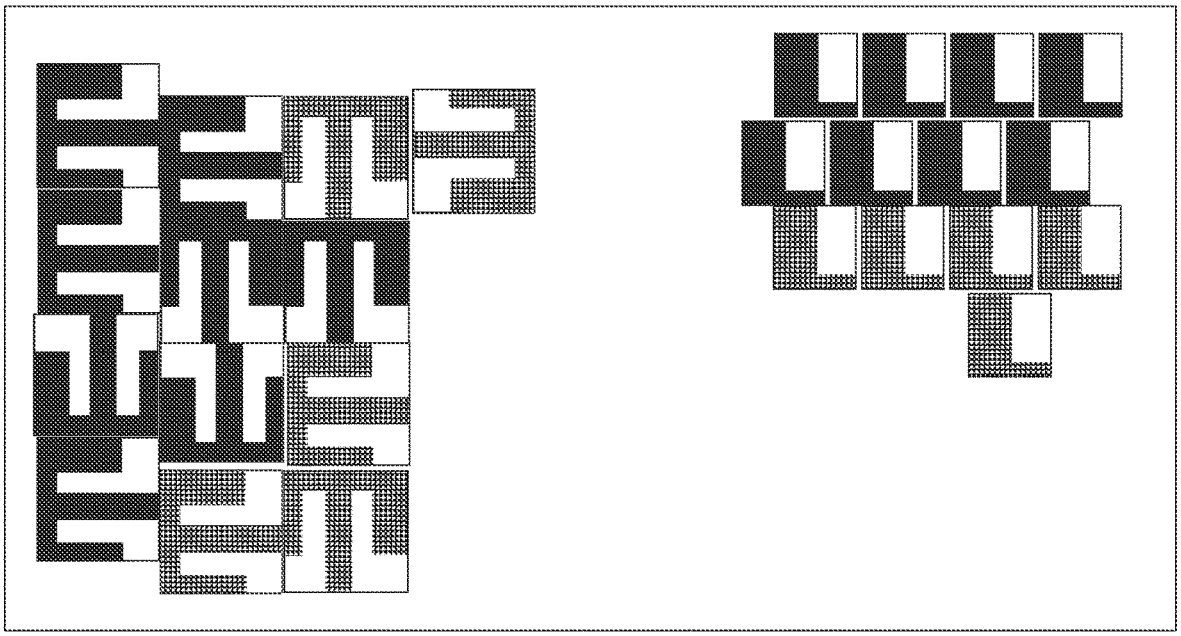
Figure 31E:
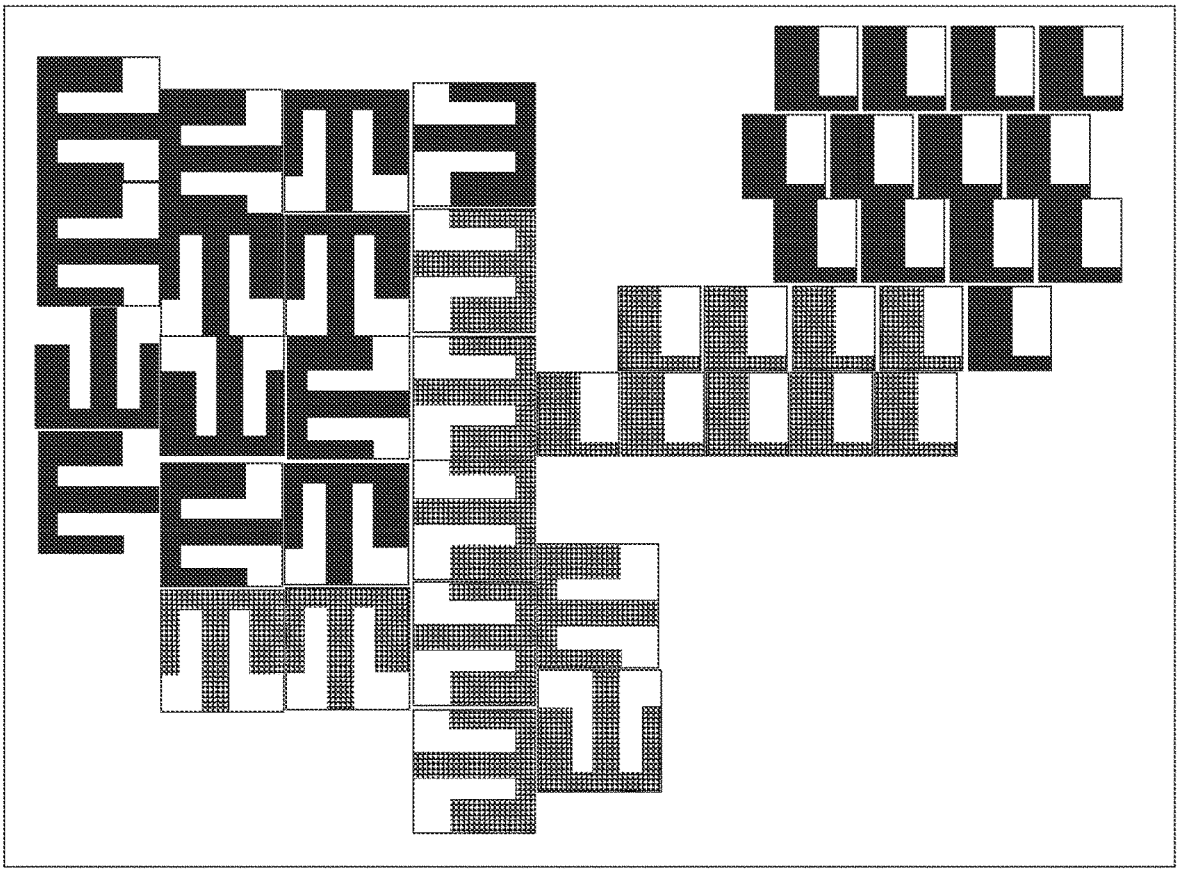
Figure 31F:
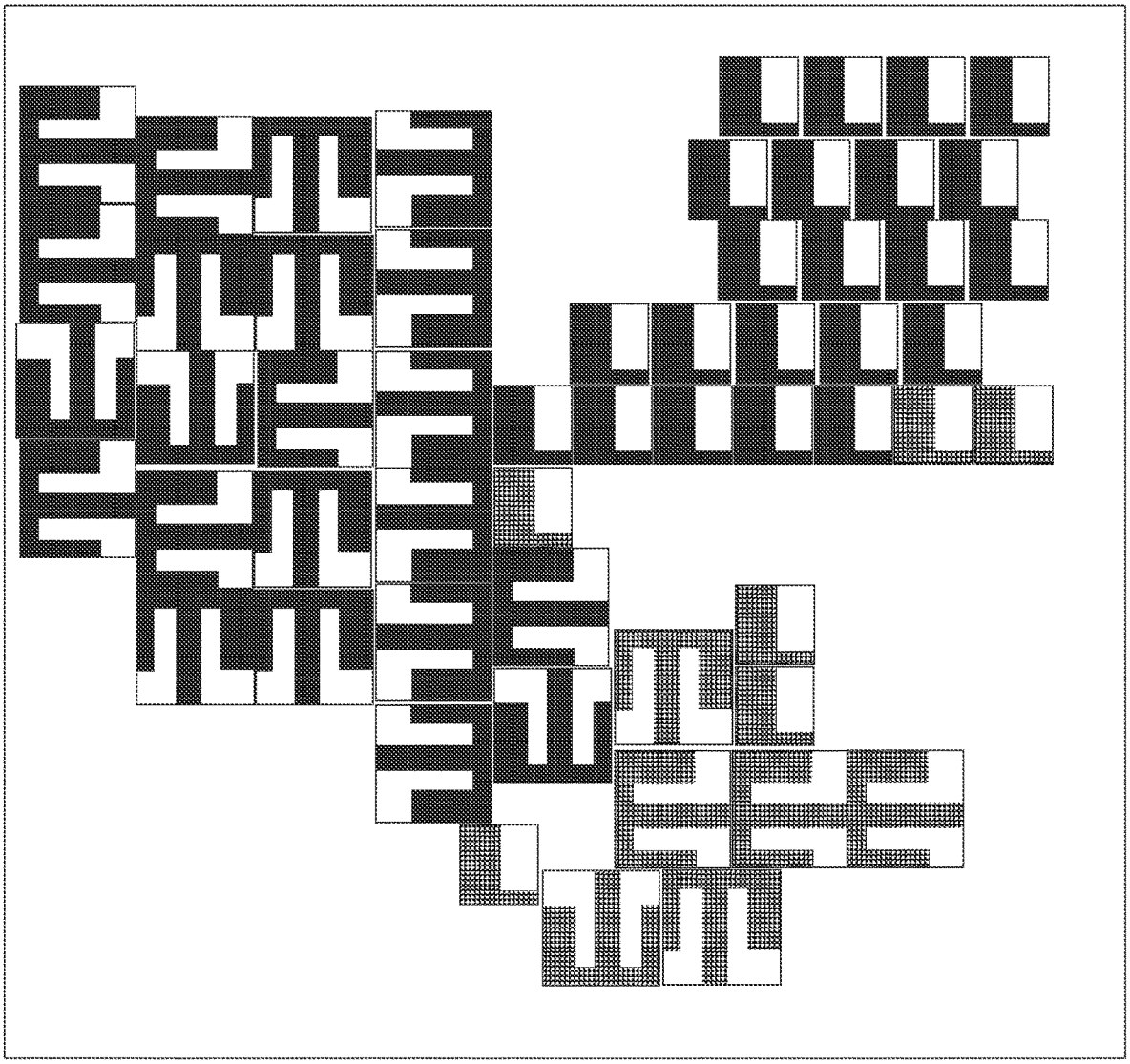
Figure 31G:
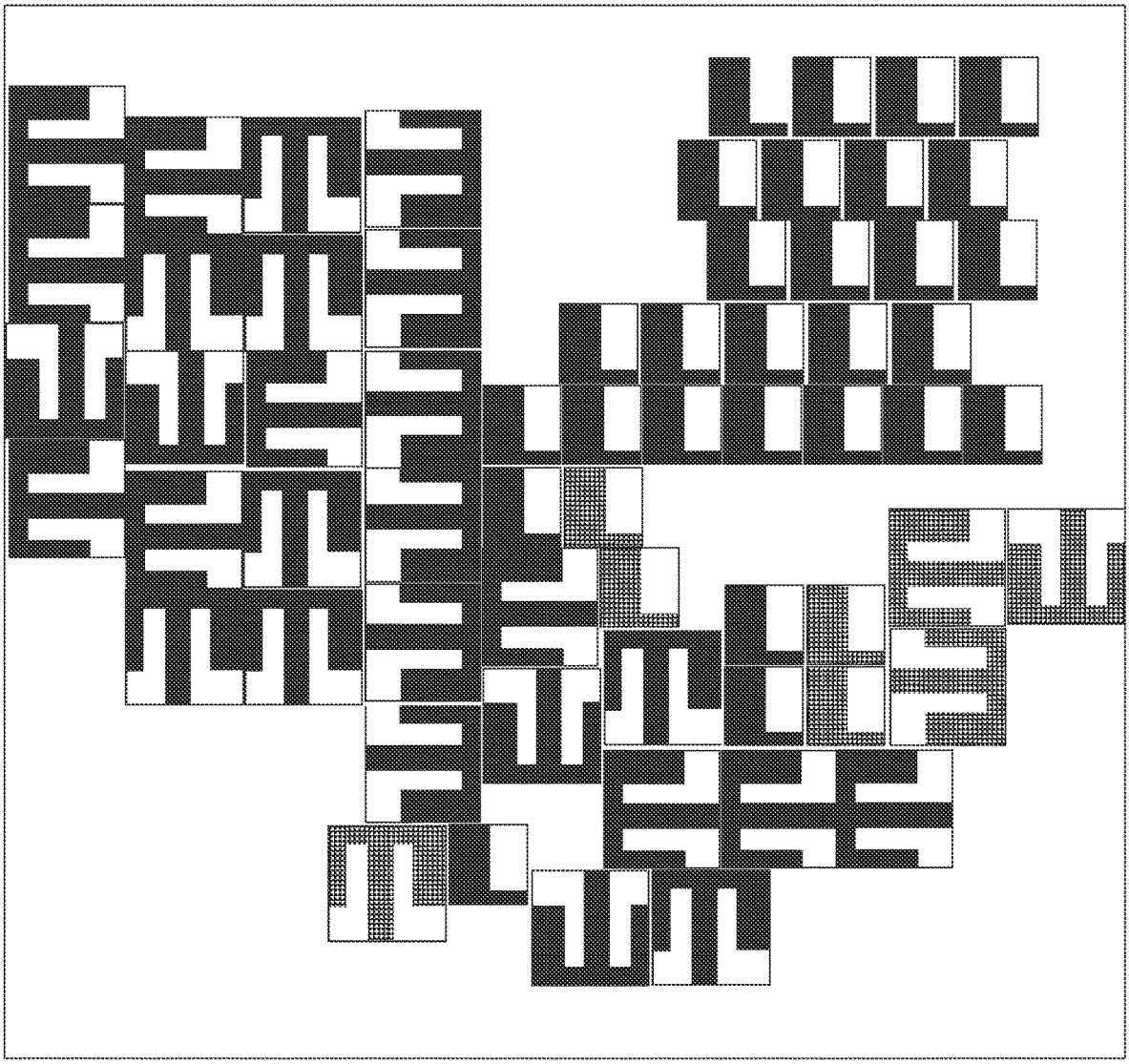
Figure 31H:
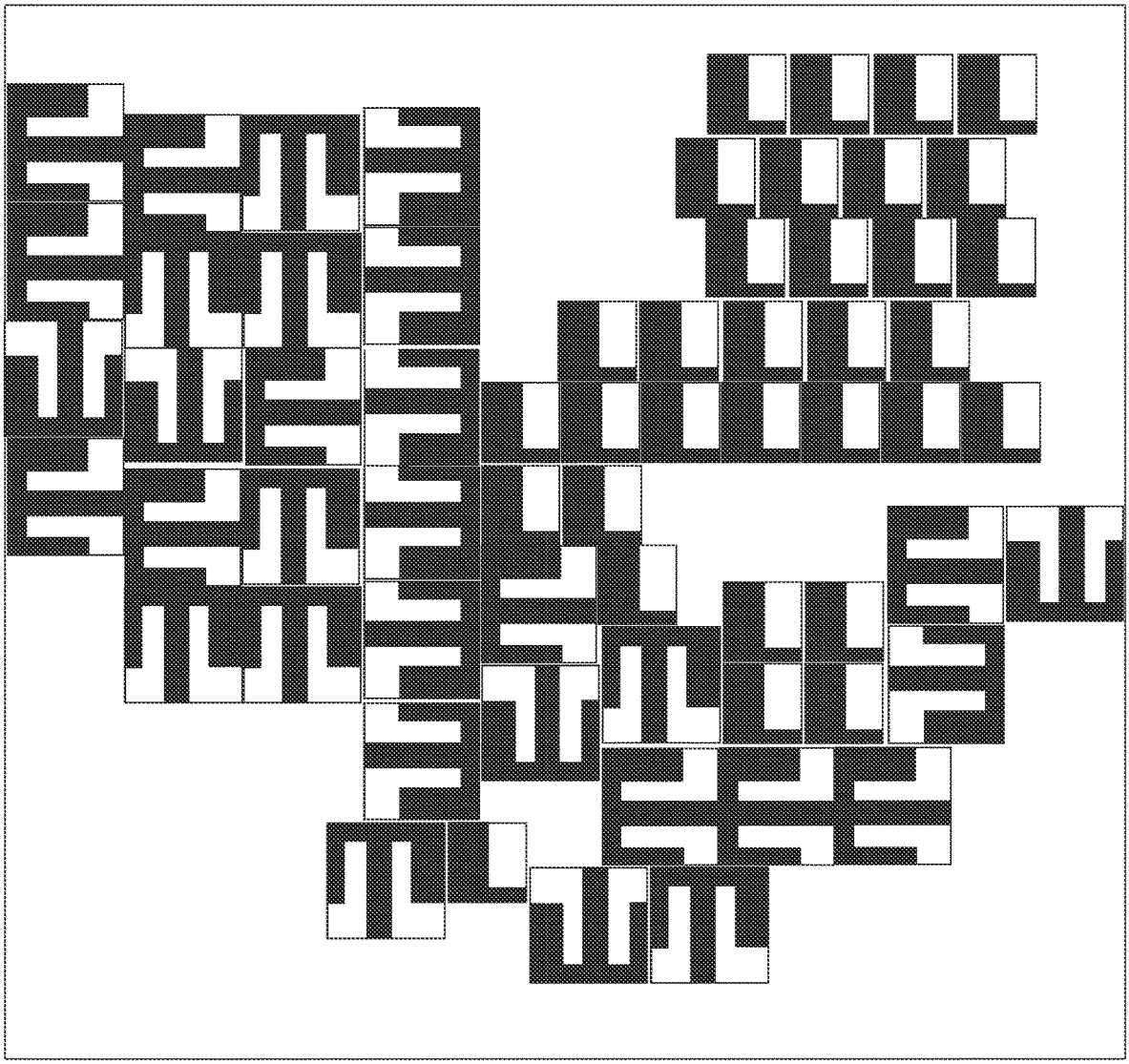
Figure 32:
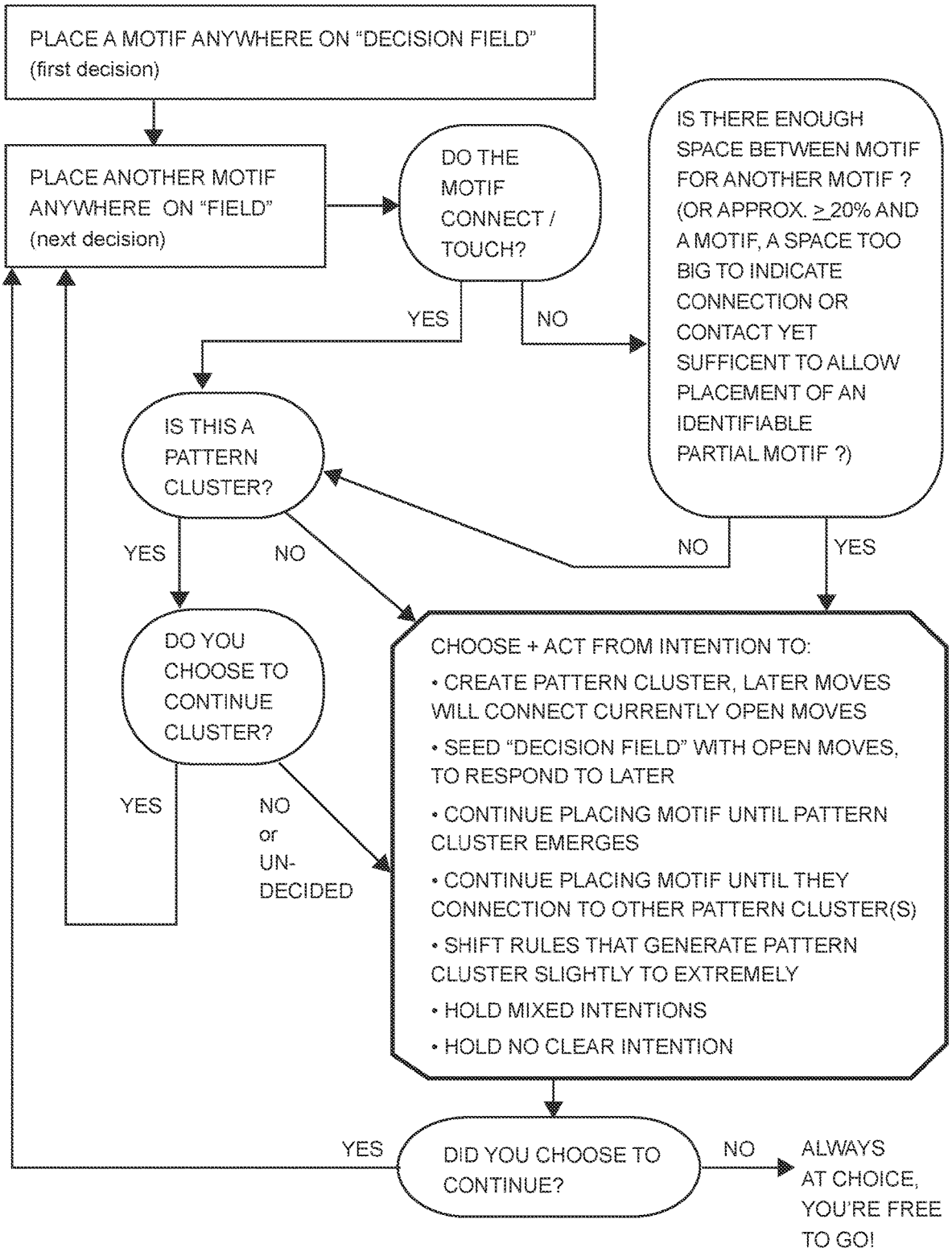
FIG. 32 shows a detailed flowchart that depicts the decisions flow around creating pattern clusters.

FIGS. 31A to 31H shows sequences in a two player game in which each player adds multiple tiles per turn, based on a chance operation like dice rolling. FIG. 31C shows five new tiles per pattern cluster or per player. FIG. 31D shows another five new tiles per pattern cluster. FIG. 31E shows nine new tiles placed per pattern cluster, including tiles that connect the two clusters. FIG. 31F shows six new tiles, including tiles from the right cluster intermingling with the left cluster. FIG. 31G shows four new tiles added and further intermingling of the clusters. FIG. 31H shows where the players chose to end the game.

In stamped or software embodiments, motifs may include overlaps, edge misalignments, blurring, smudging, slight to total rotation, which add to the complexity and satisfaction of play. Embodiments on thin, transparent tiles may include some overlaps and rotations. Embodiments on thicker, opaque tiles will not include overlaps or smudges but can show edge misalignments. The higher degree of irregularity the embodiment allows, the higher degree of complexity will appear in play or use, and the greater number of decisions or amount of attention a player may exert. This includes decisions made in an embodied way, and how the player manages their motor skills.

This method includes distributing one or more motifs among each player, when there are a plurality of players, with instructions that the players both give and receive rules for creating patterns.

This method includes providing different two-dimensional motifs to each player, when there's more than one, and for the players to take turns using the motif they each have. They may choose to work on the same or on different pattern clusters, and how their different pattern clusters connect or interact. (FIGS. 15B to 15C, FIGS. 30A to 30K, FIGS. 31A to 31H).

This method includes providing a set of instructions for how to play the motifs and following an instruction from said set directing how to play one of said motifs. Instruction may be selected from the group consisting of: alternate, amplify, avoid, combine, conclude, continue, coordinate, deflect, differentiate, diverge, expand, extend, flip, flirt, fortify, intermingle, interrupt, invert, loosen, nudge, persist, redirect, respond, reverse, start, tease, tighten, transition, and veer.

Figure 17A:
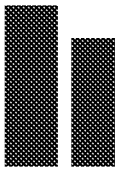
FIGS. 17A to 17C show variations of parallel rectangle motifs.
Figure 17B:
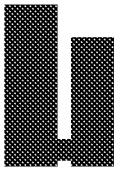
Figure 17C:
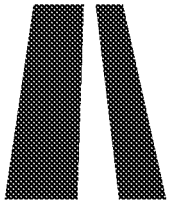
Figure 17D:
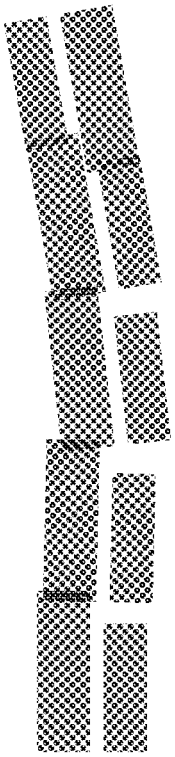
FIGS. 17D to 17F show a selection of adjacent moves for each of these motifs in play, as stamp impressions.
Figure 17E:
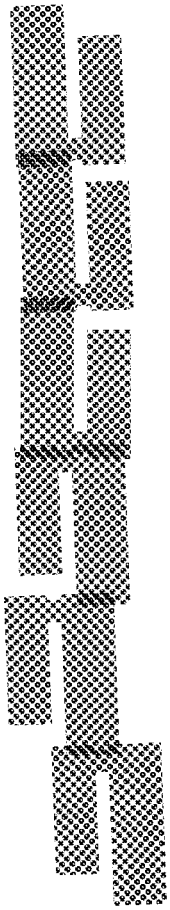
Figure 17F:
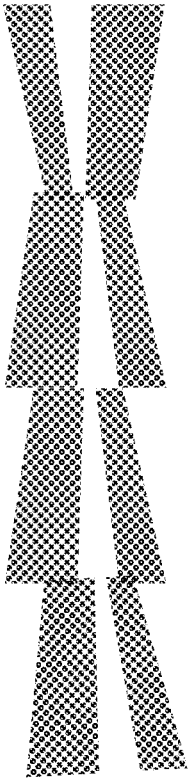

The method of this invention may include stamping of a motif on or in a playing surface and overlapping a portion of a previously played motif. (FIG. 17E or FIG. 24B). FIG. 15A shows a blank playing surface, which may be called a Decision Field. An analog Decision Field can be paper, cloth, or any surface that will show marks. A horizontal Decision Field, on a table or floor, may encourage a player to use a broad range of embodied motion. A Decision Field may be partially translucent, or porous, so choices of motif placement from one face bleed through to a lower face. A Decision Field may bend, warp, twist, loop, fold, crumple, pleat, rip, puncture, as a whole or in part, before, during, or after play. A digital Decision Field may be on a computer screen or in virtual reality. Computer software can create a playing surface in many shapes, including with swooping and folding, as a single plane or plurality of planes.

This invention includes a kit for playing an emergent pattern game comprising at least one two-dimensional motif for playing an emergent pattern game. Said motif has a playing plane and a theoretical minimal-area rectangular bounding box which contains said motif along said playing plane. Said motif is not fully or about radially symmetric and not fully or about rotationally symmetric. Said motif extends to or extends to about at least one corner of said box and less than fully to at least one side of said box. Said motif by itself does not consist of nor can two or more of said first motifs be arrangeable to consist of a solid regular polygon or solid basic shape.

This kit includes a deck of three or more cards. Each card has a unique instruction which directs how to play one or more of the motifs. (FIGS. 13A and 13B) These instructions are behaviors, and there is one per card. Among the behaviors are: accompany, allow, alternate, amplify, augment, avoid, combine, comment, commingle, conclude, continue, coordinate, deflect, differentiate, diverge, encourage, expand, extend, extrapolate, filter, flip, flirt, flow, fortify, infuse, intensify, intermingle, interrupt, interpolate, invert, loosen, nudge, overrun, pace, persist, redirect, rejoin, relieve, respond, reverse, start, suggest, tease, tighten, transfer, transition, or veer.

Figure 14:
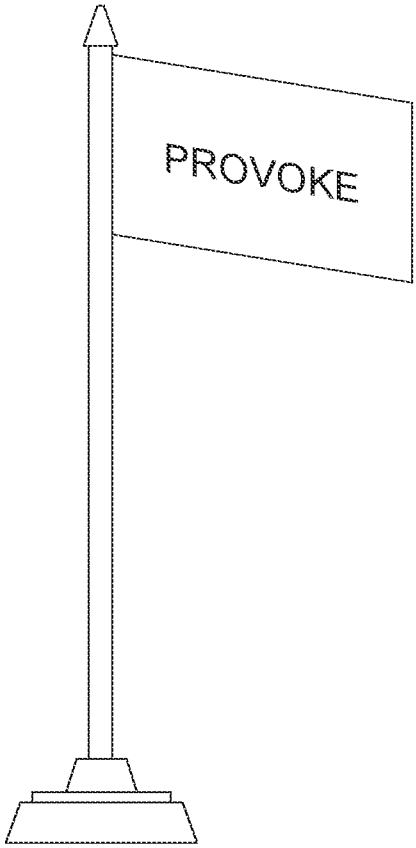
FIG. 14 shows a card holder in the shape of a model flagpole that can be used in play.

In an embodiment, there are directions for play that reference behaviors, preferably focusing on what is desired in play, such as collaboration, responsiveness, attention, choice and generally excluding aggressive and territorializing behaviors although these latter are possible if not desirable. With Behaviors, there are multiple ways to interpret or respond to each word. In some embodiments, these behaviors are listed on cards, which may be chosen by players, or correlated with numbers on dice, or generated by a computational algorithm or a randomizing system. In an embodiment, the behaviors are on cards which can be drawn by players to inspire or direct play. (FIGS. 13A and 13B) In an embodiment, a Behavior card may be placed in a holder such as a miniature flag (FIG. 14) stand and may also be placed onto the playing surface to be referenced by the players or to guide them. In an embodiment there are blank cards where agents can add behaviors not already listed as well as instruction variations.

This kit includes instructions for playing the emergent pattern game of this invention. These instructions include the options of playing an initial motif and subsequent motifs. Playing a second or additional motif may start generating a pattern. The pattern begins to emerge from two or more motifs being played as a cluster, which is where the motifs are placed fairly close to each other or touching.

The kit's instructions include suggesting a player draw a Behavior card and follow its instructions. In some embodiments, the directions or rule variations allow a player to resist the instruction or otherwise interpret the behavior as they wish. Additional instructions or directions suggest a player continue adding motifs that continue a pattern or enlarge a cluster; create a second or subsequent pattern, or add to a subsequent cluster; or change a characteristic of an existing pattern; or block future moves that might alter or add to a pattern. This kit may also have cards with instructions selected from a group that includes: break, destroy, displace, extract, move, open, remove, replace, rotate, separate, shift, stretch, substitute, swap; and includes moving, replacing or removing a previously played motif.

This kit may have several iterations, versions, or types of motifs. This kit may have a set of 2 motifs, more than 2, more than 3, more than 4, more than 5, more than 6, more than 7, more than 8, more than 9, more than 10, more than 11, or more than 12 unique motifs. This kit may have more than one of each unique motif, as in sets of tiles where there are multiple iterations of each unique motif. An embodiment of this invention is a set of from two to twelve, or more, of unique motifs as described above.

In an embodiment, the kits of this invention include one or more motifs, instructions for playing emergent pattern games with the motifs, and optionally additional directions for how to play all or selected moves. The additional directions may be in a deck of cards, a die, a computer program, chosen by a player from a printed or electronic list, etc. This invention includes as embodiments a set with 2 or more motifs, a set with 3 or more motifs, a set with 4 or more motifs, and so on.

In an embodiment of this invention, a set of tiles has at least 10 copies of one motif for one person to play, at least 20 if 2 people, and noting that the play may be more rewarding if there is a minimum of 30 tiles of one motif and also additional tiles of other motifs. Alternatively, the motifs could be configured as stamps, and then only one is needed for one player to use or two players to share.

In an embodiment, this invention provides a deck of 3 or more cards, of 4 or more cards, of 5 or more cards, of 10 or more cards, 20 or more cards, 30 or more cards, and 40 or more cards, each card having a unique instruction directing how to play a motif of the games of this invention. The sets of this invention may have any of these size decks.

An embodiment of this invention is a two-dimensional motif for playing an emergent pattern game. This motif has a playing plane (86) and a theoretical minimal-area rectangular bounding box (88) that goes around the "playing plane." (FIG. 9A) This motif is not fully nor approximately radially reflectively symmetrical, nor fully nor approximately rotationally symmetrical. (FIGS. 9A and 9B, FIGS. 6A to 6G, FIGS. 11A to 11P, FIGS. 12A to 12R). (For more on reflection and rotation symmetry, visit https://faculty-.math.illinois.edu/~scamach2/Math103/9.2.pdf)

Included in embodiments of this invention are rules, directions, and instructions to use or play with this invention. They can be invented during play. There is a difference between an instruction for how the game ought to be played and a playful rule or direction of play, such as on a card or from a coach or referee or even another player. Some examples of directions include: continue in a line, until something interrupts it or the player chooses to stop or try another direction; parallel rectangle motifs may connect or nearly-connect to something else.

Figure 33A:
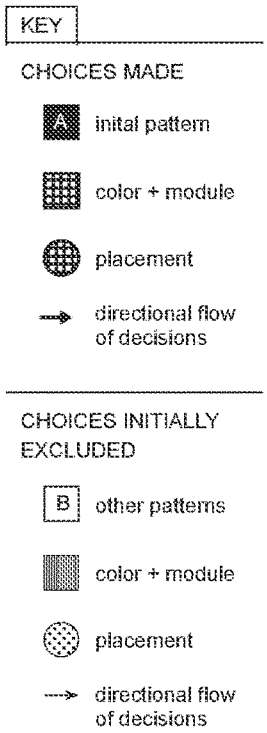
FIGS. 33A-33C show decision-tree schematics, FIGS. 33B-33C, with a key, FIG. 33A.
Figure 33B:
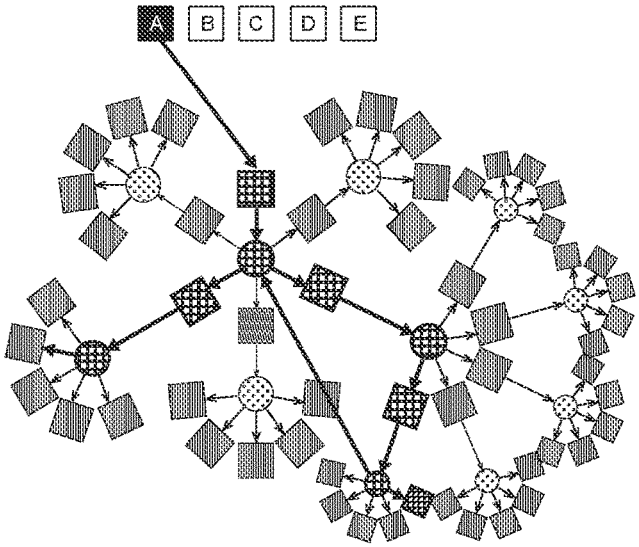
Figure 33C:
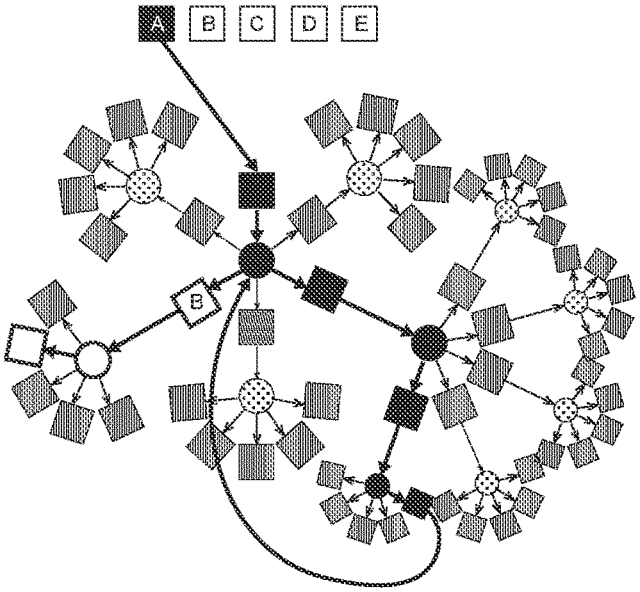

There are a range of ways to respond to motifs in play, including via other directions or prompts from Behavior cards, or prompts from other participants. Players having choices and making choices is in many embodiments of this invention. FIG. 33A shows a key to the FIGS. 33B to 33C decision-tree schematics. The schematics indicate some of the cascading decisions required to create an emergent pattern. In this simplified Decision Schematic, after each placement, there are 5 possible choices for the next placement. With each new choice, the possibilities of what was not chosen appear to recede. However, although each choice succeeds a previous choice, any of the other paths remains available. Likewise, the original choice of pattern is only one of n possibilities. FIGS. 33B to 33C show that an Agent (the chooser) chooses from an array of potential patterns and that each new choice holds the possibility that a developing pattern cluster could shift into becoming another pattern. That is, an Agent may switch to a different pattern with any choice. Motifs in play typically relate to others, through a pattern or accidentally or through adjacency or distance. Players may create and exchange rules with each other. There may be repetition of an action, such as placing a similar or same motif several times in a row. Players may create or have a direction or choice about when to begin, how to continue, and when to stop play. Play can optionally be timed. Players can choose different speeds to play, or notice pacing that is occurring.

There can be instructions constraining placement or quality of placement. Players can respond to how juicy (deep) or faded (shallow) each stamp impression is. There can be directions to start a pattern with some constraint, which may be chosen by the player, by another player, by a particular rule in that embodiment, by a chance operation, etc. There can be instructions to change one or more actions in a turn.

In an embodiment, two separate clusters can merge or crash into each other to create a larger cluster and/or two adjoined clusters. In an embodiment there is a rule or instruction about this or players can choose. Sometimes blocking in a patterned way can create a different pattern, such as a basketweave. In an embodiment there may be multiple patterns in a cluster, multiple ways a single motif shows up in patterns simultaneously. One can play by alternating with someone or with different motifs or roll dice to see how many motifs to play.

In embodiments with Behavior cards, a direction can be that players have options to adhere to or resist the behavior on card, that is, they can go with or against it, or relate to the behavior in other ways. Players may respond to a behavior card that they or another player draws, or that they receive through a chance operation. Players can note inner experience before, during, after any move. There can be a direction asking players to check in and notice feelings/emotions before/after each move.

Games of this invention may be a finite length of time, a finite length of motifs or motif movements, and they may be infinite and undefined in their length. Directions or invented rules can be on a continuum of technical to poetic.

A motif of this invention extends to, or nearly extends to, at least one corner of its bounding box, and leaves at least one side partly open (FIG. 7B). The motif by itself or with one or more other motifs of its kind cannot be arranged into a solid regular polygon or solid regular shape. A motif of this invention also has one of the following characteristics: a) it is bilaterally reflectionally asymmetric; or b) it is fully reflectional bilaterally symmetric; or c) is fully reflectional bilaterally symmetric and is made up of two or more parallel rectangles of the same length and of two or more different widths (FIGS. 11A to 11L); or d) it's approximately fully reflectionally bilaterally symmetric; or e) it's fully or approximately reflectional bilaterally symmetric and also does not extend fully to two corners of the bounding box; or f) it can be broken down or divided into two or more contiguous polygons or solid basic shapes selected from the group consisting of square, circle, triangle, rectangle, oval, star, pentagon, hexagon, trapezoid, and parallelogram; or g) the motif extends to less than 50-95% of the perimeter of its bounding box, or in a range that includes 20-95% to 40-75% of the perimeter; or h) the motif extends to less than 30-95% of the area of its bounding box; or i) the motif is approximately less than 30-90% self-nestable, that is it doesn't fully nest or interlock with itself; or j) the motif is reducible to ten or fewer through this range to two or fewer convex polygons; or it's reducible to two or more to eight or more convex polygons; or k) it's a relatively simple shape, where the motif is reducible to fewer than six, five, four, three, or two basic shape (11 in FIG. 8).

FIGS. 5A and 5B show two distinct tile versions of the same irregular shaped motif. FIG. 5A shows the tile base in the shape of the motif. FIG. 5B shows the motif in the bounding box of a regular quadrilateral polygon. In this preferred instantiation, the shape has sections of different lengths and widths. These differences allow the rotation of the shape to show up in each placement. When the shape has a bounding box, the area that is not filled with shape—negative space—becomes part of whatever pattern is created. When the shape has no bounding box, how much space between the tiles when placed becomes part of the decision of how to place each one. FIGS. 6A to 6G show some possible irregular shapes as motifs on both regular and irregular polygonal tiles. Each shape relates to the polygon bounding by filling a percentage of the polygon's edges. When tiles are placed, whether aligned edge-to-edge or misaligned, the shapes and negative spaces connect to form larger shapes. If the tiles are placed to form patterns, both shape and negative space contribute to the pattern. The irregular shapes are designed to avoid association, being neither strict or regular geometrics shapes nor organic or biological or natural-looking shapes. FIG. 2B shows the motif within a theoretical bounding box. The irregular shape, black against a white background, is abstract and geometric yet is not recognizable as a particular, known shape. When used in a pattern, the way this shape is irregular allows the pattern-creator to track which way it is rotated or how it is aligned or mis-aligned. When the irregular shapes are within a bounding box, as shown, the white interstitial areas are as visually salient as the black shape areas.

This motif of this invention may be embodied as stamps, tiles, or shaped tiles. Stamps and tiles may be in physical or analog embodiments. They may be in digital, software, or virtual reality embodiments. preferred size is typically easy to manipulate by a hand or fingers however large-scale or much larger versions are possible and would invite a different and useful range of effects and interactions. Motifs of this invention are preferably reusable at least several times. FIGS. 3A to 3B show two instantiations of a particular irregular shape motif. FIG. 3A shows the motif on a base as a tile. FIG. 10A to 10D show a parallel stripe motif and three different versions of printing stamps with that motif. FIGS. 10E to 10H show an irregular polygon motif and three different versions of printing stamp construction with that motif.

The stamp versions of Emergent Pattern Game or Process described here are similar to the tile versions but with some important differences. When an Emergent Pattern is created using stamps, the placements may include overlaps as well as the gaps that are possible with the tiles. These overlaps are visible and become part of the pattern or design, whether intentional or through inattention or a particular range of motor control. With the stamps, the Emergent Pattern cannot be changed once placed, however other patterns or stamp placements can occur on top of a pattern that has been made. Though patterns may overlay with the tile version, if the tiles are opaque, they do not reveal underlying patterns, however tiles may be transparent, of glass or plastic, and reveal underlying patterns.

Figure 11A:
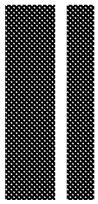
FIGS. 11A to 11P show permissible embodiments of parallel rectangle motifs for both stamp and tile pieces where each rectangle per motif is a distinct width.
Figure 11D:
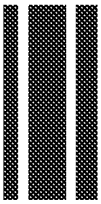
FIGS. 11M to 11O show variations of linear or rectangle motifs in which the rectangles are not parallel.
Figure 11G:
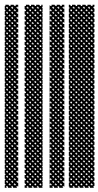
Figure 11J:
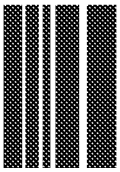
Figure 11B:
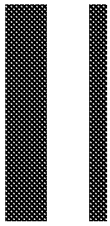
Figure 11E:
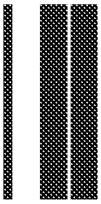
Figure 11H:
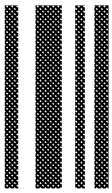
Figure 11K:
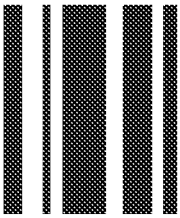
Figure 11C:
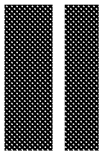
Figure 11F:
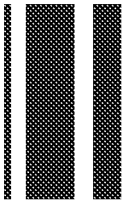
Figure 11I:
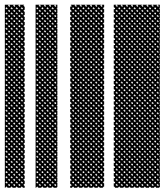
Figure 11L:
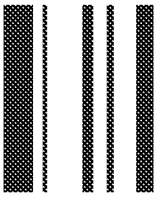
Figure 11M:
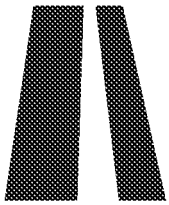
Figure 11N:
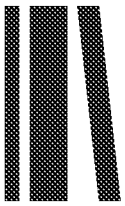
Figure 11O:
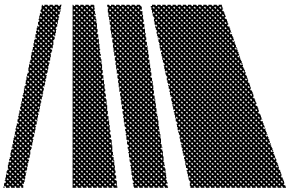
Figure 11P:
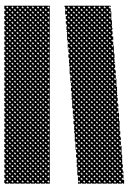
Figure 12A:
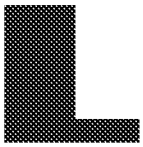
FIGS. 12A to 12R show possible irregular polygon motifs for both stamp and tile pieces.
Figure 12D:
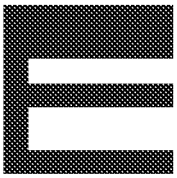
Figure 12G:
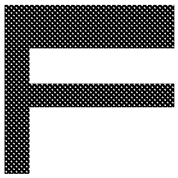
Figure 12B:
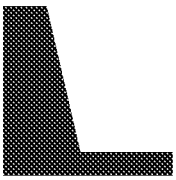
Figure 12E:
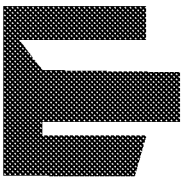
Figure 12H:
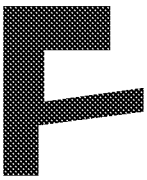
Figure 12C:
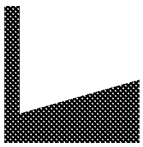
Figure 12F:
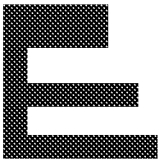
Figure 12I:
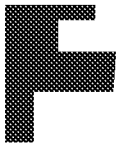
Figure 12J:
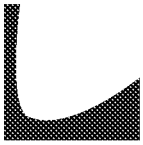
Figure 12K:
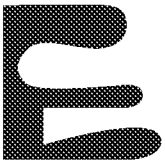
Figure 12L:
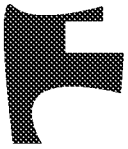
Figure 12M:
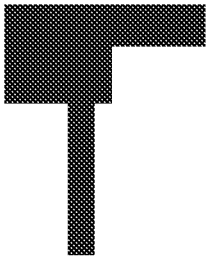
Figure 12N:
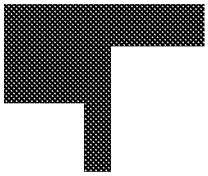
Figure 12O:
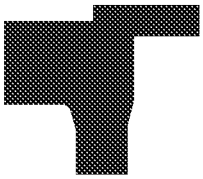
Figure 12P:
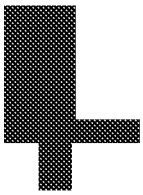
Figure 12Q:
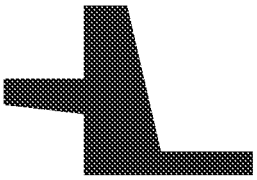
Figure 12R:
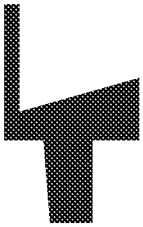

FIGS. 11A-11L show permissible embodiments of parallel rectangle motifs for both stamp and tile pieces where each rectangle per motif is a distinct width. FIGS. 11M to 11P show variations of parallel rectangle motifs in which the rectangles are not parallel. Each motif shown in FIGS. 11A to 11P is a unique possible arrangement. There are more possibilities for each. Typically, each motif is a unique length and width in a given round of operations/game play. Though inclusive of up to n rectangles, for embodied play the number of stripes per segment (motif) will max out in the low double digits, as it is preferred that each motif is visible in and of itself. FIGS. 12A to 12R show possible irregular polygon motifs for both stamp and tile pieces. Each motif here is only one unique possibility among many. For embodied play, players choose distinctly proportioned and scaled shapes.

A motif of this invention, when configured with a selection of the group, may be in the form of printing on paper, whether electronically printed or manually or otherwise; as a stamp that gives impressions when inked or into a soft surfacer such as wet clay (FIGS. 10B to 10D and 10F to 10H; as a tile whose backing is at least approximately the same shape as the motif itself; or as a tile with minimally-sided and minimal-area bounding polygon base (FIGS. 10B to 10C, FIGS. 10F to 10G).

Motifs of this invention when stamps, also called printing blocks, are used for printing. This embodiment is preferable if there is a wish to create visual records of the history of moves. In this embodiment, there are opportunities to overlap motifs or overlay one pattern on top of another. This method includes the possibility of a unique imprint or fingerprint for each use of a unique motif, even as a unique impression per motif may occur by using stamps with transparent inked stamp pads. For software/video game/virtual reality, a unique impression per unit would be included in the coding. This unique impression could also be numeration or naming, that is, each instantiation of an icon/module has a unique number or name.

A motif of this invention when a tile may have an approximately rectangular shape or irregular polygon that extends beyond the motif. A motif of this invention has preferred material that is rigid or minimally flexible, including but not limited to plastic, metal, glass, card- or chipboard, plywood, or bone. In an embodiment of this invention, tiles can be created by printing motifs onto paper with an electronic printer, by hand, or otherwise, with at least two possibilities of having a shaped tile cut to the outlines of the motif and a motif in a bounding box. In an embodiment, tiles are marked so that although there are numerous instantiations of a single motif, each instantiation is unique. This marking can be textural (like a fingerprint) or a numeral or letter.

A motif of this invention is a tile in the shape of the motif. These shaped tiles have attributes of bounded tile, above, and additional attributes, including that, in a preferred embodiment, either face of shaped tiles can be used in play which adds variation and interest to the game and to the emergent patterns. FIGS. 4A and 4B show instantiations of a particular irregular shape motif, where the irregular shape is also the shape of the tile base. FIG. 4B shows shaped tiles also in use flipped over. Because the shape isn't bilaterally symmetrical, on any axis, flipping over some tiles brings added interest and complexity to the creation of patterns. In shape variations where the protuberances are different lengths, patterns include enclosed interstitial areas. (See also (FIGS. 22A and 22B, 29A to 29M, and 30A to 30K.)

This invention includes a method for playing an emergent tile pattern game, which has a plurality of motifs. In this method, playing two or more motifs creates a first pattern which may form a first cluster. In a cluster, two motifs are close enough to be recognizably clustered together. Clusters depend on a context. If they are in an open playing field, almost any two motifs might be said to be clustered. And if several motifs are scattered about, then any two motifs must be much closer together to be recognized as a cluster. In an embodiment, one way a cluster is defined, or a way to know if a placement of a motif is in an existing cluster, is when the outer edges of two neighboring motifs are at least as close to each other as at least one of: ~60% of the longest length of the motif or as close as about 20% of the entire length of said first cluster.

In this method, playing one or more of the first motif can accomplish any of the following possibilities: a) It approximately repeats an existing pattern and thereby enlarges that cluster, b) It creates a second pattern in that cluster or by forming a new cluster, c) It follows some of an existing pattern yet also substantially changes at least one characteristic of it (e.g., angle, distance), d) It blocks the ability of a future playing move to repeat or approximately repeat one of an initial or subsequent patterns in any given direction on the playing surface (Decision Field). (118 in FIG. 15C shows this if this round of play includes a rule excluding overrunning another player's pattern or motif.)

In an embodiment, while playing emergent pattern games of this invention, a player places a sufficient number of motifs in a cluster with similar enough positions that a first pattern emerges or is visible. In an embodiment, motifs become aggregated in clusters on the playing surface or Decision Field. Enough edges of motifs are close enough together or touch or overlap to form clusters, and patterns are discernable or noticeable by one or more players or software. In some embodiments, overlapping generates a different pattern in FIGS. 19J-19L than the earlier steps shown in FIGS. 19G-19I would suggest or anticipate. Likewise, FIGS. 20A, 20B, and 20C show three different patterns that began with the same initial moves; the pattern that emerges from FIG. 20C proceeding to FIG. 20F proceeding to FIG. 20I proceeding to FIG. 20L includes overlaps that distinguish it from the pattern that emerges from FIG. 20B proceeding to FIG. 20E proceeding to FIG. 20H proceeding to FIG. 20K.

In embodiments of this invention, patterns may interact with each other. In embodiments, the patterns show or demonstrate the decisions made by the player or players, and visually represent interactions. Motifs may be placed so far away from each other that there is effectively no relationship when placed, but there could be a relationship in future, such as a cluster is formed, a motif is place halfway between with other characteristics halfway between (e.g., angle, rotation, even color, depression depth).

Embodiments of this invention include a method by which a human, robot, AI, software algorithms, or a combination of these or others can create patterns of this invention, to be played by one or a plurality of persons or entities. An embodiment of this method can be used for training non-human Agents including but not limited to robots, artificial intelligences, new technological entities, or a combination of these Agent types, about a range of irregularities within regularities; about quantities of acceptable variation within a known pattern; about biomimicry and patterns.

Embodiments of this invention include a method for practicing motor skills in which the possibility of overlaps, alignments, reversed or rotated stamps trains the user to accuracy or for practicing or training a user or Agent or player to accept or learn about irregularity and the practitioner's varying attention and choices. This method includes a user or Agent practicing acceptance or tolerance or inclusion of irregularities or what may otherwise be considered an error.

Embodiments of this invention include a method that allows a visual record of the user's attention and motor skills. Embodiments of this invention include a method for recording decisions, in which each choice made by an Agent or using this process leaves a visual record, including, when a plurality of players, how different players' decisions appear adjacent/overlapping/apart from each other. Embodiments of this invention include a method for practicing flow and ease with decision making, and which includes the possibility of leaving a visual record of each decision.

Embodiments of this invention include a method that allows players or agents to determine how many motifs and placements are required to show a pattern. Embodiments of this invention include a method to seek patterns that incorporate decision changes or irregularities. Embodiments of this invention include a method of creating particular kind of patterns that show a range of irregularities that might appeal to human aesthetics, including inconsistent overlaps, slight to large motif rotations, slight to large asymmetric motif placements, or a balance made by user's choices between regularity and irregularity. Embodiments of this invention include a method for making decorations especially in these aforementioned regular-irregular balanced patterns.

While the motifs, kits and methods of this invention are not designed for making a regular, continuous basketweave, they could be used to make a regular basketweave for part of the play if someone chooses that, and this may say something about their personality (e.g., rigid, rhythmic, compulsive), as might someone playing a blocking motif (e.g., they may feel frustrated or upset). While the motif, kits and methods of this invention are not designed for making random placements and chaos, someone might choose to do this or discover that they have been doing this for a while. They have the opportunity to notice that they've chosen this messiness. Playing chaos is an interesting "invitation" if playing with others too.

This invention can serve as a means for exploring what a pattern is or might be, and lead to: opening up creativity;

observing how much creativity can be put into play; recognizing and changing decision/choice patterns; insight into how others think and behave; recognizing personality styles, how there is response to constraints, open choice, directions; observing patterns of people and personality styles interacting; offering a contained or safe setting to test or play with communication, collaboration; gaining awareness around behaviors/preferences/styles/choices; changing people and their personalities with respect to styles of interacting; uncovering hidden operating patterns among team members; adopting strategies to understand self and others; redefining mistakes and the role they play in a team's ability to grow; increasing an individual's ability to tap into underlying truths and unspoken rules; elevating collaborative work through improved communication skills; up-leveling a team's ability to play with agency and improve decision-making processes; improving trust and psychological safety; modeling ways things interact with each other, making visible (behavior patterns); or engaging employees through a day of playful learning and development.

Other purposes include: recording pattern choices for use in the moment and later; making patterns as artwork or on textiles; making art; playing for fun.

In embodiments of this invention, the motifs, games, and kits of this invention are useful for: self-inquiry (why did I choose that, where did that choice lead me?); curiosity about others (where did their choice lead them); self-understanding (what can or did I learn making that choice?); measuring/comparing/learning (looking at multiple iterations); the unusual experience of witnessing a pattern laid out in steps.

In embodiments of this emergent pattern game invention, personality characteristics come into play, including: exactness, looseness; creativity, change; playfulness, rigidity; responsiveness (to what another does) or influence-ability; what role one plays in a group; fostering attention, autonomy, agency; fostering a new relationship to perfection, acceptance of so-called errors; collaboration, non-competitiveness; capacity to offer feedback, in different forms including verbally, through body language, and using the motifs of this invention; working with ranges of constraints and freedom.

Psychological characteristics could impact how a player potentially makes decisions in every aspect of play. These characteristics include how much patience or how much tolerance for discomfort or uncertainty a player has. A player's assurance around their creativity will affect how they play. Without support from a facilitator, those with doubts about whether they are creative may restrict how much creative expression or risk taking they allow themselves (even within the constraints of the game); they may be deterred by their discomfort. In the more collaborative and interactive parts of the game, players' social ease and self-regulation will offer them readier access to playfulness and human connection. Again, facilitated versions of this game offer support to and the possibility of psychological shifts to those who struggle more with sociality. The Agent/Player needs to make choices about placement and may take the opportunity to work with their discomfort around imperfections, their limitations or skill with their body.

In embodiments of this invention, the play can serve as a visual recording of choices and collaboration. When played with stamp motifs, the impressions form a fixed record of the choices. This invention can include considering choices or feeling the impact of choices. This invention is about inventing/changing/combining patterns. This invention can include collaborating and co-creating. A person plays with a set of the invention to learn how they themselves respond to repetition and regularity. A person plays with a set of the invention to understand their own motor skills and also to notice whether they are concerned about their level of skill. A person plays with this game to expand their creativity This invention may train a robot or an Artificial Intelligence to operate within ranges of flexibility, tolerance for error, and pattern recognition that humans do naturally. In an embodiment, the robot or artificial intelligence can learn to create patterns with irregularities and errors that accord with how a human behaves in the range of their attention, from focused to mind wandering.

This invention may be used as a team building process or game for people who work together or will begin to work together. Using this emergent pattern game for team building may be done with facilitation or through the self-organization of a group.

In a facilitated version of this invention, an option is that a facilitator notices meta patterns and asks questions (that might prompt creativity); calls attention to how people might constrain themselves, for example matching perpendicular edges of motifs and surfaces, for example making assumptions about how to use motifs.

In an embodiment, a set of unique motifs (of which there may be a plurality of each) includes all the motifs shown in FIG. 11. In an embodiment, a set of such motifs includes two, three, four, five, six, seven, eight or ten of the motifs in FIG. 11.

In an embodiment, a set of such motifs includes all the motifs shown in FIG. 11. In an embodiment, a set of such motifs includes two, three, four, five, six, seven, eight or ten of the motifs in FIG. 12. In an embodiment, a set of such motifs includes only the motifs that are closed curve shapes. In an embodiment, a set includes only motifs that are reduceable to two convex polygons, three convex polygons, four convex polygons, or four or fewer convex polygons. In an embodiment, the set includes only motifs that form one contiguous polygon or closed curve or two separate contiguous polygons or closed curves. In an embodiment, the set only includes motifs made of parallel rectangles.

EXAMPLES

Learning about Individual Choices

First variation: A person uses a set of the invention, with a single motif as a stamp with an aim to create a pattern following a step-and-repeat rule. They take one motif in the form of a stamp and one inkpad and press the stamp into the ink then onto a playing surface which, in this instance, is a large piece of paper. With this step they're learning how to see a pattern form from their individual choices to continue the same or similar steps.

Second variation: after there are sufficient impressions of the motif to show a pattern to the person creating it, the person then begins to add new impressions that change the pattern. The original pattern then becomes a starting point for new ideas. Because the stamp impressions are fixed on the paper, the decisions that created the original pattern and those that shifted away from it, are visible. The stamps are not numbered though, so the order used to create it is not recorded unless the sequence is specifically noted, such as on the playing field.

Learning about Mutual, Collaborative, and Individual Choices

Two or more people use a set of the invention, including a plurality each of four unique motifs, a playing surface, and a set of instructions. Optionally, they have a catalog of known patterns that can be made with this invention and a set of Behavior cards. Both people stand at the table they are playing on. Each chooses a unique initial motif and chooses where to place their first motif—simultaneously. They pause and look at what the other chose. They each choose a next motif that is of the same plurality as their first motif, place it, and again consider what the other chose. Play may continue repeating these actions, and can also include, at intervals of placing 10-30 motifs (if the motifs are small relative to the playing surface), longer periods of consideration of what each person is choosing. During these longer periods, each person describes why they have made particular choices and also what feelings and ideas they have about the choices. In this way, as patterns form on the paper, each player gains an understanding about their own choices and the choices of their co-player. This opens up creativity as they learn about their variation in a low-impact, non-competitive setting.

When playing with another player, players discover that when they establish a noticeable pattern, that they can communicate about this pattern to their co-player. They can then experience how to change it, or share how to shift it with their co-player. This builds skills for creating together in life and work.

People in the workplace have a need to learn about how others make choices and how others work in a setting where no one's expertise interferes with sharing and where the business success is not dependent on the outcome. This invention provides sets and methods for people to do this.

Tracking Choices

An individual wants to understand something about their choices. They decide to note each decision as they use the kits of this invention to create multiple pattern clusters on a playing surface. They put numbers by the tiles (or use tiles that already have numbers) to keep track of the order of decisions and how many decisions they make as their clusters and patterns reach a size that they like. They also take notes on their thoughts and feelings as they play each tile, including the ways they chose to have the patterns interact with each other and what changes they made to those interactions. They take photographs of different stages of how the patterns are on the playing surface to further track when and where decisions are made, and note-taking to track their "why." The individual is curious about how their mood and internal narratives impact any particular decision; they want to build self-awareness around decision-making and so go slowly enough in this play to evaluate each decision. Tracking each tile placement allows them to connect each decision with the moment's mood, internal dialog, and physical state. For example, they notice that, when they are especially tired, they question each tile placement closely and the pattern becomes more rigid.

Facilitated Play where a Coach Notices Meta Patterns

A coach comes to a team that works together, bringing a game of this invention. As the team members play, the coach pays attention to how team members place motifs on the playing surface; how team members interact with each other; and how team members respond to the coach's prompts and requests for input. This information allows the coach to notice and recognize behavioral patterns, and asks the team if these observed patterns match how team members do/don't collaborate, are creative, etc. and they say yes. The coach works with each of them individually, where they each play, and the coach makes suggestions, supporting them to practice new skills.

Self-Organized Team Play

Team members gather to play a game of this invention together and practice new skills while playing with each other. Every time they play. the patterns they create individually and together are different. How they form and who they interact with are different. With more practice with the game individually and together, these new patterns get easier. When the team works on a project together, their awareness of how patterns form or change and this helps them negotiate teamwork.

When they do work together, they sometimes make reference to the game and how they could stretch to do things in new ways in their work that the game has symbolized. They begin to learn and practice new skills at work in ways that parallel with the game. Their manager also references the game play to encourage and celebrate new work styles. The team is more creative together, knows how to collaborate more, plus they have skills for playfully disagreeing and suggesting alternatives when new ideas emerge. They better include new ideas now, in all their work.

Discovery of a Pattern During Play

An example occurred with a group of several people as an activity at a gathering. Six people gathered around a table, and using the emergent pattern system and method rule and suggestion book, "Operating Manual," they took the following steps. Playing surfaces, made of paper, were laid on the table, one paper per participant. Each player chose a stamp and a color of stamp pad. Each player used a motif to create a repeat pattern, by placing one motif after another on the surface until they determined a pattern had evolved. The player then filled their paper with the same pattern.

Later, larger paper was spread across the whole table. Players began to place motifs in clusters, creating areas of a particular pattern. This play also included players making a move (approximately a complete stamping move) responding to the playing surface; and players making a subsequent move to create a pattern or discover a pattern algorithm (proximity, space-overlap, angle, arrangement, exact-loose, with or without variations). It was an optional part of this play for players to notice what feelings arose as they made decisions about placement and as they interacted with other players.

When patterns grew big enough on the playing surface that they neared each other, players each drew a Behavior card that determined how the pattern they created would interact with the encroaching pattern. Each player responded particularly to the Behavior card suggestion. Eventually, most of the area of the playing surface was full, and the play ceased.

No Pattern Forms at First, then Repeating & Blocking

Someone plays with a game kit of this invention. After playing for 5 minutes, having placed 15 motifs, still no clear pattern has emerged. While one could use the games, kits and motifs of this invention to avoid making patterns, that is generally not the aim. After placing 3 more motifs, suddenly a pattern emerges that is also in a cluster! The 19th motif is placed to repeat the pattern and enlarge the cluster. The 20th motif is placed to enlarge the cluster and to change the pattern by rotating the motif, about 15 degrees. The 21st motif is placed to enlarge this cluster and repeat this new angle. The 22nd motif is placed far enough away that it is not in the cluster, yet it is placed slightly less than the longest length of the motif way and placed at a different angular rotation to block the ability to continue the cluster's pattern in this direction.

Children and Teenagers Play Together at a Camp

A couple of older teenagers are camp counselors in charge of a group of ten year olds. The teenagers set up a playing surface that covers two picnic tables end-to-end, and distribute printing motifs and ink pads among the children. The children are also given catalogs of patterns along with kindly offered instructions for them to make patterns. There is also a deck of Behavior cards. Children roll dice to select which pattern they will create initially. When about 10 minutes have elapsed, the camp counselors ring a bell and pause the action. They ask the children to choose new places around the table, each choose a Behavior card, and begin to add or change a pattern created by another child. They ask the children to share if they are excited or concerned about "messing up" what someone else started. They reassure the children that any placement of a motif is acceptable. The counselors also choose motifs and create patterns, and they carefully place their motifs to interact kindly with the children's placements. The counselors model non-competitiveness and flexibility. They repeat these steps three or four times, or more, until the paper is filled. If there is a child who does something that seems to be outside the rules, like printing the same motif in a line across the entire length of the paper, the counselors accept this behavior and encourage the other children to work with the results of those decisions. When the paper is filled, counselors and children gather around it. Children talk about what they were thinking about while they made their patterns, how they feel now looking at what was made, what parts of the process they enjoyed, what they didn't enjoy, and what they would do the same or differently if they played again. The counselors talk about how differently each child acted, noting how they all contributed. The children are practicing embracing diversity, collaborating, sharing, self-acceptance, and much more.

An Anarchic Person and an Organized Person Play Together on One Decision Field

Colleagues at an organization who like each other but with different working styles and temperaments agree to play several rounds of games of this invention across several weeks. They are curious to know how their differences will interact, and what they will learn about each other, themselves, and collaboration, in an arena in which neither is an expert and neither needs to accomplish anything in particular. They agree to alternate who chooses instructions for any round of play. Over the course of their experiment, they keep notes about their beliefs and opinions about the other's behavior, and how the other's choices impact them and the patterns on the Decision Field. They share their learnings at the end of the experiment. The anarchic, experimental person notices ways in which their colleague seems to maneuver to control the game surface but that also, over time, that colleague's playful side emerges due to playing in a low stakes environment. The anarchic, experimental person also notices that they are sometimes able to riff on or tweak the seemingly rigid patterns created by their colleague, and even involve the organized colleague's participation in unruliness. Likewise, the organized person is sometimes flummoxed by the apparently wild and arbitrary motif placements by their colleague. Yet over several weeks, the organized person develops strategies for creatively incorporating the wildness into their own patterns or in gently deflecting the chaos. Each person borrows from the other's behaviors at times, in ways that surprise them both. The stamped results of each week's games look different and help remind the colleagues of the arc of their experiment.

Romantic Partners

A couple gets out a game kit of this invention with two pluralities of two different motifs. They read the instructions and set up on the table to play. They each play motifs, taking turns and talking about their choices at times. One ventures to place a motif near one of their partner's patterns. One of them feels scared, and they talk about it. They explore what they can collaboratively make together and enjoy the process. They observe the different patterns they have each made, their styles and discuss how their styles interact together. They feel excited to discover that they enjoy collaborating. They play more.

The foregoing description, including preferred embodiments of the invention, has been presented for the purposes of illustration and description in detail. It is not intended to be exhaustive or to limit the invention to the precise form disclosed. Many modifications and variations are possible in light of the above teaching. It will be readily understood by those skilled in the arts that various modifications may be made therein without departing from the spirit of the disclosure or from the scope of the appended claims.

The invention claimed is:

1. A method for playing an emergent pattern game comprising:

providing a plurality of a first 2-dimensional motif, said motif having a playing plane, a longest length, and a theoretical minimal area rectangular bounding box containing said motif along said playing plane, wherein:

said motif is radially reflectively asymmetric;

said motif is rotationally asymmetric;

said motif extends to or extends to about at least one corner of said box;

said motif extends less than fully to at least one side of said box; and said motif by itself does not consist of nor can two or more of said first motifs be arrangeable to consist of a solid regular polygon or solid basic shape;

playing a portion N of said plurality thereby creating a first pattern formed by two or more of said played first motifs in a first cluster, wherein in said cluster an edge of each first motif in said cluster is at least as close to a neighboring first motif in said cluster as whichever is greater: about 60% of said longest length or 20% of the entire length of said first cluster; and playing an N+1 first motif thereby comprising at least one of:

about repeating said first pattern and enlarging said first cluster;

creating a second or subsequent pattern in said first, a second or a subsequent cluster;

substantially changing a characteristic of at least one of said first, second or subsequent patterns; and blocking the ability of a future playing move to about repeat one of said first, second or subsequent patterns in a direction on said playing plane; and the method further comprising one or more of the following:

assessing a playing rhythm, preference or tendency; and predicting a psychological, personality or collaboration characteristic.

2. A method for playing an emergent pattern game comprising:

providing a plurality of a first 2-dimensional motif, said motif having a playing plane, a longest length, and a theoretical minimal area rectangular bounding box containing said motif along said playing plane, wherein:

said motif is radially reflectively asymmetric;

said motif is rotationally asymmetric;

said motif extends to or extends to about at least one corner of said box;

said motif extends less than fully to at least one side of said box; and said motif by itself does not consist of nor can two or more of said first motifs be arrangeable to consist of a solid regular polygon or solid basic shape;

playing a portion N of said plurality thereby creating a first pattern formed by two or more of said played first motifs in a first cluster, wherein in said cluster an edge of each first motif in said cluster is at least as close to a neighboring first motif in said cluster as whichever is greater: about 60% of said longest length or 20% of the entire length of said first cluster; and playing an N+1 first motif thereby comprising at least one of:

about repeating said first pattern and enlarging said first cluster; creating a second or subsequent pattern in said first, a second or a subsequent cluster;

substantially changing a characteristic of at least one of said first, second or subsequent patterns; and blocking the ability of a future playing move to about repeat one of said first, second or subsequent patterns in a direction on said playing plane; and the method further comprising:

providing a set of instructions directing how to play said motifs; and following an instruction from said set directing how to play one of said first motifs.

3. The method of claim 2 wherein said instruction is selected from the group consisting of: alternate, amplify, avoid, combine, conclude, continue, coordinate, deflect, differentiate, diverge, expand, extend, flip, flirt, fortify, intermingle, interrupt, invert, loosen, nudge, persist, redirect, respond, reverse, start, tease, tighten, transition, and veer.

4. A method for playing an emergent pattern game comprising:

providing a plurality of a first 2-dimensional motif, said motif having a playing plane, a longest length, and a theoretical minimal area rectangular bounding box containing said motif along said playing plane, wherein:

said motif is radially reflectively asymmetric;

said motif is rotationally asymmetric;

said motif extends to or extends to about at least one corner of said box; said motif extends less than fully to at least one side of said box; and said motif by itself does not consist of nor can two or more of said first motifs be arrangeable to consist of a solid regular polygon or solid basic shape;

playing a portion N of said plurality thereby creating a first pattern formed by two or more of said played first motifs in a first cluster, wherein in said cluster an edge of each first motif in said cluster is at least as close to a neighboring first motif in said cluster as whichever is greater: about 60% of said longest length or 20% of the entire length of said first cluster; and playing an N+1 first motif thereby comprising at least one of:

about repeating said first pattern and enlarging said first cluster;

creating a second or subsequent pattern in said first, a second or a subsequent cluster;

substantially changing a characteristic of at least one of said first, second or subsequent patterns; and blocking the ability of a future playing move to about repeat one of said first, second or subsequent patterns in a direction on said playing plane; and wherein playing a motif comprises a) stamping said motif on or in a playing surface and b) overlapping a portion of a previously played motif with said stamping.

5. A kit for playing an emergent pattern game comprising:

at least one 2-dimensional motif for playing an emergent pattern game, said motif having a playing plane and a theoretical minimal area rectangular bounding box containing said motif along said playing plane, wherein:

said motif is radially reflectively asymmetric;

said motif is rotationally asymmetric;

said motif extends to or extends to about at least one corner of said box;

said motif extends less than fully to at least one side of said box; and said motif by itself does not consist of nor can two or more of said first motifs be arrangeable to consist of a solid regular polygon or solid basic shape;

instructions for playing said emergent pattern game comprising:

playing a first motif and optionally playing subsequent N motifs;

playing a second or N+1 motif thereby creating a first pattern formed by two or more of said played motifs in a first cluster, wherein in said cluster an edge of each first motif in said cluster is at least as close to a neighboring first motif in said cluster as whichever is greater: about 60% of said longest length or 20% of the entire length of said first cluster;

playing a third or N+2 motif comprising at least one of:

about repeating said first pattern and enlarging said first cluster;

creating a second or subsequent pattern in said first, a second or a subsequent cluster;

substantially changing a characteristic of at least one of said first, second or subsequent patterns; and blocking the ability of a future playing move to about repeat one of said first, second or subsequent patterns in a direction on said playing plane; and three or more directions for playing all or selected motifs, said directions configured as a list or deck comprising three or more cards, each card having a unique instruction directing how to play one or more of said motifs, said direction comprising: accompany, allow, alternate, amplify, augment, avoid, combine, commingle, conclude, continue, coordinate, deflect, differentiate, diverge, encourage, expand, extend, extrapolate, filter, flip, flirt, flow, fortify, infuse, intensify, intermingle, interrupt, interpolate, invert, loosen, nudge, overrun, pace, persist, redirect, rejoin, relieve, respond, reverse, start, suggest, tease, tighten, transfer, transition, or veer; and said instructions further comprising a step of selecting one of said directions and following or doing the opposite of the direction while playing at least one subsequent motif.

6. The kit of claim 5 further comprising:

a card comprising an instruction selected from the group consisting of: break, destroy, displace, extract, move, open, remove, replace, rotate, separate, shift, stretch, substitute, swap; and moving, replacing or removing a previously played motif.

7. The kit of claim 5 further comprising a plurality of said first motifs.

8. The kit of claim 5 further comprising a set of: 2, more than 2, more than 3, more than 4, more than 5, more than 6, more than 7, more than 8, more than 9, more than 10, more than 11, or more than 12 unique motifs.

9. The kit of claim 8 further comprising a plurality of each unique motif.

* * * * *